US009146499B2

(12) United States Patent
Kikuchi et al.

(10) Patent No.: US 9,146,499 B2
(45) Date of Patent: Sep. 29, 2015

(54) TONER CONTAINER AND IMAGE FORMING APPARATUS WITH A MECHANISM TO SECURE THE TONER CONTAINER

(71) Applicants: Kenji Kikuchi, Kanagawa (JP); Eisuke Hori, Tokyo (JP); Yuji Suzuki, Tokyo (JP); Hideki Kimura, Kanagawa (JP); Nobuo Takami, Kanagawa (JP); Noriyuki Kimura, Kanagawa (JP)

(72) Inventors: Kenji Kikuchi, Kanagawa (JP); Eisuke Hori, Tokyo (JP); Yuji Suzuki, Tokyo (JP); Hideki Kimura, Kanagawa (JP); Nobuo Takami, Kanagawa (JP); Noriyuki Kimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/307,185

(22) Filed: Jun. 17, 2014

(65) Prior Publication Data

US 2014/0294435 A1 Oct. 2, 2014

Related U.S. Application Data

(63) Continuation of application No. 13/411,134, filed on Mar. 2, 2012, now Pat. No. 8,792,809, which is a continuation of application No. PCT/JP2010/059968, filed on Jun. 11, 2010.

(30) Foreign Application Priority Data

| | | |
|---|---|---|
| Sep. 4, 2009 | (JP) | 2009-204368 |
| Sep. 4, 2009 | (JP) | 2009-204403 |
| Sep. 4, 2009 | (JP) | 2009-204459 |
| May 27, 2010 | (JP) | 2010-121808 |
| May 27, 2010 | (JP) | 2010-121919 |
| May 27, 2010 | (JP) | 2010-121974 |

(51) Int. Cl.
*G03G 15/08* (2006.01)

(52) U.S. Cl.
CPC ..... *G03G 15/0872* (2013.01); *G03G 15/0868* (2013.01); *G03G 15/0886* (2013.01); *G03G 2215/0692* (2013.01)

(58) Field of Classification Search
CPC ..... G03G 15/0886; G03G 2215/0692; G03G 2215/067; G03G 15/0872; G03G 15/0868
See application file for complete search history.

(56) References Cited

U.S. PATENT DOCUMENTS

| | | | | |
|---|---|---|---|---|
| 5,848,342 | A | 12/1998 | Tanda | |
| 6,438,345 | B1 * | 8/2002 | Ban et al. | 399/262 |
| 6,826,381 | B2 | 11/2004 | Muramatsu et al. | |
| 6,882,817 | B2 | 4/2005 | Kita | |
| 7,133,629 | B2 | 11/2006 | Kita | |
| 7,248,824 | B2 | 7/2007 | Takami | |
| 7,389,071 | B2 | 6/2008 | Katsuyama et al. | |
| 7,426,362 | B2 | 9/2008 | Takami | |
| 7,457,564 | B2 | 11/2008 | Takami | |
| 7,515,855 | B2 | 4/2009 | Katsuyama et al. | |
| 7,590,374 | B2 | 9/2009 | Takami | |
| 7,596,338 | B2 | 9/2009 | Mihara | |
| 7,792,468 | B2 | 9/2010 | Ichikawa et al. | |
| 2007/0086809 | A1 * | 4/2007 | Yamane | 399/258 |
| 2007/0092302 | A1 | 4/2007 | Koyama | |
| 2007/0122205 | A1 | 5/2007 | Taguchi et al. | |
| 2007/0154244 | A1 | 7/2007 | Taguchi et al. | |
| 2007/0177886 | A1 | 8/2007 | Taguchi et al. | |
| 2007/0223972 | A1 * | 9/2007 | Isomura | 399/262 |
| 2008/0025743 | A1 | 1/2008 | Hori | |
| 2008/0199224 | A1 | 8/2008 | Isomura et al. | |
| 2008/0298835 | A1 | 12/2008 | Takashima | |
| 2009/0074471 | A1 | 3/2009 | Takami | |
| 2009/0129813 | A1 | 5/2009 | Nagashima et al. | |
| 2009/0129827 | A1 | 5/2009 | Ichikawa et al. | |
| 2010/0003055 | A1 | 1/2010 | Kikuchi et al. | |
| 2010/0003058 | A1 | 1/2010 | Hori et al. | |
| 2010/0111572 | A1 | 5/2010 | Hori et al. | |
| 2010/0129118 | A1 | 5/2010 | Kimura et al. | |
| 2010/0166460 | A1 | 7/2010 | Maeshima | |
| 2010/0226690 | A1 | 9/2010 | Kadota et al. | |
| 2010/0232840 | A1 | 9/2010 | Kitagawa et al. | |
| 2011/0058857 | A1 | 3/2011 | Hori et al. | |
| 2011/0262180 | A1 | 10/2011 | Suzuki | |

FOREIGN PATENT DOCUMENTS

| | | |
|---|---|---|
| JP | 2002-268356 | 9/2002 |
| JP | 2007-065613 | 3/2007 |
| JP | 2007-102133 | 4/2007 |
| JP | 2007-219417 | 8/2007 |
| JP | 2008-112198 | 5/2008 |
| JP | 2009-122559 | 6/2009 |
| JP | 4380639 | 10/2009 |
| JP | 2011-76063 | 4/2011 |

OTHER PUBLICATIONS

Japanese Office Action issued May 8, 2013 in Japanese Patent Application No. 2012-061296 with English translation.

Japanese Office Action issued Nov. 29, 2011 in Japanese Patent Application No. 2010-121919 with English translation.

Japanese Office Action issued Nov. 29, 2011 in Japanese Patent Application No. 2010-121974 with English translation.

U.S. Office Action for corresponding U.S. Appl. No. 13/411,211 dated Mar. 28, 2014.

* cited by examiner

*Primary Examiner* — Sandra Brase

(74) *Attorney, Agent, or Firm* — Oblon, McClelland, Maier & Neustadt, L.L.P.

(57) ABSTRACT

A toner container and system for mounting and/or securing the toner container includes a toner container having a toner dispensing hole, a shutter, a protrusion. The shutter is movable relative to the toner dispensing hole, and is to selectively close the toner dispensing hole. The protrusion is connected to the shutter and movement of the protrusion causes the shutter to move relative to the toner dispensing hole to cover the toner dispensing hole. There is a receiver including a movable catch, the movable catch being in a first position when the toner container is initially inserted into the receiver, and the moveable catch moving to a second position upon insertion of the toner container into the receiver. The moveable catch interacts with the protrusion of the toner container when the toner container is being removed from the receiver such that the moveable catch in the second position restricts movement of the protrusion of the toner container which closes the shutter as the toner container is withdrawn from the receiver.

22 Claims, 33 Drawing Sheets

TONER CONTAINER AND IMAGE FORMING APPARATUS WITH A MECHANISM TO SECURE THE TONER CONTAINER

CROSS REFERENCES TO RELATED APPLICATIONS

The present application is a continuation of U.S. application Ser. No. 13/411,134 filed on Mar. 2, 2012 which is based upon and claims the benefit of priority of PCT Application No. PCT/JP2010/059968 filed on Jun. 11, 2010, the entire contents of each of which are incorporated herein by reference. The present application is based upon and claims the benefit of priority of Japanese Patent Application Laid-open No. 2010-121919, filed on May 27, 2010, Japanese Patent Application Laid-open No. 2010-121974, filed on May 27, 2010, Japanese Patent Application Laid-open No. 2010-121808, filed on May 27, 2010, Japanese Patent Application Laid-open No. 2009-204459, filed on Sep. 4, 2009, Japanese Patent Application Laid-open No. 2009-204403, filed Sep. 4, 2009, and Japanese Patent Application Laid-open No. 2009-204368, filed on Sep. 4, 2009, the entire contents of each of which are incorporated herein by reference. The present application further incorporates herein by reference the entire contents of the U.S. Patent Application Publication No. 2006/0034642, filed Feb. 16, 2006, and U.S. Patent Application Publication No. 2004/0223790, filed on Nov. 11, 2004.

FIELD

The present invention relates to a toner container for use in a copier, a printer, or an image forming apparatus such as a multifunction peripheral that has the functions of a copier, a printer, and/or a facsimile machine, and relates to an image forming apparatus including the toner container.

BACKGROUND

In conventional image forming apparatuses such as copiers, a cylindrical toner container (a toner bottle) that is detachably attached to a main body of an image forming apparatus has been widely used (see, for example, Patent Document 1 and Patent Document 2). Patent Documents 1 and 2 disclose a toner container (a toner bottle) that is set in a body of an image forming apparatus in a replaceable manner and that mainly includes a container body (a bottle body) and a cap unit (a held unit).

Patent Document 1: Japanese Patent Application Laid-open No. H4-1681

Patent Document 2: Japanese Patent Application Laid-open No. 2002-268344

SUMMARY

A toner container detachably attached to a body of an image forming apparatus that includes a first holding member, a second holding member, and a shutter closing mechanism such that a longitudinal direction of the toner container is kept horizontal includes: a toner outlet for discharging toner; a shutter unit that moves along an outer periphery of the toner container to open and close the toner outlet; a shutter rail for guiding the shutter unit to move in the longitudinal direction for opening and closing the toner outlet; and a projection that protrudes from the toner container in the longitudinal direction so as to protrude from an end portion of the shutter unit in a closing direction with the end portion located at a position where the toner outlet is closed. The shutter rail has two surface members that are disposed, respectively, on one side and another side of the toner container, and are extending in the longitudinal direction, the projection has surfaces that are respectively in the same planes as planes of the surface members of the shutter rail, the toner outlet is opened and closed by moving the shutter unit on the shutter rail, the surface members are to be sandwiched by the first holding member, the shutter unit is switched between a held state in which the shutter unit is held by the second holding member and a released state in which holding of the shutter unit by the second holding member is released in accordance with rotation of the second holding member, and the shutter unit is prevented by the shutter closing mechanism, which makes the second holding member incapable of rotating, from being open while the surface members are sandwiched by the first holding member.

DESCRIPTION OF EMBODIMENTS

Figure 1:
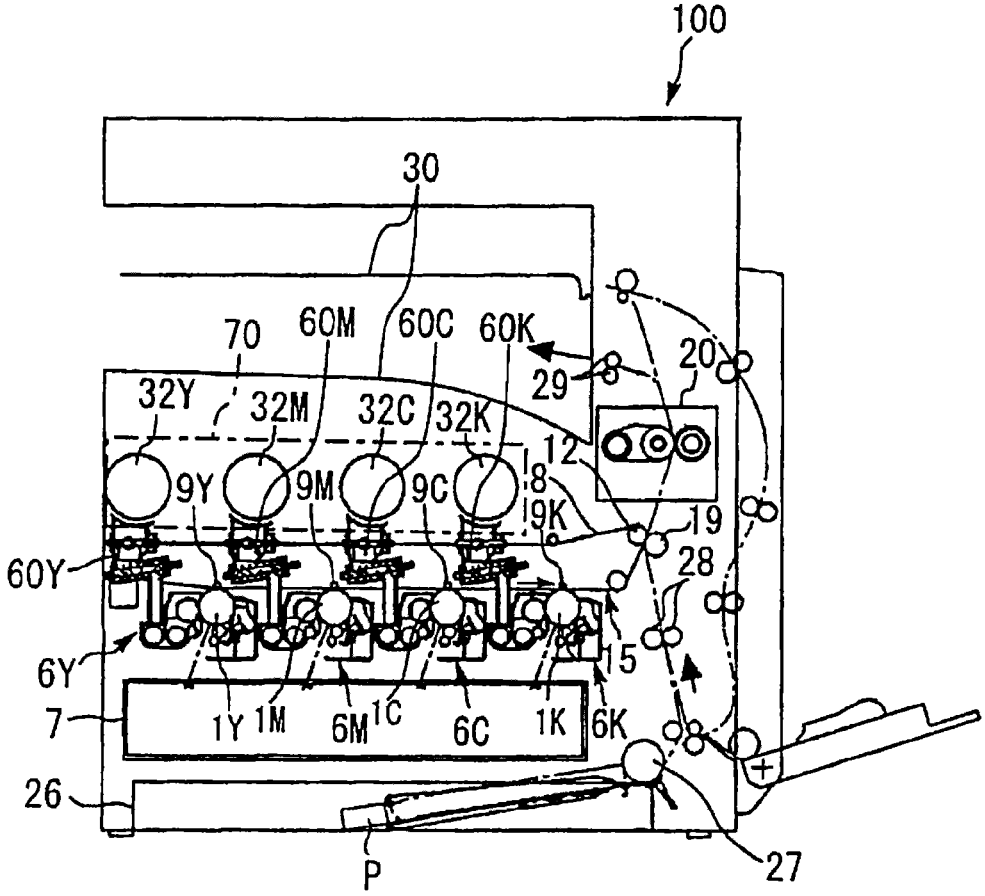
FIG. 1 is an overall configuration diagram of an image forming apparatus according to a first embodiment of the present invention.

Exemplary embodiments of the present invention will be described in detail below with reference to the accompanying drawings. In the drawings, the same or equivalent components are denoted by the same reference letters or numerals, and explanation thereof will be appropriately simplified or omitted.

First Embodiment

A first embodiment will be described in detail below with reference to FIGS. 1 to 44. The configuration and operation of whole of the image forming apparatus are described first. As illustrated in FIG. 1, four toner containers 32Y, 32M, 32C, and 32K corresponding to respective colors (yellow, magenta, cyan, and black) are detachably (in a replaceable manner) arranged in a toner-container holder 70 provided on the upper side of a body of an image forming apparatus 100 (also see FIGS. 3, 4, and 38). An intermediate transfer unit 15 is arranged below the toner-container holder 70. Image forming units 6Y, 6M, 6C, and 6K corresponding to the respective colors (yellow, magenta, cyan, and black) are arranged in a line so as to face an intermediate transfer belt 8 of the intermediate transfer unit 15. Toner supply devices 60Y, 60M, 60C, and 60K are arranged below the toner containers 32Y, 32M, 32C, and 32K, respectively. The toner supply devices 60Y, 60M, 60C, and 60K supply (feed) toner contained in the toner containers 32Y, 32M, 32C, and 32K to developing devices in the image forming units 6Y, 6M, 6C, and 6K, respectively.

Figure 2:
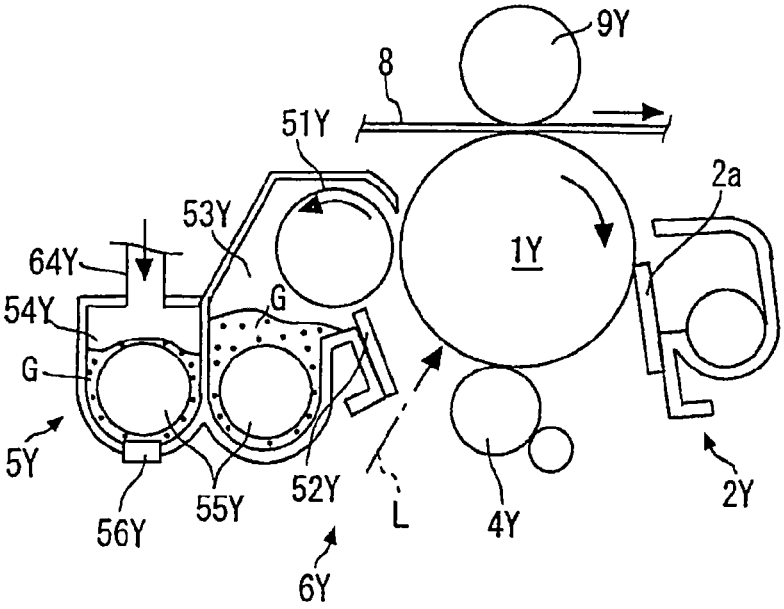
FIG. 2 is a cross-sectional view of an image forming unit.

Referring to FIG. 2, the image forming unit 6Y for yellow includes a photosensitive drum 1Y, and also includes a charging unit 4Y, a developing device 5Y (a developing unit), a cleaning unit 2Y, and a neutralizing unit (not illustrated), which are arranged around the photosensitive drum 1Y. Image forming processes (charging process, exposing process, developing process, transfer process, and cleaning process) are preformed on the photosensitive drum 1Y, on which a yellow image is formed.

The other three image forming units 6M, 6C, and 6K have almost the same configurations as the image forming unit 6Y for yellow except that colors of toners to be used are different and images corresponding to the respective toner colors are formed. In the followings, explanation of the other three image forming units 6M, 6C, and 6K will be appropriately omitted, and explanation of only the image forming unit 6Y for yellow will be given.

Referring to FIG. 2, the photosensitive drum 1Y is rotated clockwise in a plane of FIG. 2 by a drive motor (not illustrated). The surface of the photosensitive drum 1Y is uniformly charged at the position of the charging unit 4Y (charging process). The surface of the photosensitive drum 1Y then reaches a position of radiating a laser light L emitted from an exposing device 7 (see FIG. 1), where an exposing light is scanned to form an electrostatic latent image for yellow (exposing process).

The surface of the photosensitive drum 1Y then reaches a position of facing the developing device 5Y, where the electrostatic latent image is developed and a yellow toner image is formed (developing process). The surface of the photosensitive drum 1Y then reaches a position of facing the intermediate transfer belt 8 and a primary-transfer bias roller 9Y, where the toner image on the photosensitive drum 1Y is transferred to the intermediate transfer belt 8 (primary transfer process). At this time, a slight amount of non-transferred toner remains on the photosensitive drum 1Y.

The surface of the photosensitive drum 1Y then reaches a position to face the cleaning unit 2Y, where the non-transferred toner remaining on the photosensitive drum 1Y is mechanically collected by a cleaning blade 2*a* (cleaning process). The surface of the photosensitive drum 1Y finally reaches a position to face the neutralizing unit (not illustrated), where the residual potential on the photosensitive drum 1Y is removed. In this manner, a series of the image forming professes performed on the photosensitive drum 1Y is completed.

The image forming processes are performed on the other image forming units 6M, 6C, and 6K in the same manner as the yellow image forming unit 6Y. Specifically, the exposing device 7 arranged below the image forming units emits a laser light L based on image information toward each photosensitive drum of the image forming units 6M, 6C, and 6K. More specifically, the exposing device 7 emits the laser light L from a light source, and radiates the laser light L onto the photosensitive drum through a plurality of optical elements while scanning the laser light L by a polygon mirror being rotated. Subsequently, color toner images formed on the respective photosensitive drums through the developing process are superimposed and transferred onto the intermediate transfer belt 8. In this manner, a color image is formed on the intermediate transfer belt 8.

Referring to FIG. 1, the intermediate transfer unit 15 includes the intermediate transfer belt 8, four primary-transfer bias rollers 9Y, 9M, 9C, and 9K, a secondary-transfer backup roller 12, a plurality of tension rollers, an intermediate-transfer cleaning unit, and the like. The intermediate transfer belt 8 is stretched and supported by a plurality of rollers, and is endlessly moved in a direction indicated by an arrow in FIG. 1 in association with a rotation of the secondary-transfer backup roller 12.

The four primary-transfer bias rollers 9Y, 9M, 9C, and 9K sandwich the intermediate transfer belt 8 with the photosensitive drums 1Y, 1M, 1C, and 1K, respectively, to form primary transfer nips. A transfer bias with an opposite polarity to a polarity of toner is applied to the primary-transfer bias rollers 9Y, 9M, 9C, and 9K. The intermediate transfer belt 8 moves in the direction indicated by the arrow in FIG. 1 and sequentially passes through the primary transfer nips of the primary-transfer bias rollers 9Y, 9M, 9C, and 9K.

Accordingly, the toner images for respective colors on the photosensitive drums 1Y, 1M, 1C, and 1K are superimposed on the intermediate transfer belt 8 as primary transfers.

The intermediate transfer belt 8 carrying the superimposed and transferred toner images of a plurality of colors reaches a position to face a secondary transfer roller 19. At this position, the secondary-transfer backup roller 12 sandwiches the intermediate transfer belt 8 with the secondary transfer roller 19 to form a secondary transfer nip. The four-color toner image formed on the intermediate transfer belt 8 is transferred to a recording medium P, such as a transfer sheet, that has been conveyed to the position of the secondary transfer nip. At this time, non-transferred toner which has not been transferred to the recording medium P remains on the intermediate transfer belt 8.

The intermediate transfer belt 8 then reaches the position of the intermediate-transfer cleaning unit (not illustrated), where the non-transferred toner on the intermediate transfer belt 8 is collected. In this manner, a series of the transfer process performed on the intermediate transfer belt 8 is completed.

The recording medium P is conveyed to the position of the secondary transfer nip from a feed unit 26, which is disposed on the lower side of the body of the image forming apparatus 100, via a feed roller 27 and a registration roller pair 28. More specifically, a plurality of recording media P, such as transfer sheets, is stacked in the feed unit 26. When the feed roller 27, as drawn in FIG. 1, is rotated counterclockwise, the topmost recording medium P is fed to a nip between rollers of the registration roller pair 28.

The recording medium P conveyed to the registration roller pair 28 temporarily stops at the position of the nip between the rollers, which are stopped of driven rotation, of the registration roller pair 28. The registration roller pair 28 is rotated in association with the color image on the intermediate transfer belt 8, and the recording medium P is conveyed toward the secondary transfer nip. Then, a desired color image is transferred to the recording medium P.

The recording medium P to which the color image is transferred at the position of the secondary transfer nip is conveyed to the position of a fixing unit 20, where the color image transferred to the surface of the recording medium P is fixed to the recording medium P by heat and pressure applied by a fixing belt and a pressing roller. The recording medium P is then discharged to the outside of the apparatus through a nip between rollers of a discharging roller pair 29. The recording medium P discharged to the outside of the apparatus by the discharging roller pair 29 is sequentially stacked on a stack portion 30 as an output image. In this manner, a series of the image forming processes in the image forming apparatus is completed.

The configuration and operation of the developing device in the image forming unit are described in detail below with reference to FIG. 2. The developing device 5Y includes a developing roller 51Y to face the photosensitive drum 1Y, a doctor blade 52Y to face the developing roller 51Y, two conveyor screws 55Y disposed in developer storage units 53Y and 54Y, and a density detection sensor 56Y for detecting toner density in developer. The developing roller 51Y includes a magnet fixed inside thereof and a sleeve that rotates around the magnet. Two-component developer G formed of carrier and toner is stored in the developer storage units 53Y and 54Y. The developer storage unit 54Y communicates with a toner-falling conveying path 64Y via an opening formed on an upper side of the developer storage unit 54Y.

The developing device 5Y configured as above operates as follows. The sleeve of the developing roller 51Y rotates in a direction indicated by an arrow in FIG. 2. The developer G, which is carried on the developing roller 51Y by a magnetic field formed by the magnet, moves along the developing roller 51Y in association with rotation of the sleeve.

The developer G in the developing device 5Y is controlled so that the proportion (toner density) of toner in the developer is in a predetermined range. More specifically, toner contained in the toner container 32Y is supplied to the developer storage unit 54Y via the toner supply device 60Y (see FIG. 3) according to toner consumption in the developing device 5Y. The configuration and operation of the toner supply device will be described in detail below.

The toner supplied to the developer storage unit 54Y circulates in the two developer storage units 53Y and 54Y while being mixed and stirred together with the developer G (movement in a direction perpendicular to the sheet of FIG. 2) by the two conveyor screws 55Y. The toner in the developer G adheres to the carrier by triboelectric charging with the carrier, and is carried on the developing roller 51Y together with the carrier due to the magnetic force formed on the developing roller 51Y.

The developer G carried on the developing roller 51Y is conveyed in the direction indicated by the arrow in FIG. 2 and reaches the position of the doctor blade 52Y. After the amount is adjusted at this position, the developer G on the developing roller 51Y is conveyed to the position (development area) to face the photosensitive drum 1Y. The toner adheres to a latent image formed on the photosensitive drum 1Y by an electric field formed in the development area. The developer G remaining on the developing roller 51Y reaches the upper side of the developer storage unit 53Y in association with the rotation of the sleeve, where the developer G is separated from the developing roller 51Y.

Figure 3:
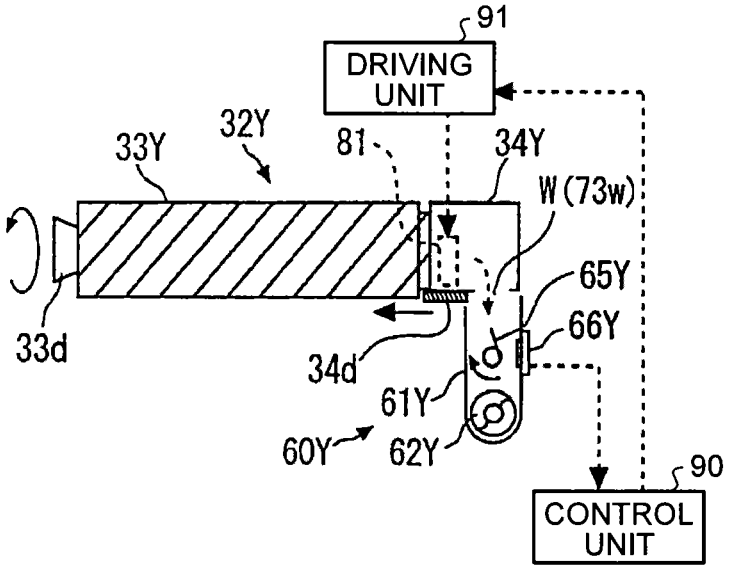
FIG. 3 is a schematic diagram of how a toner container is set in a toner supply device.
Figure 4:
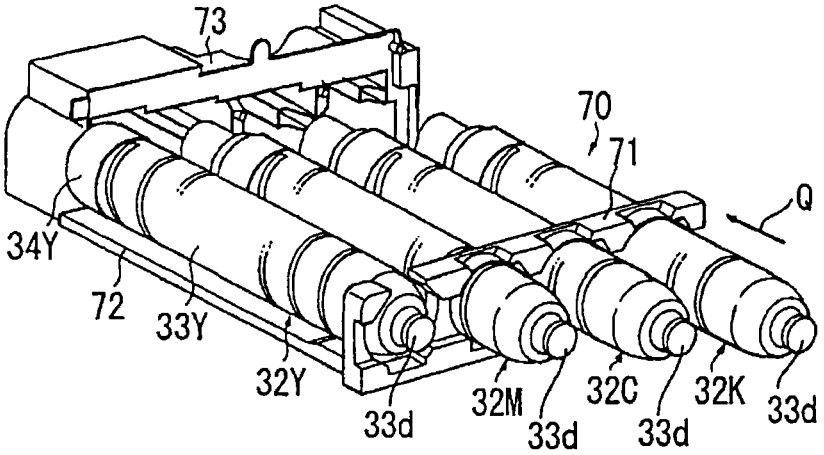
FIG. 4 is a schematic perspective view of how toner containers are set in a toner-container holder.

Referring to FIGS. 3 and 4, the toner supply devices 60Y, 60M, 60C, and 60K are described in detail below. Referring to FIG. 3, toner in the toner containers 32Y, 32M, 32C, and 32K arranged in the toner-container holder 70 of the body of the image forming apparatus 100 is appropriately supplied to the respective developing devices by the toner supply devices 60Y, 60M, 60C, and 60K, which are arranged for the respective toner colors, according to toner consumption in the developing devices for the respective colors. The four toner supply devices 60Y, 60M, 60C, and 60K have almost the same configurations and the four toner containers 32Y, 32M, 32C, and 32K have almost the same configurations, except that colors of toners used for the image forming processes are different from each other. Therefore, explanation will be given only of the toner supply device 60Y and the toner container 32Y for yellow, and explanation of the toner supply devices 60M, 60C, and 60K and the toner containers 32M, 32C, and 32K for the other three colors will be omitted appropriately.

As illustrated in FIG. 4, when the toner containers 32Y, 32M, 32C, and 32K are attached to the toner-container holder 70 of the body of the image forming apparatus 100 (movement in a direction indicated by an arrow Q), a shutter unit 34*d* of each of the toner containers 32Y, 32M, 32C, and 32K moves in association with the attachment operation. Accordingly, a toner outlet W is opened and a toner supply port 73*w* of each of the toner supply devices 60Y, 60M, 60C, and 60K (see FIGS. 3 and 38) and the toner outlet W operate together. Consequently, toner contained in the toner container 32Y (same for 32M, 32C, and 32K) is discharged from the toner outlet W and is accumulated in a toner tank 61Y (same for 61M, 61C, and 61K) through the toner supply ports 73*w* of the toner supply device 60Y, 60M, 60C, and 60K.

Referring to a schematic diagram of FIG. 3, the toner container 32Y is an approximately cylindrical toner bottle, and mainly includes a cap unit 34Y that is held in a non-rotatable manner held by the toner-container holder 70 and a container body (bottle body) 33Y that has an integrally-formed gear 33*c*. The container body 33Y is held so as to rotate relative to the cap unit 34Y, and is driven by a driving unit 91 (which includes a drive motor, a driving gear 81, and the like) to rotate in the direction indicated by an arrow in FIG. 3. In association with rotation of the container body 33Y, toner contained in the toner container 32Y (the container body 33Y) is conveyed in a longitudinal direction (conveyed from left to right in FIG. 3) by a spiral-shaped projection 33*b* formed on the inner circumferential surface of the container body 33Y, and the toner is discharged from the toner outlet W of the cap unit 34Y. That is, the driving unit 91 appropriately rotates the container body 33Y of the toner container 32Y, so that toner is appropriately supplied to the toner tank 61Y. The toner containers 32Y, 32M, 32C, and 32K are replaced with new ones at the end of their lifetimes (when almost all of toner contained is consumed and the container becomes empty).

Referring to FIG. 3, each of the toner supply devices 60Y, 60M, 60C, and 60K includes the toner-container holder 70, the toner tank unit 61Y, a toner conveyor screw 62Y, a stirring member 65Y, a toner end sensor 66Y, and the driving unit 91. The toner tank unit 61Y is arranged below the toner outlet W of the toner container 32Y for accumulating toner discharged from the toner outlet W of the toner container 32Y. The bottom portion of the toner tank unit 61Y is connected to an upstream portion of the toner conveyor screw 62Y. The toner end sensor 66Y for detecting that the amount of toner accumulated in the toner tank unit 61Y becomes equal to or smaller than a predetermined amount is set on a wall surface of the toner tank unit 61Y (at a position with a predetermined height from the bottom portion). A piezoelectric sensor or the like may be used as the toner end sensor 66Y. When a control unit 90 detects, by using the toner end sensor 66Y, that the amount of toner accumulated in the toner tank 61Y becomes equal to or smaller than the predetermined amount (toner end detection), the control unit 90 controls the driving unit 91 (the driving gear 81) to rotate the container body 33Y of the toner container 32Y for a predetermined period of time so as to supply toner to the toner tank unit 61Y. When the toner end detection by the toner end sensor 66Y is not cancelled even after the above control is repeated, information for urging replacement of the toner container 32Y is displayed on a display unit (not illustrated) of the body of the image forming apparatus 100 on the presumption that the toner container 32Y is out of toner.

The stirring member 65Y that prevents toner accumulated in the toner tank unit 61Y from being cohered is disposed at the center (near the toner end sensor 66Y) of the toner tank unit 61Y. The stirring member 65Y has a flexible member arranged at a shaft portion thereof. The stirring member 65Y rotates clockwise in FIG. 3 so as to stir toner in the toner tank unit 61Y. A tip of the flexible member of the stirring member 65Y comes into slide contact with a detection surface of the toner end sensor 66Y at every rotational period so as to prevent reduction in detection accuracy due to toner stuck to the detection surface of the toner end sensor 66Y.

The toner conveyor screw 62Y conveys, though the details are not illustrated in the figure, toner accumulated in the toner tank unit 61Y in an obliquely upper direction. Specifically, the toner conveyor screw 62Y conveys toner from the bottom portion (a bottommost point) of the toner tank unit 61Y toward an upper side of the developing device 5Y straight. Toner conveyed by the toner conveyor screw 62Y falls through the toner-falling conveying path 64Y (see FIG. 2) by falling due to own weight and is supplied to the developing device 5Y (developer storage unit 54Y).

Referring to FIG. 4, the toner-container holder 70 mainly includes a cap holder 73 for holding the cap unit 34Y of the toner container 32Y, a bottle holder 72 (container-body holder) for holding the container body 33Y of the toner container 32Y, and an insertion port 71 serving as an insertion port in the attachment operation of the toner container 32Y. The configuration of the toner-container holder 70 (the bottle holder 72 and the cap holder 73) will be described in detail later with reference to FIGS. 28 to 42.

Referring to FIG. 1, when a body cover (not illustrated) arranged at a front side (a front side in a direction perpendicular to the sheet of FIG. 1) of the body of the image forming apparatus 100 is opened, the toner-container holder 70 (the insertion port 71) is exposed. While each of the toner containers 32Y, 32M, 32C, and 32K is kept such that its longitudinal direction is horizontal, attachment/detachment operation of each of the toner containers 32Y, 32M, 32C, and 32K is performed from the front side of the body of the image forming apparatus 100 (the attachment/detachment operation using the longitudinal direction of the toner container as an attachment/detachment direction).

The bottle holder 72 is formed such that the length thereof in the longitudinal direction is nearly equal to the length of the container body 33Y in the longitudinal direction. The cap holder 73 is provided on one end of the bottle holder 72 in the longitudinal direction (attachment direction) while the insertion port 71 is provided on the other end of the bottle holder 72 in the longitudinal direction (attachment direction). Thus, along with the attachment operation of the toner container 32Y, the cap unit 34Y slides on the bottle holder 72 for a while after passing through the insertion port 71, and thereafter is set to the cap holder 73.

Figure 34:
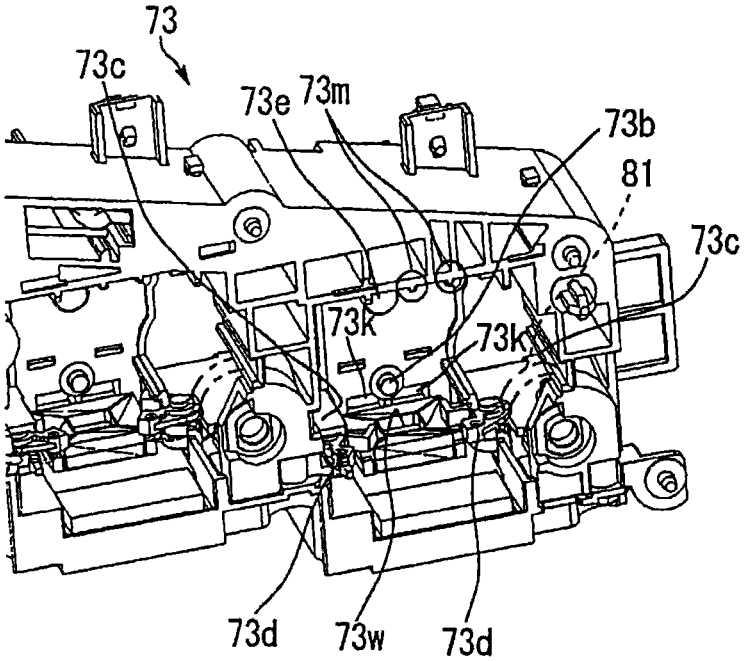
FIG. 34 is an enlarged perspective view of a part of the cap holder.
Figure 35:
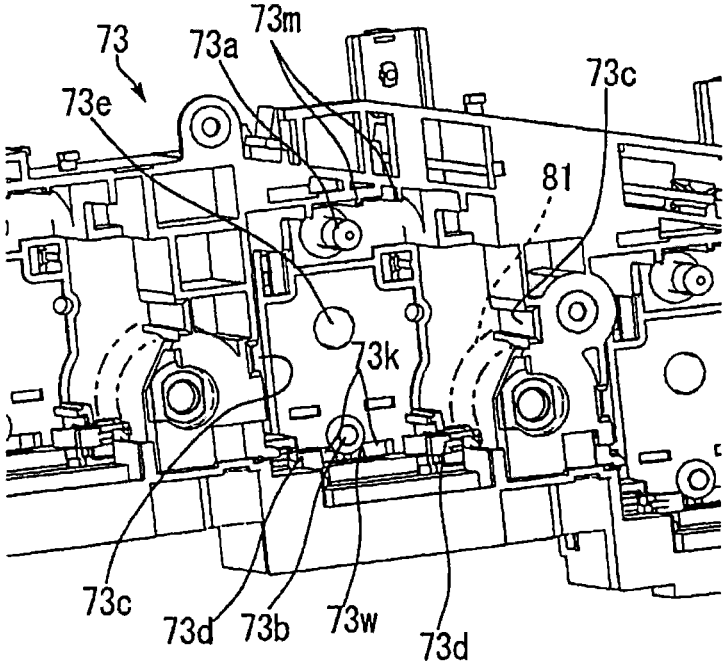
FIG. 35 is another enlarged perspective view of a part of the cap holder.
Figure 36:
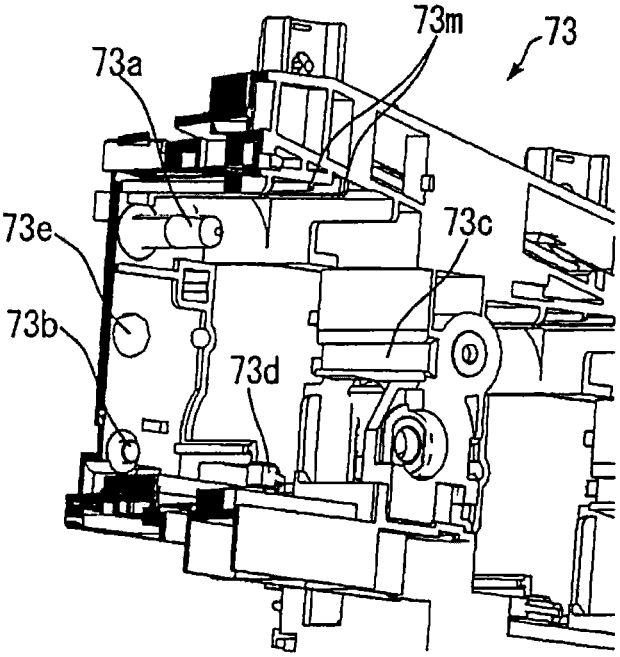
FIG. 36 is a perspective view of the interior of the cap holder.

In the first embodiment, an antenna 73*e* (radio-frequency identification (RFID) antenna) is mounted on the cap holder 73 of the toner-container holder 70 in which the toner containers 32Y, 32M, 32C, and 32K are detachably mounted in a line (see FIGS. 34 and 35). More specifically, the antenna 73*e* is used for communicating with an RFID chip 35 (see FIGS. 5 and 9) that is an electronic-information storage member mounted on an end face of the cap unit 34Y of the toner container 32Y.

The RFID chip 35 (electronic-information storage member) of each of the toner containers 32Y, 32M, 32C, and 32K exchanges necessary information with the antenna 73*e* (RFID antenna) mounted on the body of the image forming apparatus 100. Examples of the information exchanged between the RFID chip 35 and the antenna 73*e* include information on a manufacturing number of the toner container, the number of times the toner container has been recycled, information on the amount of toner that the toner container can contain, a lot number of the toner container, and toner color, and information on usage of the body of the image forming apparatus 100. The above electronic information is stored in the RFID chip 35 (electronic-information storage member) in advance before the RFID chip 35 is mounted on the body of the image forming apparatus 100 (or information received from the body of the image forming apparatus 100 after the chip is mounted is stored).

Figure 5:
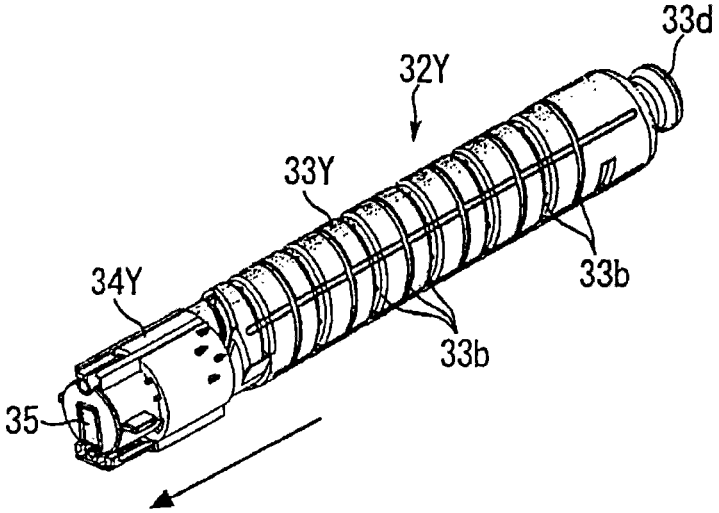
FIG. 5 is a perspective view of the toner container viewed obliquely from above.
Figure 6:
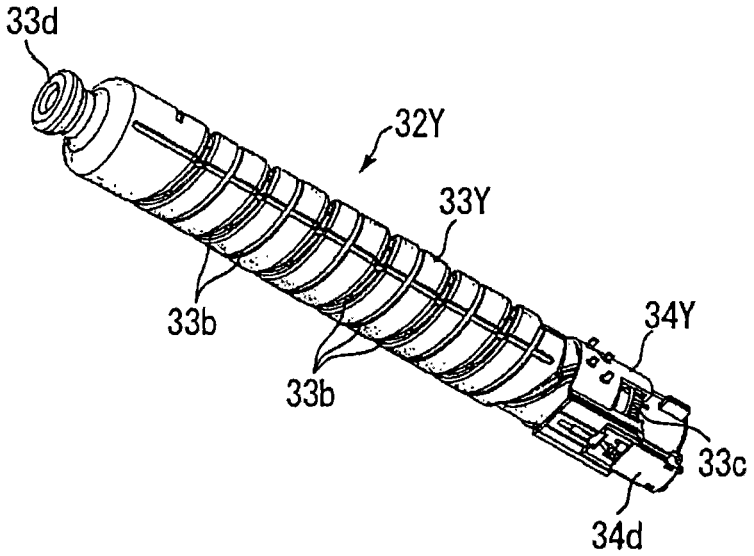
FIG. 6 is a perspective view of the toner container viewed obliquely from below.
Figure 7:
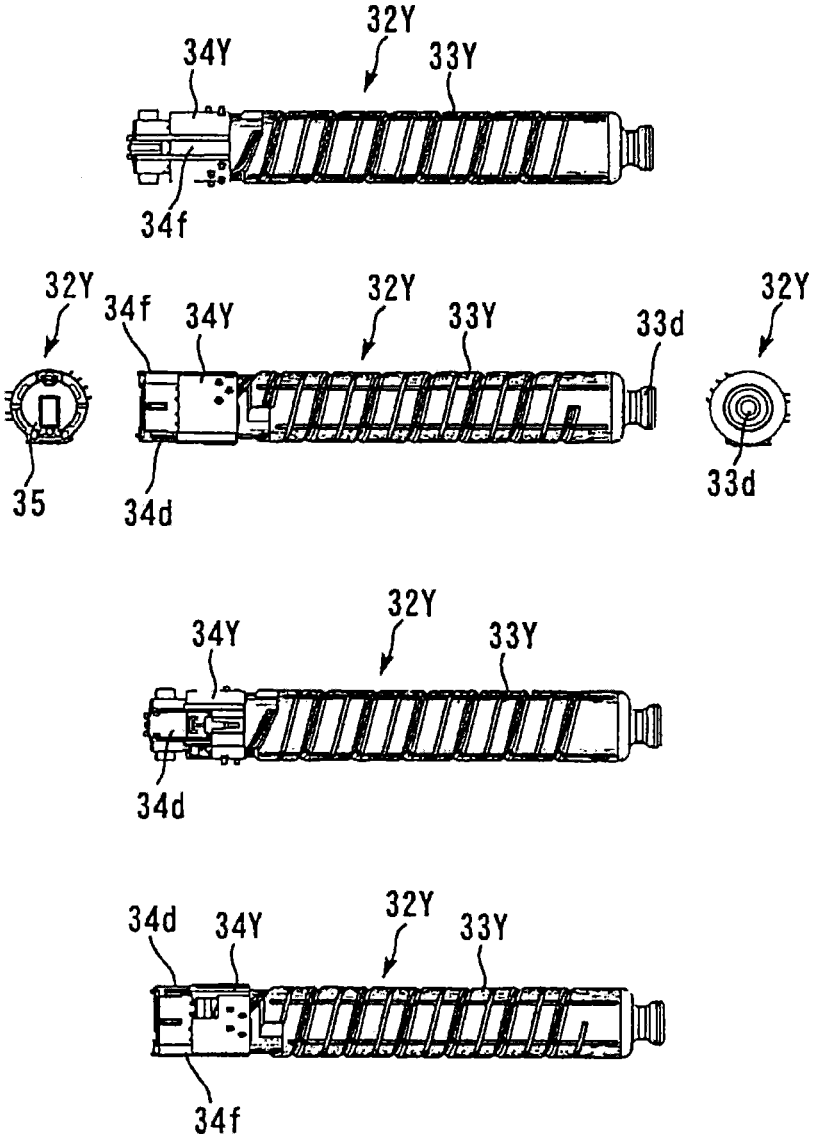
FIG. 7 illustrates six sides of the toner container.
Figure 8:
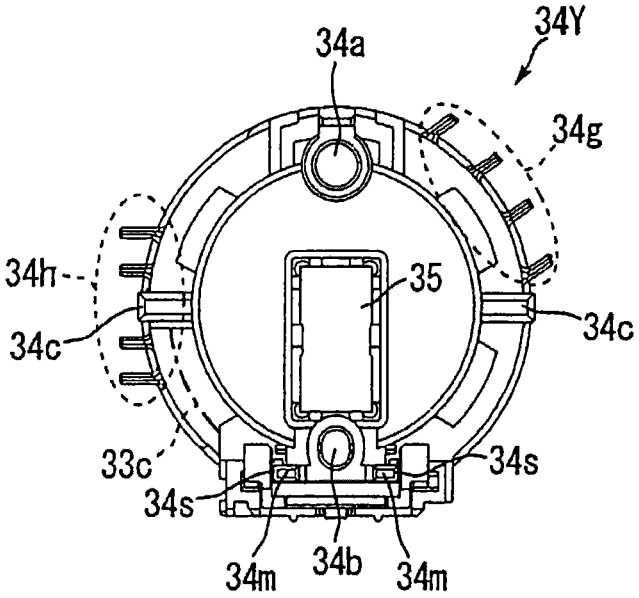
FIG. 8 is a front view of the toner container viewed from a cap unit side.
Figure 9:
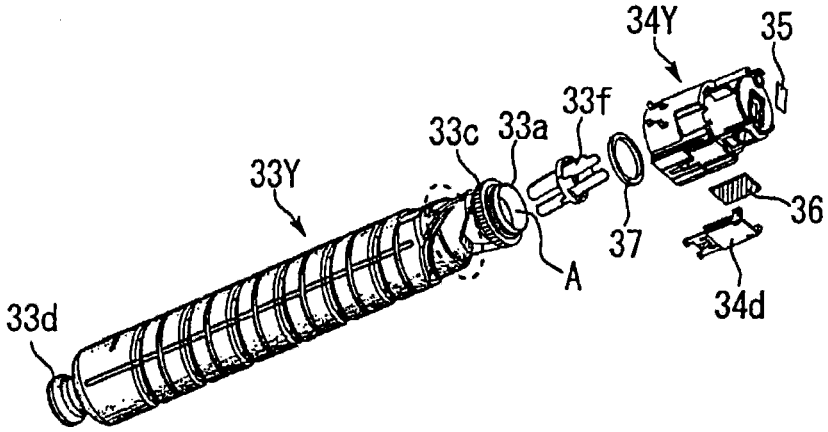
FIG. 9 is an exploded view of the toner container.

Referring to FIGS. 5 to 26, the toner containers 32Y, 32M, 32C, and 32K will be described in detail. As illustrated in FIGS. 5 to 7, the toner container 32Y mainly includes the container body 33Y (bottle body) and the cap unit 34Y (bottle cap) arranged on the head of the container body. Referring to FIG. 9, the toner container 32Y further includes, in addition to the container body 33Y and the cap unit 34Y, a stirring member 3M; a cap seal 37, the shutter unit 34*d*, a shutter seal 36 as a seal member, and the RFID chip 35 as the electronic-information storage member.

The gear 33*c*, which rotates with the container body 33Y together, and an opening A are arranged on one end of the container body 33Y in the longitudinal direction (a direction perpendicular to the sheet of FIG. 8) (see FIG. 9). The opening A is provided on the head of the container body 33Y (front end position in the attachment operation), and is used for discharging toner contained in the container body 33Y into a space (a cavity B, see FIG. 25) in the cap unit 34Y. Toner is appropriately conveyed from the container body 33Y to the cavity B in the cap unit 34Y (conveyance is induced by the rotation of the container body 33Y) to the extent that toner in the cap unit 34Y does not fall below a predetermined draft line.

The gear 33*c* is engaged with the driving gear 81 arranged in the toner-container holder 70 of the body of the image forming apparatus 100 to thereby rotate the container body 33Y about an axis of the rotation. More specifically, the gear 33*c* is formed to circle around the circumference of the opening A, and includes a plurality of teeth that are radially arranged with respect to the axis of the rotation of the container body 33Y. A part of the gear 33*c* is exposed through a notch portion 34*x* (see FIG. 19) formed on the cap unit 34Y, and is engaged with the driving gear 81 of the body of the image forming apparatus 100 at an engagement position on the lower left side of FIG. 8. Driving force is transmitted from the driving gear 81 to the gear 33*c*, so that the container body 33Y rotates clockwise in FIG. 8. In the first embodiment, the driving gear 81 and the gear 33*c* are realized as spur gears.

Referring to FIGS. 5 and 6, a gripper 33*d* is arranged on the other end of the container body 33Y in the longitudinal direction (a trailing end in the attachment direction) so that a user can grip the gripper 33*d* in attaching/detaching the toner container 32Y. The user attaches the toner container 32Y to the body of the image forming apparatus 100 by gripping the gripper 33*d* (movement of the toner container 32Y in the direction indicated by an arrow in FIG. 5).

The spiral-shaped projection 33*b* is arranged on the inner circumferential surface of the container body 33Y (a spiral-shaped groove when viewed from the outer circumferential surface side). The spiral-shaped projection 33*b* is used for discharging toner from the opening A in association with the rotation of the container body 33Y in a predetermined direction. The container body 33Y configured as above can be manufactured by blow molding with the gear 33*c* of the container body 33Y, which is arranged on the circumferential surface, and the gripper 33*d* together.

Figure 10:
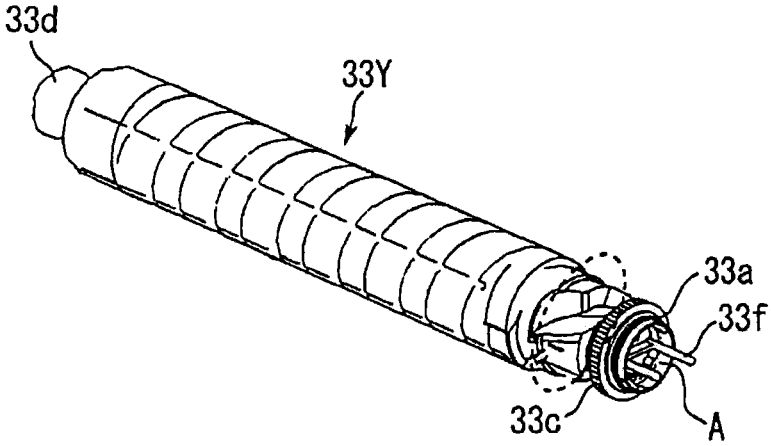
FIG. 10 is a perspective view of a container body of the toner container.

Referring to FIGS. 9 and 10, the toner container 32Y according to the first embodiment includes the stirring member 33*f* that rotates together with the container body 33Y and that is fitted to a bottle opening 33*a* (the opening A). The stirring member 33*f* is formed of a pair of rod-shaped members that extend from the cavity B in the cap unit 34Y to inside of the container body 33Y (also see FIG. 25). Rotation of the stirring member 33*f* together with the opening A of the container body 33Y improves the toner discharging performance from the opening A.

Referring to FIGS. 9 and 10, engaging members (convex portions), which are engaged with claw members 34*j* (see FIGS. 12 and 26) of the cap unit 34Y in order to connect the container body 33Y and the cap unit 34Y to each other, are formed to circle around the outer circumference of the bottle opening 33*a* of the container body 33Y. As described above, the container body 33Y is engaged with the cap unit 34Y in such a manner that the container body 33Y is rotatable with respect to the cap unit 34Y. Therefore, the gear 33*c* rotates relative to the cap unit 34Y when the container body 33Y rotates.

Figure 25:
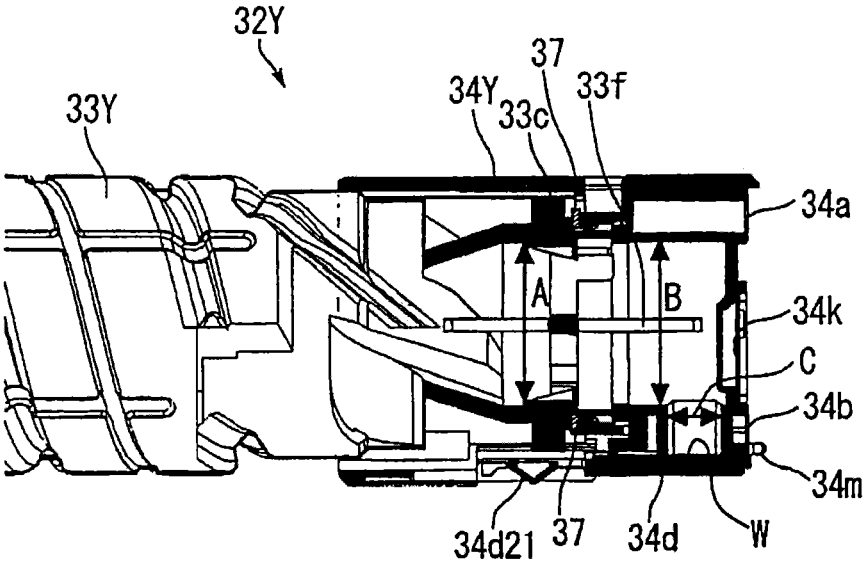
FIG. 25 is a cross-sectional view of the vicinity of the cap unit of the toner container.
Figure 26:
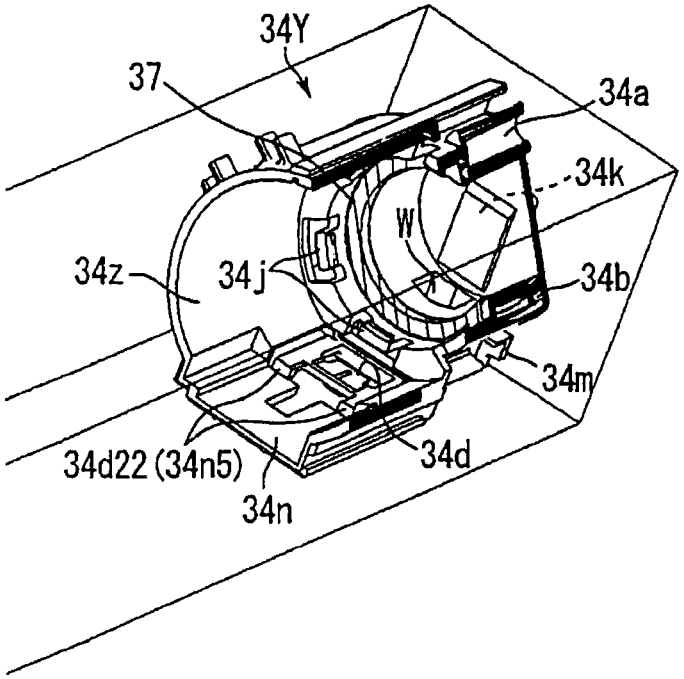
FIG. 26 is a perspective view of the interior of the cap unit of the toner container.
Figure 27A:
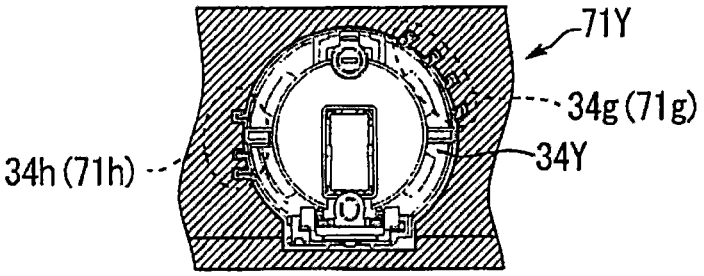
FIGS. 27A to 27D are front views illustrating states in which different toner containers are inserted into insertion ports as viewed from the cap unit side.
Figure 27B:
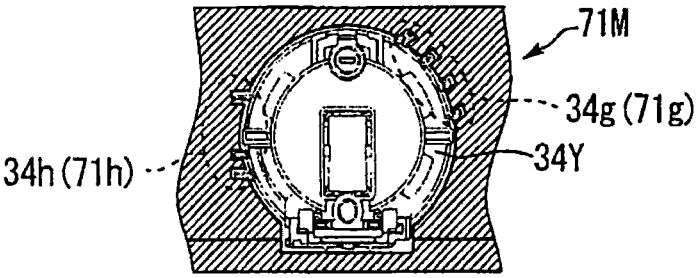
Figure 27C:
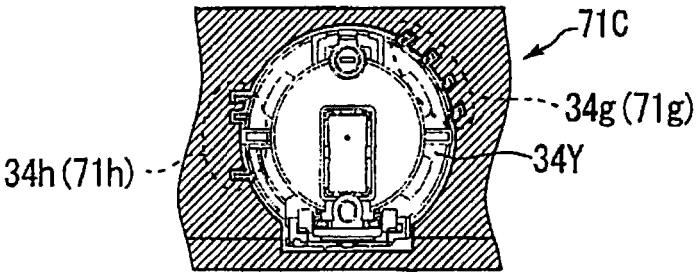
Figure 27D:
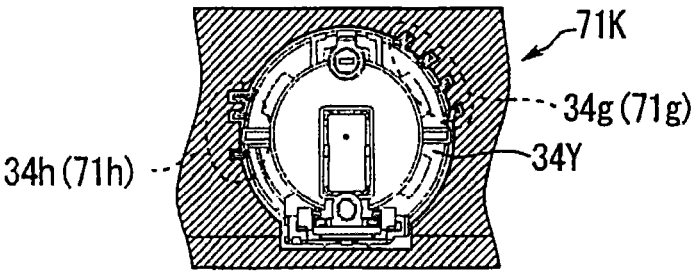

The inner diameter of a head portion of the container body 33Y (near the position where the gear 33*c* is formed) is smaller than the inner diameter of a toner-containing portion of the toner container (the position where the spiral-shaped projection 33*b* is formed) (also see FIG. 25). The scooping portion (the portion surrounded by a dashed circle in FIGS. 9 and 10), of which the inner circumferential surface protrudes inward, is provided on the head of the container body 33Y. Toner conveyed toward the opening A by the spiral-shaped projection 33*b* in association with the rotation of the container body 33Y is scooped, by the scooping portion (the portion surrounded by a dashed circle in FIGS. 9 and 10), into a small-diameter portion of the head. The toner scooped into the small-diameter portion of the head is stirred by the stirring member 33*f*, and is discharged to the cavity B of the cap unit 34Y through the opening A.

Referring to FIGS. 11 to 14, the shutter unit 34*d*, the shutter seal 36 (seal member), the cap seal 37, and the RFID chip 35 (electronic-information storage member) are arranged on the cap unit 34Y of the toner container 32Y.

Figure 17:
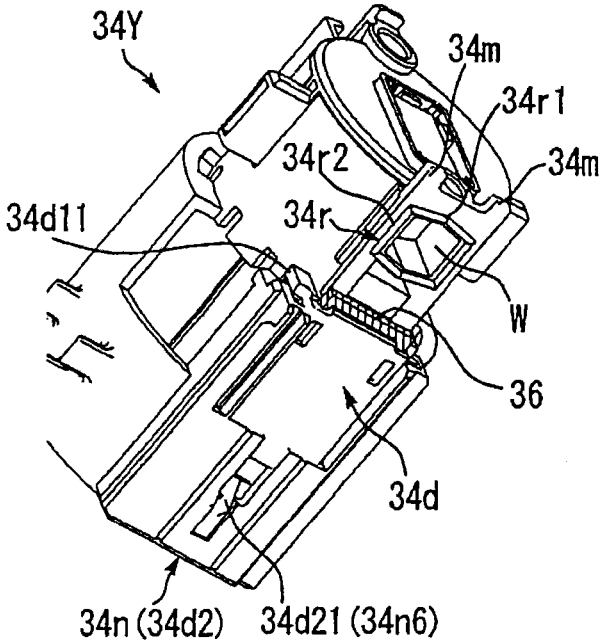
FIG. 17 is a perspective view of a state in which the shutter unit of the toner container opens the toner outlet.

The cap unit 34Y includes an insertion portion 34*z* with an inner diameter greater than the inner diameter of the cavity B (see FIG. 26), and the opening A of the container body 33Y is inserted into the insertion portion 34*z*. Referring to FIGS. 17 and 25, the toner outlet W is formed at the bottom portion of the cap unit 34Y to allow toner that has been discharged from the opening A of the container body 33Y to be discharged to the outside of the toner container in a vertically downward direction (to fall by own weight). The shutter unit 34*d* for opening and closing the toner outlet W is held in a movable way by sliding at the bottom portion of the cap unit 34Y. More specifically, the shutter unit 34*d* moves by a relative motion in the longitudinal direction from the cap unit 34Y side to the container body 33Y side (movement to the left in FIG. 25) to open the toner outlet W, and the shutter unit 34*d* moves by a relative motion in the longitudinal direction from the container body 33Y side to the cap unit 34Y side (movement to the right in FIG. 25) to close the toner outlet W. The open/close operation of the shutter unit 34*d* (the open/close operation of the toner outlet W) is performed in association with the attachment/detachment operation of the toner container 32Y to the toner-container holder 70 (the body of the image forming apparatus 100) in the longitudinal direction.

Figure 15:
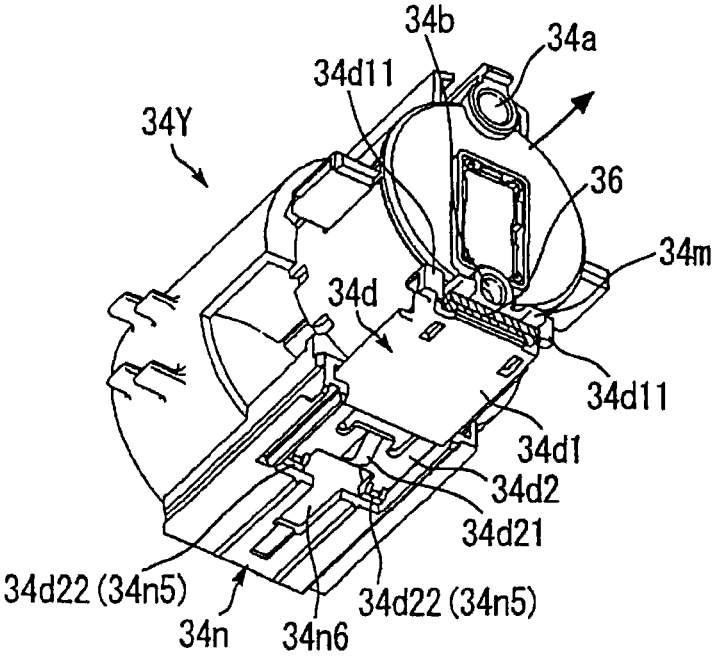
FIG. 15 is a perspective view of a state in which a shutter unit of the toner container closes a toner outlet.
Figure 16:
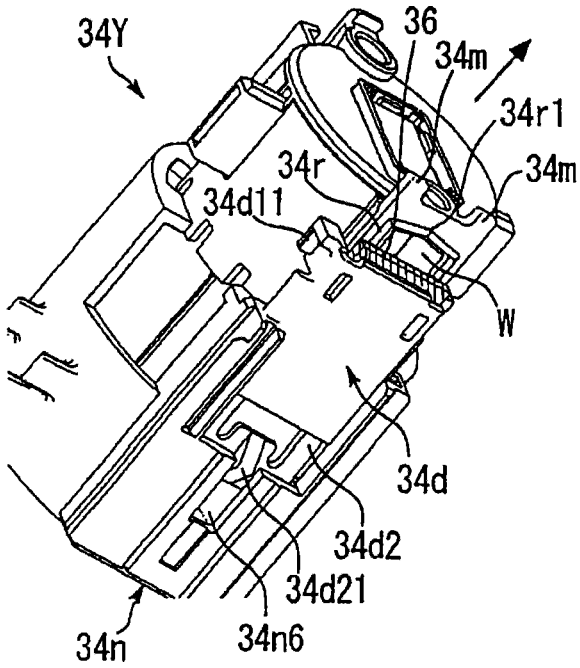
FIG. 16 is a perspective view of how the shutter unit of the toner container opens the toner outlet.

FIGS. 15 to 17 illustrate operation of the shutter unit 34*d* from start to completion of opening the toner outlet W. FIG. 18 is a schematic diagram illustrating the opening operation of the shutter unit 34*d* (a deformable shutter member 34*d*2).

Figure 11:
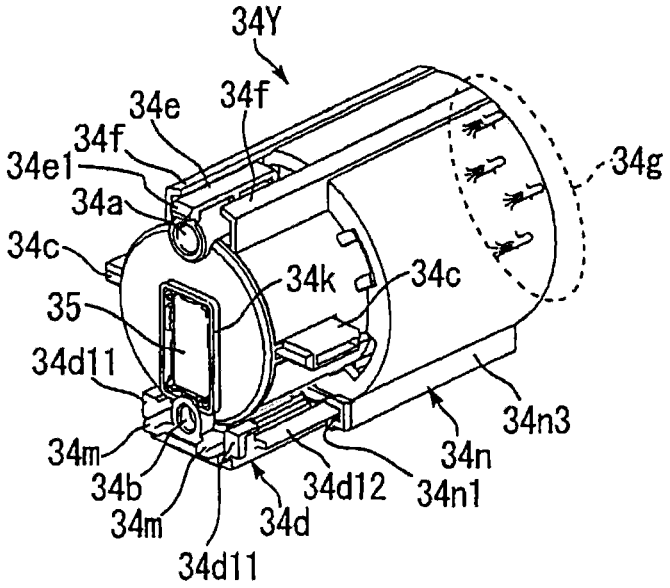
FIG. 11 is a perspective view of a cap unit of the toner container.
Figure 12:
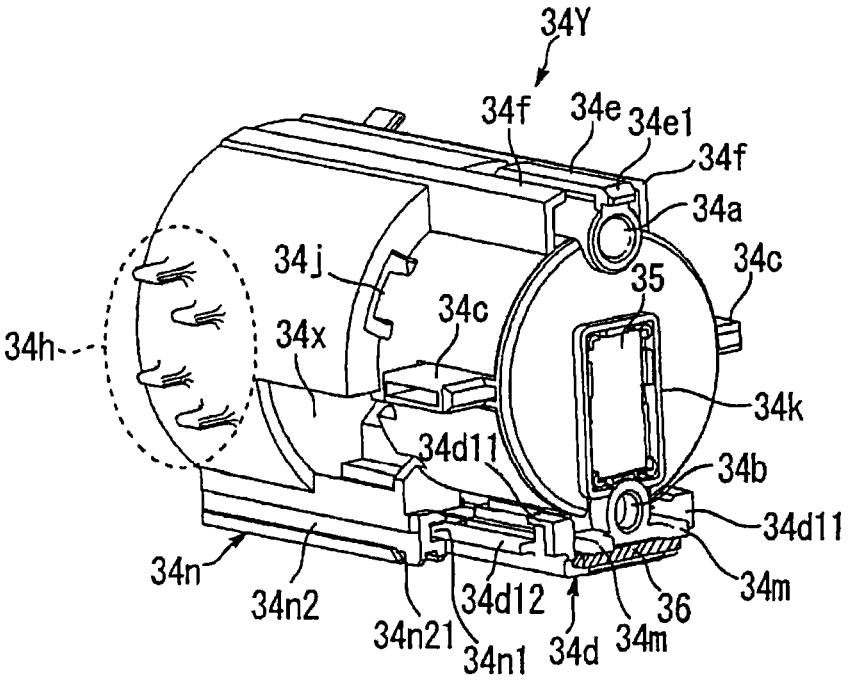
FIG. 12 is another perspective view of the cap unit of the toner container.

Referring to FIGS. 11 and 12, a first hole 34*a* is formed at the upper portion (ceiling portion) of the cap unit 34Y such that the first hole 34*a* extends in the longitudinal direction from the end face, which is perpendicular to the longitudinal direction, of the cap unit 34Y. The first hole 34*a* functions as a main guide for positioning the cap unit 34Y in the body of the image forming apparatus 100. More specifically, the first hole 34*a* of the cap unit 34Y is engaged with a main guide pin 73*a* (see FIGS. 35 and 36) of the cap holder 73 in association with the attachment operation of the toner container 32Y to the toner-container holder 70 in the longitudinal direction.

A second hole unit 34*b* is formed at the lower portion (bottom portion) of the cap unit 34Y such that the second hole unit 34*b* extends in the longitudinal direction from the end face, which is perpendicular to the longitudinal direction, of the cap unit 34Y so as not to reach the position of the toner outlet W. The second hole unit 34*b* functions as a sub-guide for positioning the cap unit 34Y in the body of the image forming apparatus 100. More specifically, the second hole unit 34*b* of the cap unit 34Y is engaged with a sub-guide pin 73*b* (see FIGS. 35 and 36) of the cap holder 73 in association with the attachment operation of the toner container 32Y to the toner-container holder 70 in the longitudinal direction. As illustrated in FIG. 8, a cross section of the second hole unit 34*b* is an ellipse of which a major axis is parallel to the vertical direction.

With the use of the two holes 34*a* and 34*b* configured as above, the cap unit 34Y is positioned in the toner-container holder 70. Referring to FIG. 8, a virtual vertical line passing through the center of the first hole 34*a* and a virtual vertical line passing through the center of the second hole 34*b* are the same and identical straight line to pass through the center of the circle of the cap unit 34Y when viewed in the plane perpendicular to the longitudinal direction.

Referring to FIG. 25, the depth of the first hole 34*a* (or the length of the main guide pin 73*a* in the longitudinal direction) is greater than the depth of the second hole 34*b* (or the length of the sub-guide pin 73*b* in the longitudinal direction). Therefore, during the attachment operation of the toner container 32Y to the toner-container holder 70 (the cap holder 73) in the longitudinal direction, engagement of the main guide pin 73*a* with the first hole 34*a* as the main positioning guide is started first, and thereafter, engagement of the sub-guide pin 73*b* with the second hole 34*b* as the sub-positioning guide is started. This allows the toner container 32Y to be smoothly attached to the toner-container holder 70 (the cap holder 73). The first hole 34*a* that is long in the longitudinal direction is arranged on the ceiling portion of the cap unit 34Y (a portion that is not buried in toner), so that toner conveying capability (flowability) in the cap unit 34Y is not influenced by the first hole. Although the second hole 34*b* that is short in the longitudinal direction is arranged at the bottom portion of the cap unit 34Y, the second hole 34*b* can be arranged by using a small space between the end face of the cap unit 34Y and the position of the toner outlet W and can fully function as the sub-positioning guide.

Referring to FIGS. 11 to 14, a first engaging portion 34*e* and a second engaging portions 34*f*, which function as regulators for regulating the posture of the cap unit 34Y in the horizontal direction perpendicular to the longitudinal direction in the cap holder 73 of the body of the image forming apparatus 100, are formed on the ceiling portion of the cap unit 34Y. The first engaging portion 34*e* and the second engaging portions 34*f* protrude upward in the vertical direction from the outer circumferential surface of the cap unit 34Y and are line-symmetric with respect to a virtual vertical line passing through the center of the first hole 34*a* when viewed in the cross section perpendicular to the longitudinal direction (a cross section parallel to the front view of FIG. 8), and the first engaging portion 34*e* and the second engaging portions 34*f* extend in the longitudinal direction (a direction perpendicular to the sheet of FIG. 8). The first engaging portion 34*e* and the second engaging portions 34*f* are engaged with an engaged portion 73*m* (convex portion) of the cap holder 73 illustrated in FIG. 34. Therefore, the cap unit 34Y is attached to and detached from the cap holder 73 while the posture of the cap unit 34Y in the horizontal direction is regulated, and also, the posture of the cap unit 34Y in the horizontal direction is regulated during when the cap unit 34Y is attached to the cap holder 73.

More specifically, the first engaging portion 34*e* (regulator) is formed just above the first hole unit 34*a*, and has an approximately rectangular cross section when viewed in the cross section perpendicular to the longitudinal direction. The first engaging portion 34*e* includes a protrusion 34*e*1 that protrudes in the longitudinal direction (attachment direction) relative to the end face of the first hole unit 34*a*. A tip of the protrusion 34*e*1 has a tapered shape as illustrated in FIG. 11. In contrast, the second engaging portions 34*f* (regulators) are formed on both sides of the first engaging portion 34*e* and sandwich the first engaging portion 34*e*. Each of the second engaging portions 34*f* has an approximately L-shaped cross section when viewed in the cross sectional plane that is perpendicular to the longitudinal direction (i.e., in a cross section parallel to the front view of FIG. 8). The first engaging portion 34*e* is engaged with the two engaged portions 73*m* formed on the cap holder 73 so as to be set between the engaged portions while the two second engaging portions 34*f* are engaged with the engaged portions 73*m* so as to sandwich the two engaged portions 73*m* entirely from outside. When the cap unit 34Y is attached to the cap holder 73, the tapered protrusion 34*e*1 of the first engaging portion 34*e* is engaged with the engaged portion 73*m* before the second engaging portions 34*f* are engaged with the engaged portion 73*m*, so that the cap unit 34Y can be smoothly attached to the cap holder 73.

Referring to FIGS. 11 to 14 again, lateral projections 34*c*, which function as a second regulator for regulating the posture of the cap unit 34Y in the rotational direction in the body of the image forming apparatus 100 (the cap holder 73), are formed on both lateral sides of the cap unit 34Y. The lateral projections 34*c* (the second regulator) on both sides protrude in the horizontal direction from the outer circumferential surface of the cap unit 34Y such that both of the lateral projections 34*c* are arranged to be in a virtually drawn horizontal line that passes a midpoint of a virtual line segment connecting a hole center of the first hole 34*a* and a hole center of the second hole 34*b* when viewed on the cross section perpendicular to the longitudinal direction, and the lateral projections 34*c* extend in the longitudinal direction (a direction perpendicular to the sheet of FIG. 8). The two lateral projections 34*c* (the second regulator) are engaged with lateral grooves 73*c* (groove portion) of the cap holder 73 illustrated in FIG. 34. Therefore, the cap unit 34Y is attached to and detached from the cap holder 73 while the posture of the cap unit 34Y in the rotational direction is regulated, and also, the posture of the cap unit 34Y in the rotational direction is regulated during when the cap unit 34Y is attached to the cap holder 73.

More specifically, each tip of the lateral projections 34*c* has a tapered shape in the longitudinal direction (attachment direction) as illustrated in FIG. 11. When the cap unit 34Y is attached to the cap holder 73, the first engaging portion 34*e* is engaged with the engaged portion 73*m* first, and thereafter the second engaging portions 34*f* are engaged with the engaged portions 73*m* and the two lateral projections 34*c* having tapered shapes are engaged with the lateral grooves 73*c*, so that the cap unit 34Y can be smoothly attached to the cap holder 73 while the posture of the cap unit 34Y is securely regulated.

Referring to FIGS. 11 and 12, the RFID chip 35, which is an electronic-information storage member for storing various types of electronic information, is mounted on a mount portion 34*k* (surrounded by a convex portion) formed between the first hole 34*a* and the second hole 34*b* on the end face of the cap unit 34Y. The RFID chip 35 is arranged so as to face the antenna 73*e* of the cap holder 73 at a predetermined distance when the cap unit 34Y is attached to the toner-container holder 70 (the cap holder 73). The RFID chip 35 performs non-contact communication (radio communication) with the antenna 73*e* while the cap unit 34Y is being held by the cap holder 73.

In the first embodiment, because the RFID chip 35 is fixed between the first hole 34*a* (main guide hole) and the second hole 34*b* (sub-guide hole), the position of the RFID chip 35 relative to the antenna 73*e* of the cap holder 73 can be fixed with high accuracy. Therefore, it is possible to prevent a communication fault due to positional deviation of the RFID chip 35 from the antenna 73*e* (RFID antenna).

The protrusion 34*e*1 and projections 34*m* are arranged so as to protrude further toward the front face side (right side in FIG. 25) than the convex portion (rib) formed on the circumference of the mount portion 34*k*. Therefore, even when the toner container 32Y is placed with the container body 33Y side up and the cap unit 34Y side down, it is possible to prevent the RFID chip 35 held in the mount portion 34*k* from coming into direct contact with a placement surface of the cap holder 73, thereby preventing the RFID chip 35 from being damaged.

Referring to FIGS. 11 and 12, convex portions 34*g* and 34*h* for ensuring the incompatibility of the toner container 32Y with toner containers of other colors are formed on the outer circumferential surface of the cap unit 34Y. The convex portions 34*g* and 34*h* are configured to be engaged with corresponding engagement members 71*g* and 71*h* (formed on the insertion port 71 of the toner-container holder 70, see FIGS. 27A to 27D) when the attachment operation of the toner container 32Y to the toner-container holder 70 is correctly performed (when the toner container 32Y is attached to a correct position in the toner-container holder 70).

Specifically, referring to FIGS. 27A to 27D, the convex portions 34*g* and 34*h* are arranged at different positions depending on each color of toner contained in the toner container (container body). The convex portions 34*g* and 34*h* corresponding to the toner container for cyan are formed at the positions at which the convex portions 34*g* and 34*h* can be engaged with only the engagement members 71*g* and 71*h* for cyan in the toner-container holder 70 (the insertion port 71C) (see FIG. 27C), the convex portions 34*g* and 34*h* corresponding to the toner container for magenta are formed at the positions at which the convex portions 34*g* and 34*h* can be engaged with only the engagement members 71*g* and 71*h* for magenta in the toner-container holder 70 (the insertion port 71M) (see FIG. 27B), the convex portions 34*g* and 34*h* corresponding to the toner container for yellow are formed at the positions at which the convex portions 34*g* and 34*h* can be engaged with only the engagement members 71*g* and 71*h* for yellow in the toner-container holder 70 (the insertion port 71Y) (see FIG. 27A), and the convex portions 34*g* and 34*h* corresponding to the toner container for black are formed at the positions at which the convex portions 34*g* and 34*h* can be engaged with only the engagement members 71*g* and 71*h* for black in the toner-container holder 70 (the insertion port 71K) (see FIG. 27D).

With the above configurations, it is possible to prevent a toner container for a certain color (for example, a toner container for yellow) from being set in a toner-container holder for a different color (for example, a toner-container holder for cyan), thereby preventing a failure to form a desired color image. That is, it is possible to prevent the toner container from being erroneously set in the toner-container holder.

Some of the incompatible convex portions 34*g* and 34*h* are cut off depending on the type (color) of toner contained in the toner container in order to fulfill the incompatible function for each color. That is, necessary claw portions are cut off with a cutting tool, such as a nipper or a cutter, from the cap unit 34Y having the incompatible convex portions 34*g* and 34*h* (eight claw members are formed on the left and right sides in total as illustrated in FIG. 8), so that the incompatible convex portions 34*g* and 34*h* of various shapes can be formed (in the first embodiment, four types are formed as illustrated in FIGS. 27A to 27D.

With the above configuration, it is not necessary to manufacture the same number of molds as the number of types of the toner containers (cap units), and it is possible to form a plurality of types of incompatible cap units by using one mold. Therefore, it is possible to reduce the entire manufacturing costs for the plurality of types of the toner containers.

In the first embodiment, the four types of incompatible cap units illustrated in FIGS. 27A to 27D are formed. However, it is possible to further form a plurality of types of incompatible cap units by cutting off necessary claw portions with various combinations thereof from the eight claw portions of the incompatible convex portions 34*g* and 34*h* (eight claw members are formed on the left and right sides in total).

Referring to FIG. 12, the notch portion 34*x*, at which a part of the gear 33*c* of the container body 33Y is exposed, is formed on the outer circumferential surface of the cap unit 34Y. While the toner container 32Y is being attached to the toner-container holder 70, the gear 33*c* exposed through the notch portion 34*x* of the cap unit 34Y is engaged with the driving gear 81 (disposed at a position indicated by a dashed-dotted line in FIG. 34, though the details are not illustrated) arranged in the cap holder 73, so that the driving gear 81 rotates the container body 33Y with the gear 33*c* together.

Figure 13:
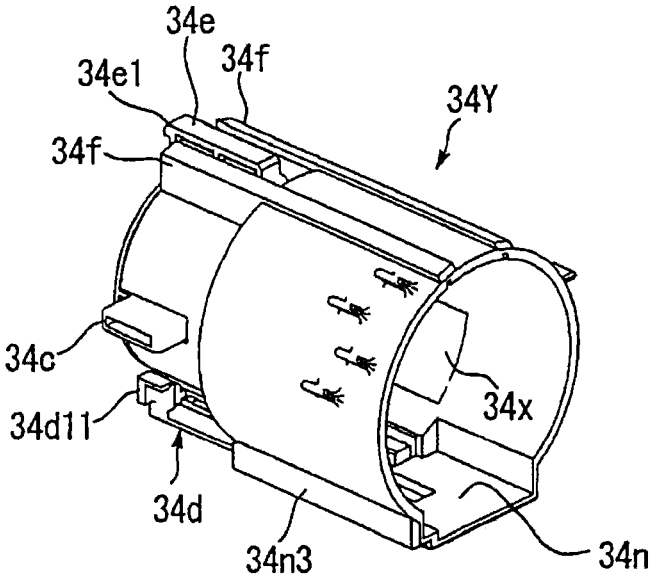
FIG. 13 is a perspective view of the cap unit of the toner container when viewed from a side of the cap unit to which the container body is connected.
Figure 14:
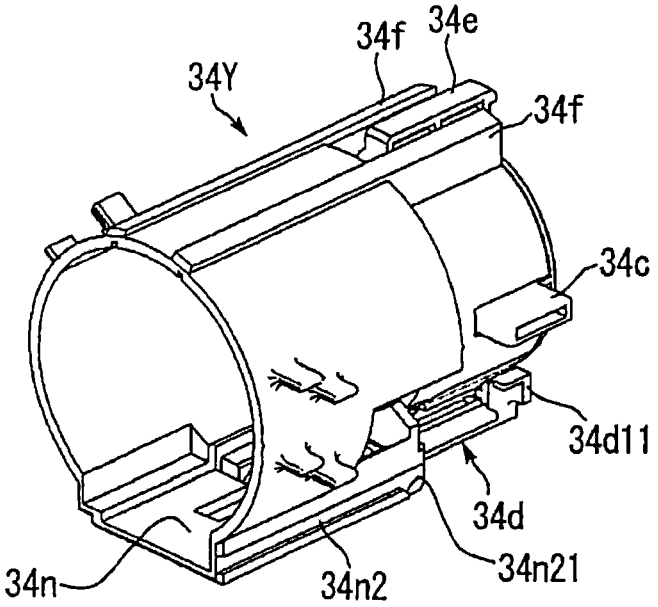
FIG. 14 is another perspective view of the cap unit of the toner container when viewed from the side of the cap unit to which the container body is connected.

Referring to FIGS. 13 and 14, a shutter housing unit 34*n* (housing unit) is formed at the bottom portion of the cap unit 34Y in order to house a part of the shutter unit 34*d* (the deformable shutter member 34*d*2) when the shutter unit 34*d* opens the toner outlet W. The shutter housing unit 34*n* is a space having an approximately rectangular parallelepiped shape bulging downward from the insertion portion 34*z*. The shutter housing unit 34*n* (housing unit) houses the deformable shutter member 34*d*2 by maintaining a deformed state (state in which the deformable shutter member 34*d*2 is elastically deformed upward by using the connection position of a shutter main unit 34*d*1 as a base point). Note that shutter housing unit 34*n* which includes the contact portion 34*n*5 houses the deformable shutter member 34*d*2, but according to an embodiment does not house the slidable shutter 34*d*1 Referring to FIGS. 11 and 12, shutter rails 34*t* (see FIG. 19) and slide grooves 34*n*1, which function as a rail unit for guiding the open/close operation of the shutter unit 34*d*, are formed on the inner surface of the shutter housing unit 34*n*. The configuration and operation of the shutter unit 34*d* will be described in detail below.

Referring to FIG. 12, a pressing rail 34*n*2 is formed on one side of the outer circumferential surface of the shutter housing unit 34*n*. The pressing rail 34*n*2 is engaged with a pressing member 72*c* of the bottle holder 72 (see FIGS. 30 and 38) in order to fix the position of the cap unit 34Y passing through the bottle holder 72 when the toner container 32Y is attached to/detached from the toner-container holder 70. The pressing rail 34*n*2 is formed as a concave shape (a groove), and is arranged in parallel to the attachment direction (the longitudinal direction) of the toner container 32Y. The pressing rail 34*n*2 is formed along the longitudinal direction (attachment/detachment direction) throughout the shutter housing unit 34*n*. Both ends of the pressing rail 34*n*2 are kept open without providing wall portions. A tapered portion 34*n*21 is formed at the tip of the pressing rail 34*n*2 in the attachment direction for smooth engagement of the pressing member 72*c* with the pressing rail 34*n*2 in the attachment operation.

Referring to FIG. 11, a pressure receiving face 34*n*3 is formed on the other side of the outer circumferential surface of the shutter housing unit 34*n*. A pressure receiving member 72*d* of the bottle holder 72 (see FIGS. 30 and 38) comes into slide contact with the pressure receiving face 34*n*3 in order to fix the position of the cap unit 34Y that passes through the bottle holder 72 when the toner container 32Y is attached to/detached from the toner-container holder 70.

With the above configuration, when the cap unit 34Y is just before (or just after) being attached to (or detached from) the cap holder 73 in the attachment (or detachment) operation of the toner container 32Y to (or from) the toner-container holder 70, in the cap unit 34Y, the pressing rail 34*n*2 is engaged with and urged by the pressing member 72*c* that is urged by a compression spring 72*e*, so that the pressure receiving face 34*n*3 receives the urging force while coming into slide contact with the pressure receiving member 72*d*. In this manner, the posture of the cap unit 34Y just before (or just after) being attached to (or detached from) the cap holder 73 is regulated when passing through the bottle holder 72.

The cap unit 34Y configured as above is connected with the container body 33Y via the opening A, and discharges toner discharged from the opening A from the toner outlet W (the movement in the direction indicated by the dashed arrow in FIG. 3).

In the first embodiment, referring to FIG. 25, the cavity B (space) in an approximately cylindrical shape is formed inside the cap unit 34Y such that the cavity B extends in the longitudinal direction (a horizontal direction in FIG. 25). The inner diameter of the cavity B is smaller than the inner diameter of the insertion portion 34*z* illustrated in FIG. 26 (a portion into which the head of the container body 33Y is inserted). A toner fall path C, which has a columnar shape with a constant flow passage area (cross-sectional area of the flow passage) from a lower circumferential surface of the approximately-cylindrical cavity B to the toner outlet W, is formed inside the cap unit 34Y. Therefore, toner that has been discharged from the opening A of the container body 33Y to the cavity B of the cap unit 34Y falls through the columnar toner fall path C by own weight and are smoothly discharged from the toner outlet W to the outside (the toner tank unit 61Y) of the container.

Figure 19:
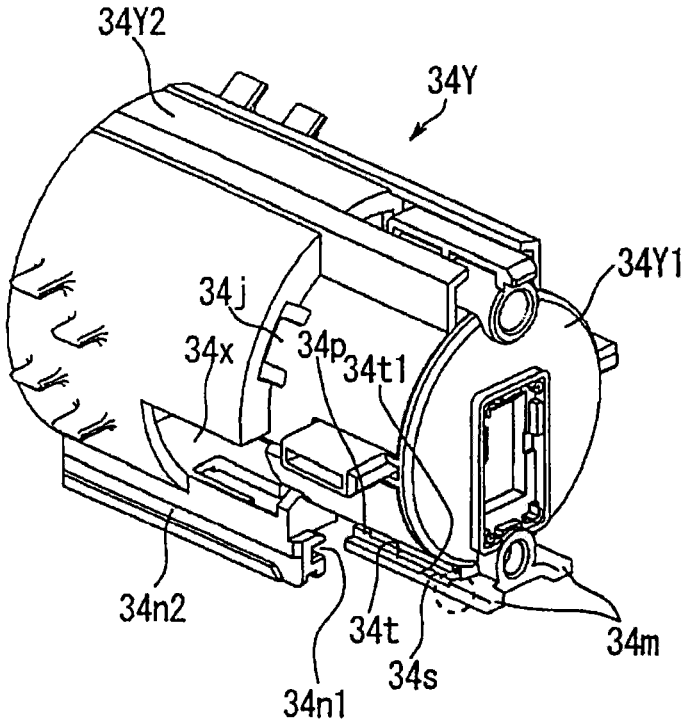
FIG. 19 is a perspective view of the cap unit from which the shutter unit is removed.
Figure 21:
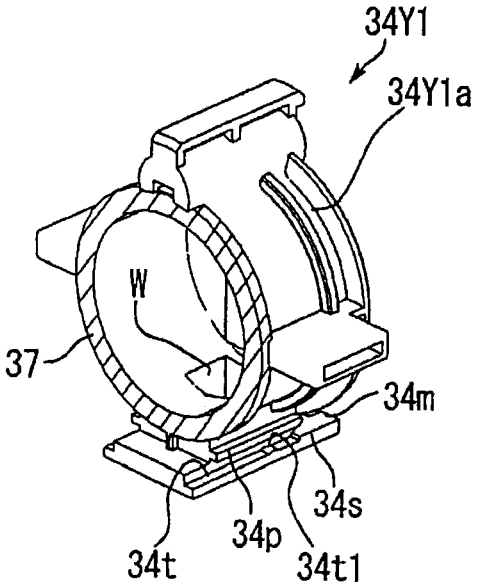
FIG. 21 is another perspective view of the first member of the cap unit.
Figure 22:
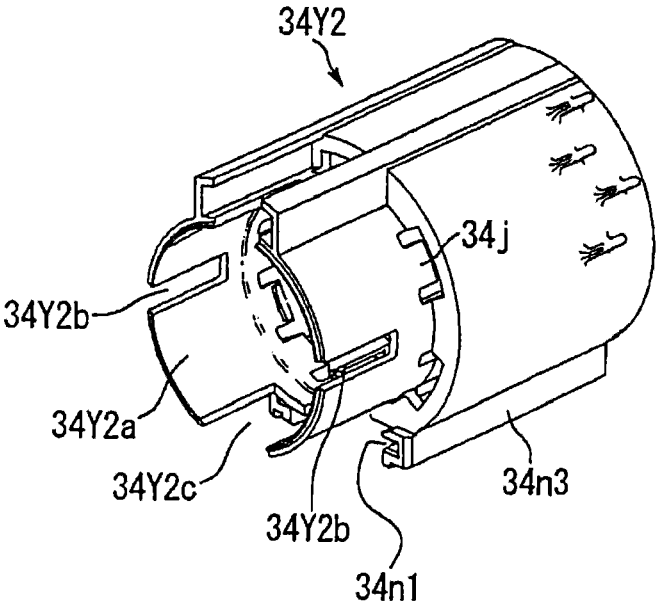
FIG. 22 is a perspective view of a second member of the cap unit.

Referring to FIG. 19, the cap unit 34Y (the shutter unit 34*d* and the shutter seal 36 are removed and hence, not illustrated) is formed by welding a first member 34Y1 (see FIGS. 20 and 21) and a second member 34Y2 (see FIG. 22). More specifically, the lateral projections 34*c* and the bottom portion of the first member 34Y1 are fitted to notch portions 34Y2*b* and 34Y2*c* of the second member 34Y2, and an inner circumferential surface 34Y2*a* of the second member 34Y2 is fitted to and bonded (welded) to a bonding portion 34Y1*a* of the first member 34Y1.

Figure 20:
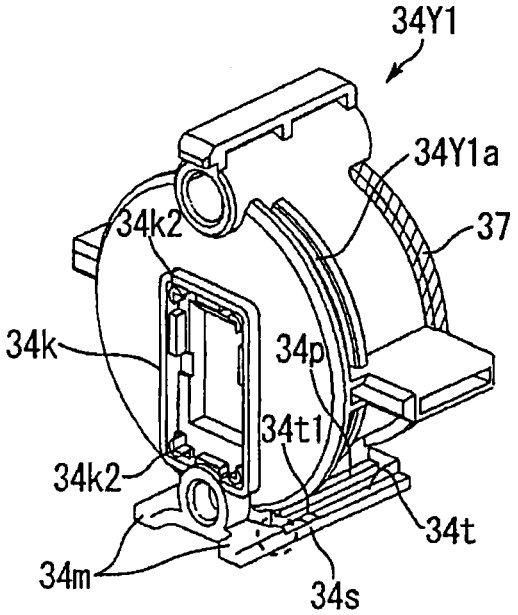
FIG. 20 is a perspective view of a first member of the cap unit.

As illustrated in FIGS. 20 and 21, the ring-shaped cap seal 37 as a seal member is attached to an opposing surface of the first member 34Y1 (a surface to face the bottle opening 33*a* formed on the circumference of the opening A of the container body 33Y). The cap seal 37 is used for sealing a gap between opposing surfaces of the container body 33Y and the cap unit 34Y at the circumference of the opening A, and is made of elastic material such as polyurethane foam (foamed resin material).

As illustrated in FIG. 20, the mount portion 34*k* for mounting the RFID chip 35 is formed on the end face of the first member 34Y1. The mount portion 34*k* is formed as a wall portion of which the circumference protrudes from the end face of the first member 34Y1. Base portions 34*k*2 for fixing four corners of the approximately-rectangular RFID chip 35 are formed at four corners of the rectangular wall portion inside the mount portion 34*k*. By placing the RFID chip 35 on the base portions 34*k*2, an electronic device formed on the back face of the RFID chip 35 (a surface to face the first member 34Y1) does not come into contact with the first member 34Y1. The RFID chip 35 is fixed to the mount portion 34*k* in such a manner that heat and pressure are applied to a part of the base portions 34*k*2 for fusing after the RFID chip 35 is placed on the base portions 34*k*2, and the base portions 34*k*2 are cooled to be solidified and joined to the four corners of the RFID chip 35.

As illustrated in FIGS. 20 and 21, the shutter rails 34*t* (rail unit) for guiding the shutter unit 34*d* to move in the longitudinal direction so as to open and close the toner outlet W is formed on both sides of the bottom portion of the first member 34Y1 (the cap unit 34Y). The shutter rails 34*t* are formed on two vertical surfaces 34*s* that stand upward from both side edges of the bottom surface on which the toner outlet W is formed. In other words, the shutter rails 34*t* are formed by using a part of the vertical surfaces 34*s*. The shutter rails 34*t* are formed by using upper surfaces of projections provided in a protruding manner at the both edges of the bottom surface (both edges in a direction perpendicular to the sheet of FIG. 25). The vertical surfaces 34*s* that stand upward are formed on the side edge portions of the projections. The two vertical surfaces 34*s* formed on both side edges of the first member 34Y1 extend from the end of the shutter unit 34*d*, which is at a position of closing the toner outlet W in the closing direction, to the protruding position in the longitudinal direction (attachment direction) (also see FIG. 39).

More specifically, two projections 34*m* (hornlike members) projecting in the longitudinal direction (attachment direction) from the end face of the cap unit 34Y perpendicular to the longitudinal direction are formed on the cap unit 34Y. The two projections 34*m* are disposed so as to sandwich the second hole 34*b* near a bottom edge of the second hole 34*b*. The two vertical surfaces 34*s* are configured to include respective vertical surfaces of the side edges of the two projections 34*m*. That is, the vertical surfaces at the outer edges of the two projections 34*m* are formed to be on the same planes as the vertical surfaces 34*s* on which the shutter rails 34*t* are formed.

Figure 41:
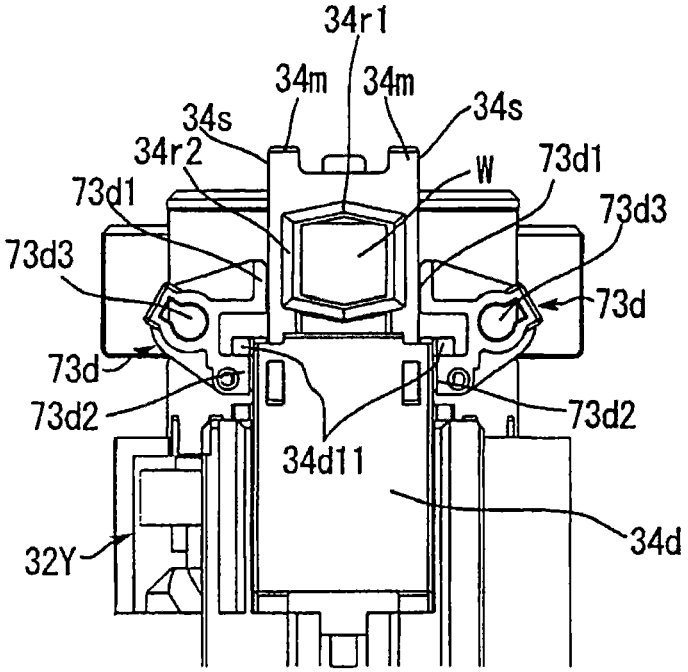
FIG. 41 is a bottom view illustrating a state following the state illustrated in FIG. 40.
Figure 42A:
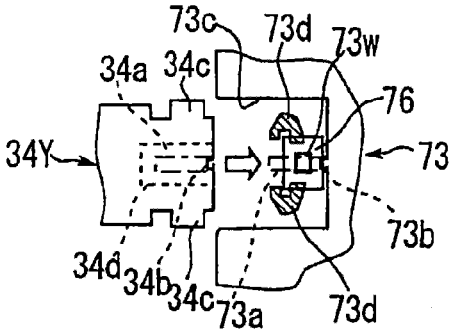
FIGS. 42A to 42D are schematic diagrams illustrating procedures in which each portion of the cap holder is engaged with the cap unit when the attachment operation of the toner container proceeds.
Figure 42B:
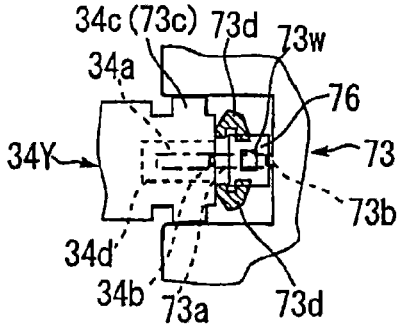
Figure 42C:
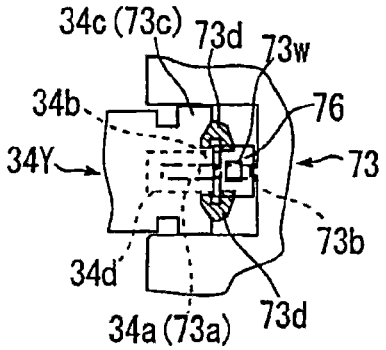
Figure 42D:
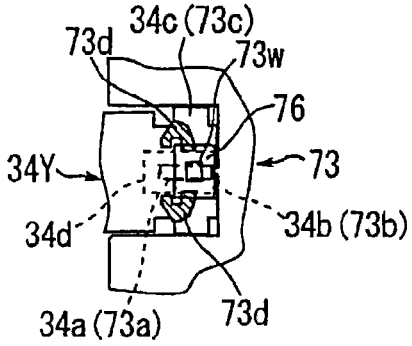

The vertical surfaces 34*s* configured as above are held surfaces that are held by first holding members 73*d*1 of shutter closing mechanisms 73*d* (shutter holding mechanisms) of the cap holder 73 (the toner-container holder 70) (see FIG. 41). That is, the posture of the shutter unit 34*d* of the cap unit 34Y set in the cap holder 73 is fixed by the shutter closing mechanisms 73*d* that also function as the shutter holding mechanisms.

Because the vertical surfaces 34*s* that function as the held surfaces are extended in the attachment direction (to the upper direction in FIG. 41), when the toner container 32Y is removed from the toner-container holder 70, a timing at which the shutter closing mechanisms 73*d* (second holding members 73*d*2) release holding of the shutter unit 34*d* using the vertical surfaces 34*s* as references can be delayed as compared to a timing at which the shutter closing mechanisms 73*d* completely close the shutter unit 34*d*. Therefore, it is possible to prevent the toner container 32Y from being removed from the body of the image forming apparatus 100 before the shutter unit 34*d* completely closes the toner outlet W. In particular, because the tips of the two projections 34*m* in the longitudinal direction (attachment direction) are located to protrude relative to the end face of the first hole 34*a* in the longitudinal direction (attachment direction), the shutter closing mechanisms 73*d* (the second holding units 73*d*2) release holding of the shutter unit 34*d* at the end of removal of the cap unit 34Y from the cap holder 73. Therefore, it is possible to securely prevent a closing error of the shutter unit 34*d*. The configuration and operation of the shutter closing mechanisms 73*d* (the shutter holding mechanisms) will be described in detail below with reference to FIGS. 39 to 41.

The shutter unit 34*d* with the shutter seal 36 (seal member) attached on a surface to face the toner outlet W is disposed at the bottom portion of the cap unit 34Y configured as above. As illustrated in FIGS. 15 to 17, the shutter unit 34*d* opens and closes the toner outlet B in association with the attachment/detachment operation of the toner container 32Y to the toner-container holder 70.

Figure 23:
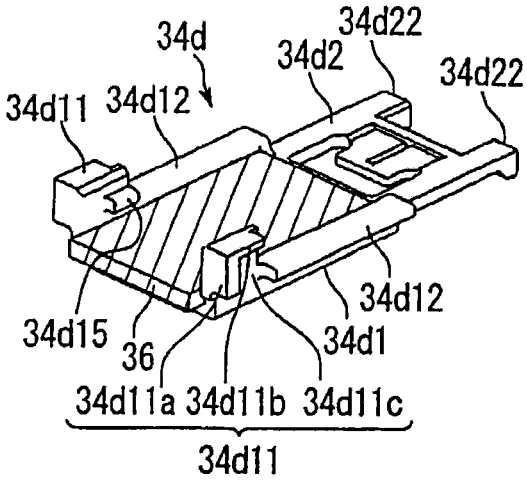
FIG. 23 is a perspective view of the shutter unit.
Figure 24:
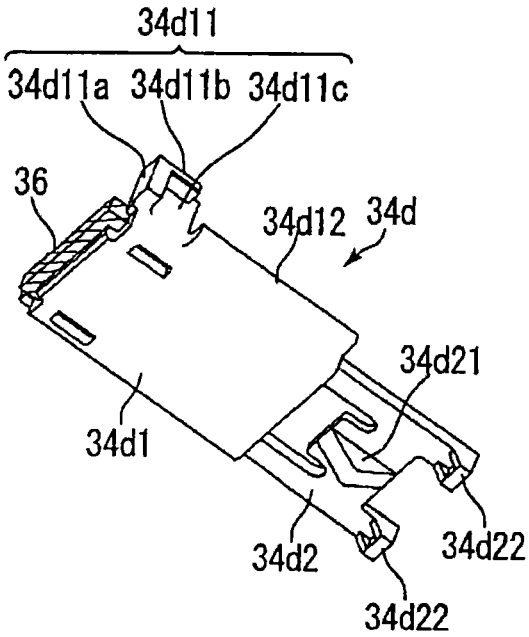
FIG. 24 is another perspective view of the shutter unit.

More specifically, referring to FIGS. 23 and 24, the shutter unit 34*d* includes a plate-shaped shutter main unit 34*d*1 and the deformable shutter member 34*d*2, protruding from the shutter main unit 34*d*1, that is thinner than the shutter main unit 34*d*1 and elastic. Shutter sliders 34*d*12 being a pair are formed on both outer sides of the shutter main unit 34*d*1, and shutter-rail engaging portions 34*d*15 being a pair are formed on both inner sides of the shutter main unit 34*d*1. The shutter sliders 34*d*12 are projections that extend on side portions of the shutter main unit 34*d*1 and parallel to the insertion direction of the toner container 32Y. The shutter-rail engaging portions 34*d*15 project inside the shutter main unit 34*d*1 (on the side opposite to the side where the shutter sliders 34*d*12 protrude) by keeping a predetermined distance from the shutter seal 36. The length of the shutter sliders 34*d*12 in the insertion direction of the toner container 32Y is set, in a state in which the shutter sliders 34*d*12 are assembled to the toner container 32Y, to be equal to the length between the end of one of the shutter rails 34*t* and one of convex portions 34*t*1 formed on the one of the shutter rails 34*t*. The length of each of the slide grooves 34*n*1 formed in the shutter housing unit 34*n* in the insertion direction is approximately equal to the length of each of the shutter sliders 34*d*12.

The shutter sliders 34*d*12 of the shutter main unit 34*d*1 are engaged with the slide grooves 34*n*1 (rail units) of the cap unit 34Y, and the shutter rails 34*t* (rail units) of the cap unit 34Y are engaged, by being sandwiched, with the shutter-rail engaging portions 34*d*15 and the shutter seal 36 of the shutter main unit 34*d*1. Therefore, the shutter main unit 34*d*1 opens and closes the toner outlet W by the movement of the shutter unit 34*d* along the rail units 34*n*1 and 34*t*.

The shutter seal 36 as a seal member is attached on the top face of the shutter main unit 34*d*1 (the surface to face the toner outlet W). The shutter seal 36 prevents toner from leaking between the shutter main unit 34*d*1 and the toner outlet W while the toner outlet W is being closed by the shutter main unit 34*d*1 (the shutter unit 34*d*). The shutter seal 36 is made of foamed resin material or the like.

As illustrated in FIGS. 23 and 24, the shutter seal 36 of the first embodiment is disposed so as to protrude in the longitudinal direction (attachment direction) from one end of the shutter unit 34*d* along the closing direction. The tip of the shutter seal 36 (protruding portion) comes into contact with a wall formed on the circumference of the toner supply port 73*w* (see FIG. 34) when the cap unit 34Y is attached to the cap holder 73, and functions as a seal member to prevent toner in the toner container 32Y from leaking to the periphery of the toner supply port 73*w*.

Referring to FIGS. 23 and 24, the deformable shutter member 34*d*2 of the shutter unit 34*d* is integrally formed on the shutter main unit 34*d*1 and is elastically deformable in the vertical direction by using the connection position between the deformable shutter member 34*d*2 and the shutter main unit 34*d*1 as a base point (a portion surrounded by a dashed circle in FIG. 18). The deformable shutter member 34*d*2 is disposed on the side of the container body 33Y in the longitudinal direction when compared to the shutter main unit 34*d*1 (see FIG. 15). Stoppers 34*d*22 and a stopper releasing unit 34*d*21 are formed on the deformable shutter member 34*d*2. The shutter unit 34*d* is a mechanism for sealing the opening, the shutter main unit 34*d*1 is a cover, and the deformable shutter member 34*d*2 is an extension. This extension 34*d*2 includes a pushing surface 34*d*21 and a blocking surface 34*d*22. There is a restriction 34*n*5 which contacts the blocking surface 34*d*22 to prevent the slidable shutter from sliding. The extension 34*d*2 along with the restriction 34*n*5 are an example of a means for restricting and permitting movement of the shutter.

The stoppers 34*d*22 of the deformable shutter member 34*d*2 are walls formed on the endmost portions (tips of the deformable shutter member 34*d*2 on the distant side from the shutter main unit 34*d*1) in the opening direction of the deformable shutter member 34*d*2 (the left side in FIG. 18). The stoppers 34*d*22 come into contact with contact portions 34*n*5 formed on the shutter housing unit 34*n* of the cap unit 34Y, thereby regulating the motion of the shutter unit 34*d* in a direction from the toner outlet W being closed to open. That is, the stoppers 34*d*22 of the shutter unit 34*d* are in contact with the contact portions 34*n*5 while the toner container 32Y remains isolated (when the toner container 32Y is not set in the body of the image forming apparatus 100), so that the shutter unit 34*d* does not move by itself in the opening direction to open the toner outlet W.

The stopper releasing unit 34*d*21 (stopper releasing projection) of the deformable shutter member 34*d*2 protrudes downward in the vertical direction. The stopper releasing unit 34*d*21 displaces the stoppers 34*d*22 upward along with upward elastic deformation of the deformable shutter member 34*d*2 upon receiving an external force from below, thereby releasing the state of contact between the stoppers 34*d*22 and the contact portions 34*n*5. The stopper releasing unit 34*d*21 is formed between the stoppers 34*d*22 and the connection position (connection position between the shutter main unit 34*d*1 and the deformable shutter member 34*d*2), and is a ridge-shaped projection with slopes formed on both sides along the longitudinal direction. The stopper releasing unit 34*d*21 comes into contact with a stopper-release biasing portion 72*b* (see FIGS. 28 and 38), which is formed on the bottle holder 72, in association with the attachment operation of the toner container 32Y to the toner-container holder 70, and is pushed upward by the stopper-release biasing portion 72*b* (receives an external force from below). Then, the deformable shutter member 34*d*2 is elastically deformed upward and accordingly, the stoppers 34*d*22 are displaced upward. Thus, the contact state between the stoppers 34*d*22 and the contact portions 34*n*5 is released, so that the shutter unit 34*d* can move in the opening direction.

Figure 18A:
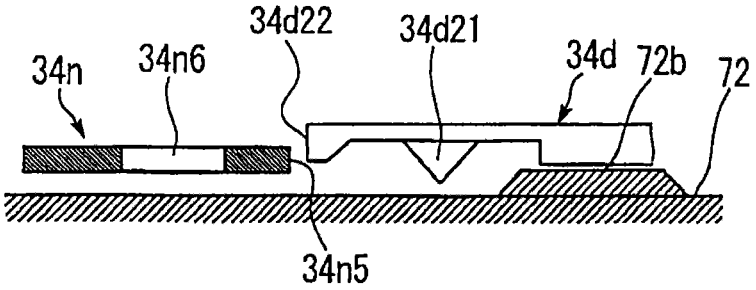
FIGS. 18A to 18C are schematic diagrams illustrating opening operation performed by the shutter unit in association with attachment operation of the toner container to a toner-container holder.
Figure 18B:
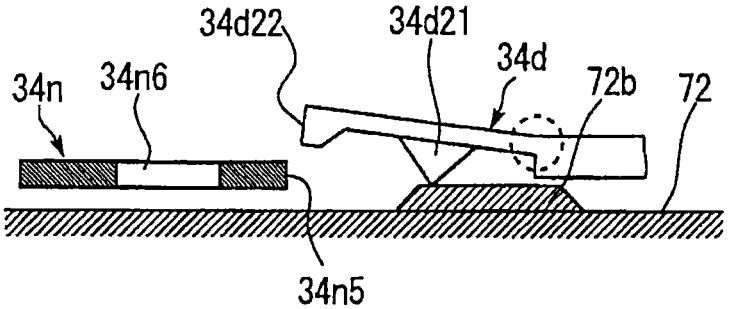
Figure 18C:
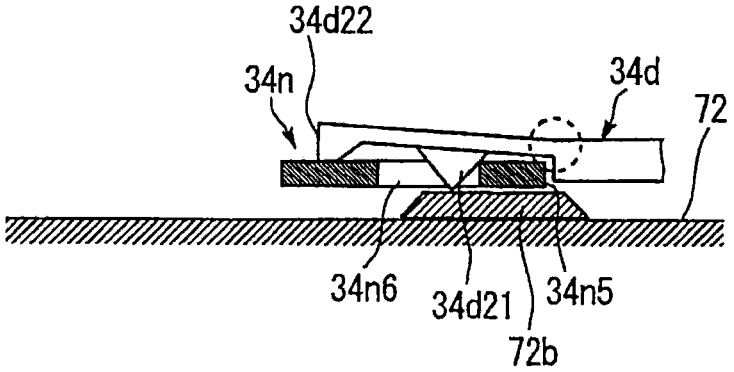

Referring to FIGS. 18A to 18C, the operation of the shutter unit 34*d* in association with the attachment operation of the toner container 32Y to the toner-container holder 70 will be described in detail below. The positions of the shutter unit 34*d* in FIGS. 18A to 18C correspond, respectively, to the positions of the shutter unit 34*d* in FIGS. 15 to 17.

As illustrated in FIG. 18A, when the attachment operation of the toner container 32Y to the toner-container holder 70 (movement to the right in FIGS. 18A to 18C) is started yet the stopper releasing unit 34*d*21 of the shutter unit 34*d* has not reached the position of the stopper-release biasing portion 72*b* formed on the bottle holder 72 (also see FIGS. 28 and 38), the stoppers 34*d*22 of the shutter unit 34*d* are in contact with the contact portions 34*n*5 and the motion of the shutter unit 34*d* in the opening direction is regulated. As illustrated in FIG. 18B, when the attachment operation of the toner container 32Y proceeds, the stopper releasing unit 34*d*21 is pushed upward by the stopper-release biasing portion 72*b*, and the deformable shutter member 34*d*2 is elastically deformed by using the connection position (a portion surrounded by a dashed circle) as a base point. Accordingly, the contact state between the stoppers 34*d*22 and the contact portions 34*n*5 is released and the shutter unit 34*d* is allowed to relatively move in the opening direction.

Thereafter, the shutter unit 34*d* comes into contact with the wall formed on the circumference of the toner supply port 73*w* of the cap holder 73 (see FIG. 34), so that the motion of the shutter unit 34*d* in the toner-container holder 70 (the cap holder 73) is regulated (the shutter unit 34*d* does not move in the longitudinal direction at all). However, the toner container 32Y is allowed to move in the attachment direction, so that the shutter unit 34*d* relatively moves in the opening direction. That is, as illustrated in FIG. 18C, the shutter unit 34*d* relatively moves to the side of the container body 33Y and the deformable shutter member 34*d*2 is housed in the shutter housing unit 34*n* (housing unit). Thus, the opening process of the toner outlet W is completed by the movement of the shutter unit 34*d* in the opening direction. At this time, the stopper releasing unit 34*d*21 of the shutter unit 34*d* is stored in a notch portion 34*n*6 of the shutter housing unit 34*n* (also see FIG. 17).

As described above, the toner container 32Y of the first embodiment includes, on the shutter unit 34*d*, the deformable shutter member 34*d*2 that is elastically deformed by using the connection position of the shutter main unit 34*d*1 as a base point, and also includes, on the deformable shutter member 34*d*2, the stoppers 34*d*22 for regulating the motion of the shutter unit 34*d* in the opening direction and the stopper releasing unit 34*d*21 for releasing the regulation. Therefore, the shutter unit 34*d* does not open the toner outlet W by itself while the toner container 32Y remains isolated. Instead, the shutter unit 34*d* opens the toner outlet W in association with the attachment operation only when the toner container 32Y is set in the body of the image forming apparatus 100.

The shutter-rail engaging portions 34*d*15 of the shutter main unit 34*d*1 (see FIG. 23) also function as second stoppers that come into contact with a second contact portion formed on the cap unit 34Y (a portion surrounded by a dashed circle in FIGS. 19 and 20) and regulate a motion of the shutter unit 34*d* in a closing direction (the opposite direction of the direction in which the stoppers 34*d*22 perform regulation). That is, when the shutter unit 34*d* transits from the state in which the toner outlet W is open (the state illustrated in FIG. 17) to the state in which the toner outlet W is closed (the state illustrated in FIG. 15), the shutter-rail engaging portions 34*d*15 (the second stoppers) of the shutter unit 34*d* come into contact with the second contact portion (the portion surrounded by the dashed circle in FIGS. 19 and 20) on the trailing side in the closing direction, and the stoppers 34*d*22 of the shutter unit 34*d* come into contact with the contact portions 34*n*5 on the leading side in the closing direction. Accordingly, the position of the shutter unit 34*d* in the closed state is fixed. At this time, the shutter-rail engaging portions 34*d*15 of the shutter unit 34*d* come into contact with the second contact portion just after passing over the convex portions 34*t*1 formed on the shutter rails 34*t* (see FIGS. 20 and 21), so that it is possible to gain a click feeling in closing the shutter unit 34*d*.

Referring to FIGS. 19 to 21, ribs 34*p* having vertical surfaces on the same virtual planes as the vertical surfaces 34*s* of the shutter rails 34*t* (or vertical surfaces parallel to the virtual plane) are extended on the upper sides of the shutter rails 34*t* in the longitudinal direction while groove portions are interposed between the ribs 34*p* and the shutter rails 34*t*. The ribs 34*p* prevent the first holding members 73*d*1 from entering the groove portions on the upper sides of the shutter rails 34*t* when the first holding members 73*d*1 of the shutter closing mechanisms 73*d* (shutter holding mechanisms) illustrated in FIG. 41 hold the vertical surfaces 34*s* of the shutter rails 34*t*. That is, a distance between one of the ribs 34*p* and one of the shutter rails 34*t* on the same side of the first member 34Y1 between the two elements of the ribs 34*p* and the shutter rails

34*t* (a distance of the groove portion) is set to be shorter than the heights of the first holding members 73*d*1 (the lengths in a direction perpendicular to the sheet of FIG. 41).

The ribs 34*p* can fulfill the functions as long as the ribs 34*p* laterally protrude (in the direction perpendicular to the sheet of FIG. 25) and extend in the longitudinal direction (the horizontal direction in FIG. 25). Therefore, the ribs 34*p* do not necessarily have the vertical surfaces described above.

Figure 39:
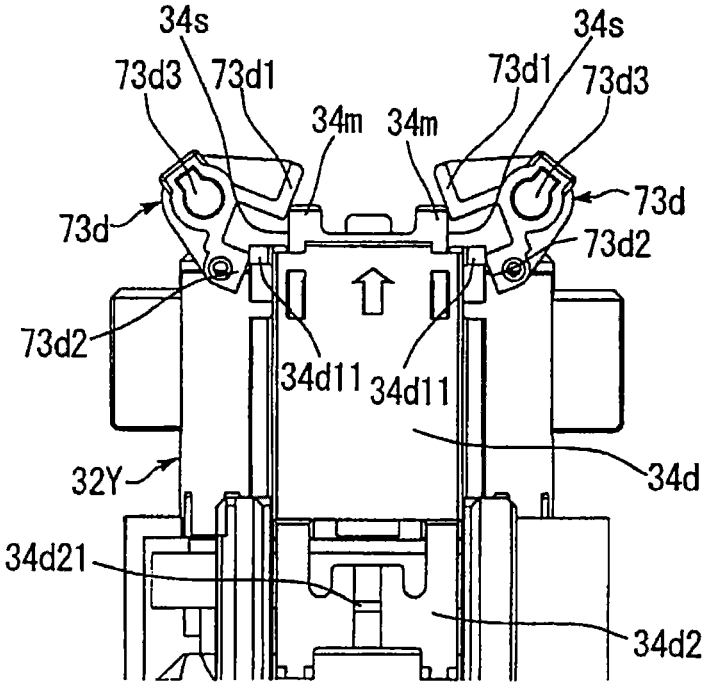
FIG. 39 is a bottom view of how the shutter unit of the toner container opens the toner outlet while being engaged with a shutter holding mechanism of the toner-container holder.
Figure 40:
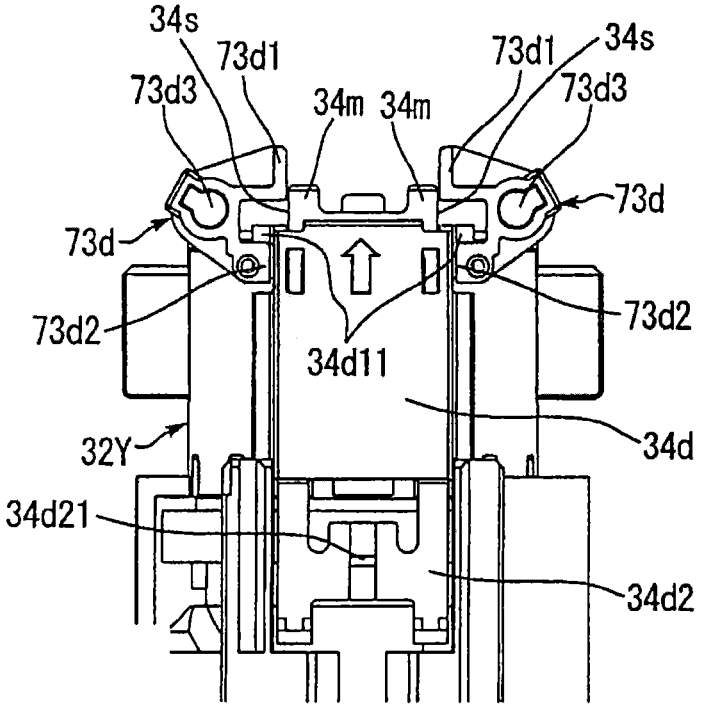
FIG. 40 is a bottom view illustrating a state following the state illustrated in FIG. 39.

Referring to FIGS. 23 and 24, held portions or protrusions 34*d*11 being a pair are formed on the attachment direction's side of the tips on both sides of the edges of the shutter main unit 34*d*1 of the shutter unit 34*d*. These held portions or protrusions may be considered a means for moving the shutter. As illustrated in FIGS. 39 to 41, the held portions 34*d*11 are held by the second holding members 73*d*2 of the shutter closing mechanisms 73*d* (shutter holding mechanisms) at the time of the open/close operation of the shutter unit 34*d*. Each of the held portions 34*d*11 is formed of an engaging wall 34*d*11*a* that stands on the tip of the shutter main unit 34*d*1 in the attachment direction, a suppression wall 34*d*11*b* extending on the upper side of the held portion 34*d*11 to be parallel to the attachment direction, and a side wall 34*d*11*c* (which also functions as a side wall of the shutter main unit 34*d*1).

The held portions 34*d*11 of the shutter unit 34*d* are held by the second holding members 73*d*2 of the shutter closing mechanisms 73*d* (shutter holding mechanisms) and the vertical surfaces 34*s* of the cap unit 34Y are held by the first holding members 73*d*1 of the shutter closing mechanisms 73*d* (shutter holding mechanisms) at the time of the open/close operation of the shutter unit 34*d*. Accordingly, the postures of the shutter unit 34*d* and the cap unit 34Y in the cap holder 73 during the open/close operation of the shutter unit 34*d* can be fixed. At this time, the second holding members 73*d*2 of the shutter closing mechanisms 73*d* (shutter holding mechanisms) hold the side walls 34*d*11*c* of the held portions 34*d*11 (the shutter main unit 34*d*1), and the suppression walls 34*d*11*b* function to suppress vertical motion of the held portions 34*d*11 relative to the second holding members 73*d*2. The engaging walls 34*d*11*a* of the held portions 34*d*11 are engaged with the second holding members 73*d*2, which will be described later. The shutter closing mechanism 73 in its entirety, or just the second holding member 73*d*2 may be considered a movable catch.

Referring to FIGS. 17 and 41, the toner outlet W of the cap unit 34Y, which is opened and closed by the shutter unit 34*d* configured as above, has a hexagonal shape when viewed from below in the vertical direction.

More specifically, an edge portion 34*r* protruding downward is formed on the circumference of the toner outlet W of the cap unit 34Y. The edge portion 34*r* has vertex portions 34*r*1 on both sides in the longitudinal direction (the vertical direction in FIG. 41). Each of the tips 34*r*1 has a pointed shape that is pointed in a longitudinal direction to be separated from the center of the toner outlet W. More specifically, when viewed from below in the vertical direction, the edge portion 34*r* is a hexagonal edge portion having parallel portions 34*r*2 that are opposed to each other along the longitudinal direction (the vertical direction in FIG. 41), and the two vertex portions 34*r*1 that are positioned on the tips opposing to each other in the longitudinal direction. The toner outlet W has a hexagonal shape that follows the hexagonal shape of the edge portion 34*r*.

In this manner, the tips 34*r*1, which are formed on the edge portion 34*r* on the circumference of the toner outlet W in the longitudinal direction (the direction in which the shutter unit 34*d* is opened and closed), have pointed shapes, so that when the shutter unit 34*d* is closed, the shutter seal 36 attached to the shutter unit 34*d* first comes into slide contact with the edge portion 34*r* at the pointed-shaped vertex portion 34*r*1 with a small area, and thereafter, the area of the slide contact gradually increases. Therefore, the shutter seal 36 is less likely to be peeled off or damaged due to the contact with the edge portion 34*r*. When the shutter unit 34*d* is opened, the area of the slide contact gradually decreases, so that the damage on the shutter seal 36 due to the contact with the edge portion 34*r* is reduced.

Figure 43:
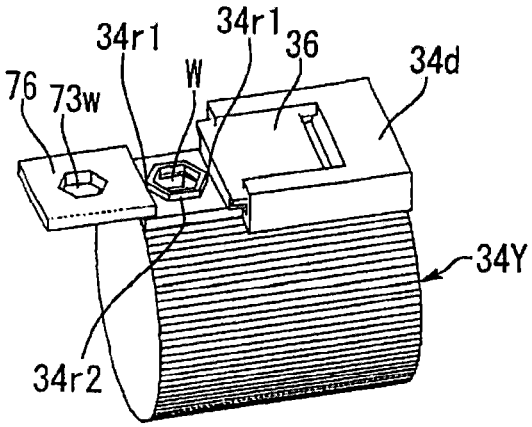
FIG. 43 is a schematic perspective view of the cap unit of the toner container and a seal member of the toner-container holder.

Referring to FIG. 43, a seal member 76 made of foamed resin material is attached to the circumference of the toner supply port 73*w* of the cap holder 73 (also see FIG. 38), so that it is possible to prevent toner from scattering from the toner supply port 73*w* connected with the toner outlet W of the toner container 32Y. Even when the edge portion 34*r* of the cap unit 34Y comes into slide contact with the seal member 76 arranged on the circumference of the toner supply port 73*w* in association with the attachment operation of the toner container 32Y in the longitudinal direction, the edge portion 34*r* comes into slide contact with the seal member 76 first at the pointed-shaped vertex portion 34*r*1 with a small area, and thereafter, the area of the slide contact gradually increases. Therefore, the seal member 76 of the toner supply port 73*w* is less likely to be peeled off or damaged due to the contact with the edge portion 34*r*. In addition, when the detachment operation of the toner container 32Y in the longitudinal direction is performed, the area of the slide contact between the seal member 76 of the toner supply port 73*w* and the edge portion 34*r* gradually decreases, so that damage on the seal member 76 of the toner supply port 73*w* due to the contact with the edge portion 34*r* can be reduced. In FIG. 43, the positional relationship between the seal member 76 of the toner supply port 73*w* and the toner outlet W is illustrated in a vertically reversed manner for the sake of easy understanding.

Therefore, it is possible to securely prevent toner (or remaining toner) housed in the toner container 32Y from scattering to outside in association with the attachment/detachment operation of the toner container 32Y to/from the body of the image forming apparatus 100.

Referring to FIG. 17, in the first embodiment, the edge portion 34*r* of the cap unit 34Y is configured such that planes (planes in contact with the vertex portions 34*r*1) perpendicular to the longitudinal direction (the vertical direction in FIG. 41) have tapered shapes so that the amount of downward protrusion gradually decreases as the distance from the center of the toner outlet W increases.

With this configuration, even when the shutter seal 36 attached to the shutter unit 34*d* is rubbed by the edge portion 34*r* in association with the attachment/detachment operation of the toner container 32Y in the longitudinal direction, the shutter seal 36 is less likely to be damaged. Similarly, even when the seal member 76 (see FIG. 43) arranged on the circumference of the toner supply port 73*w* of the cap holder 73 is rubbed by the edge portion 34*r* in association with the attachment/detachment operation of the toner container 32Y in the longitudinal direction, the seal member 76 is less likely to be damaged.

Denoting, respectively, the volume-average particle size and the number-average particle size of toner contained in the toner containers 32Y, 32M, 32C, and 32K by Dv (μm) and Dn (μm), the toner used in the first embodiment is manufactured so that the following conditions are satisfied.

$$3 \leq Dv \leq 8 \quad (1)$$

$$1.00 \leq Dv/Dn \leq 1.40 \quad (2)$$

Therefore, toner particles suited for an image pattern are selected in a developing process to maintain good image quality, and, even when the toner is stirred in the developing device for a long period of time, good developing capability can be maintained. Furthermore, toner can be efficiently and securely conveyed without blocking the toner supply path such as a tube 75.

The volume-average particle size and the number-average particle size of toner are measured by using, for example, Coulter-counter particle size distribution measurement device such as "COULTER COUNTER TA-2" (Beckman Coulter, Inc.) or "COULTER MULTISIZER 2" (Beckman Coulter, Inc.).

In the first embodiment, as the toner contained in the toner containers 32Y, 32M, 32C, and 32K, approximately spherical toner with a shape factor SF-1 in a range from 100 to 180 and with a shape factor SF-2 in a range from 100 to 180 is used. Therefore, it is possible to maintain high transfer efficiency and prevent reduction in cleaning performance. In addition, toner can be efficiently and securely conveyed without blocking the toner supply path such as the tube 75.

The shape factor SF-1 represents the degree of sphericity of a toner particle, and is obtained by the following equation:

$$SF\text{-}1=(M^2/S)\times(100\pi/4).$$

In the above equation, M is the maximum particle size in a projection plane of the toner particle (the largest particle size among various particle sizes), and S is an area of the projection plane of the toner particle. Therefore, a toner particle with the shape factor SF-1 of 100 is perfectly spherical, and the sphericity decreases as the shape factor becomes greater than 100.

The shape factor SF-2 represents the irregularity of a toner particle, and is determined by the following equation:

$$SF\text{-}2=(N^2/S)\times(100/4\pi).$$

In the equation, N is the circumferential length in the projection plane of the toner particle, and S is an area of the projection plane of the toner particle. Therefore, a toner particle with the shape factor SF-2 of 100 has no irregularities, and the irregularity increases as the shape factor becomes greater than 100.

The shape factor SF-1 and the shape factor SF-2 are obtained by photographing toner particles by using a scanning electron microscope "S-800" (manufactured by Hitachi, Ltd.) and analyzing the obtained photograph of the toner particles by an image analyzer "LUSEX3" (manufactured by Nireco Corporation).

The toner-container holder 70 (the bottle holder 72 and the cap holder 73) will be described in detail below with reference to FIGS. 28 to 42.

Figure 28:
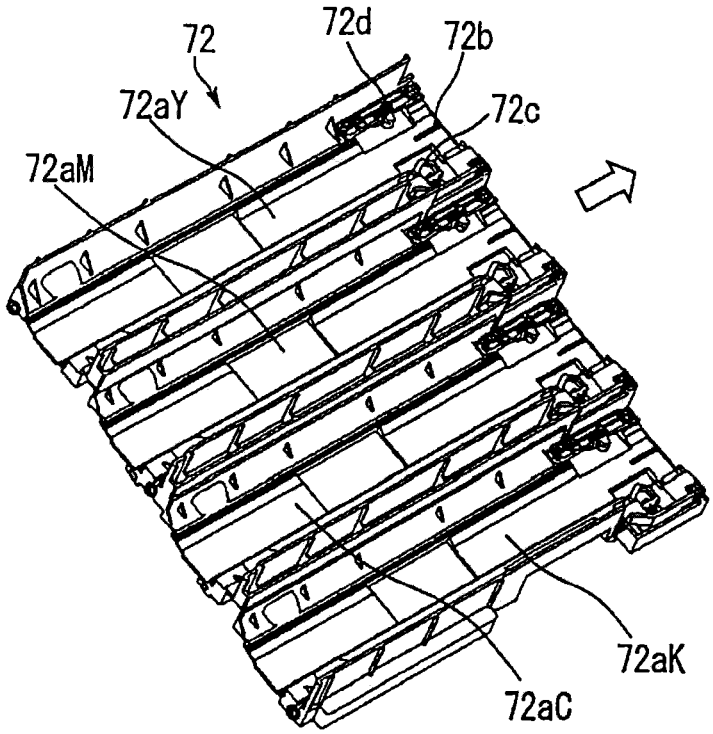
FIG. 28 is a perspective view of a bottle holder of the toner-container holder.
Figure 29:
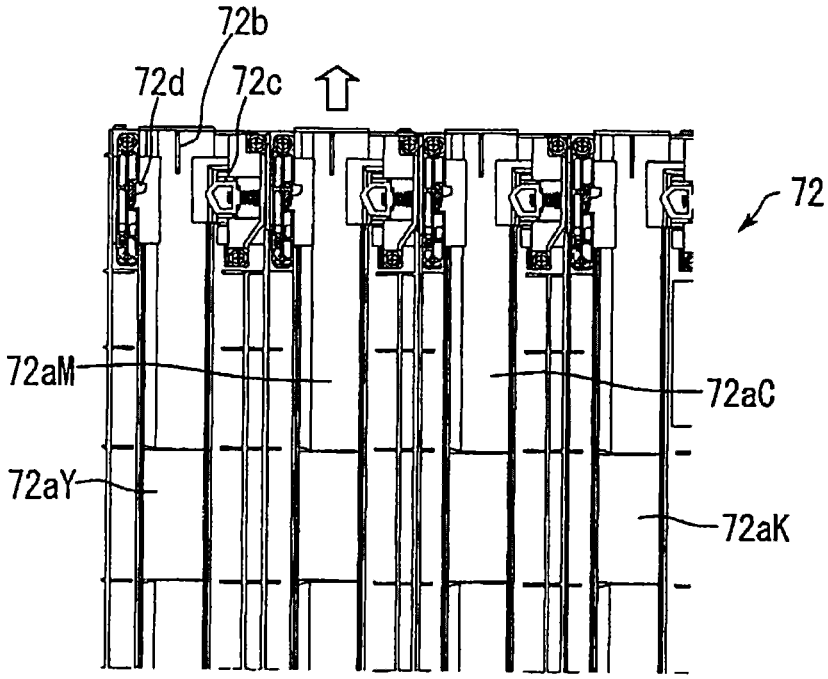
FIG. 29 is a top view of the bottle holder of the toner-container holder.
Figure 33:
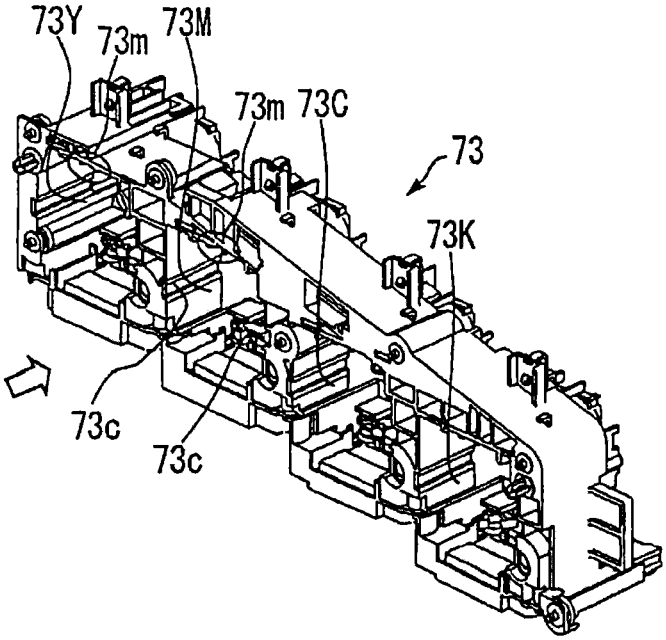
FIG. 33 is a perspective view of a cap holder of the toner-container holder.

As described above with reference to FIG. 4, the toner-container holder 70 includes the bottle holder 72, the cap holder 73, and the insertion port 71. The toner container 32Y is attached to the toner-container holder 70 from the insertion port 71 in the longitudinal direction as the attachment direction with the cap unit 34Y positioned at the leading end of the container body 33Y, while being kept by a user gripping the gripper 33*d* such that the longitudinal direction of the toner container 32Y is parallel to the horizontal direction. The toner container 32Y inserted from the insertion port 71 is pushed into the cap holder 73 by the user while sliding on the bottle holding face 72*a* of the bottle holder 72 (see FIGS. 30 and 31). Referring to FIGS. 28 and 29, bottle holding faces 72*a*Y, 72*a*M, 72*a*C, and 72*a*K are formed on the bottle holder 72 for the respective colors, and the toner containers 32Y, 32M, 32C, and 32K are inserted to the respective bottle holding faces (in a direction indicated by an outlined arrow). Referring to FIG. 33, bottle holders 73Y, 73M, 73C, and 73K are formed on the cap holder 73 for the respective colors. The toner containers 32Y, 32M, 32C, and 32K are inserted in the respective bottle holders (in a direction indicated by an outlined arrow), so that each of the cap units 34Y, 34M, 34C, and 34K is non-rotatably held at the inserted position.

Referring to FIGS. 28 to 32, the bottle holder 72 of the toner-container holder 70 includes the bottle holding face 72*a*, the stopper-release biasing portion 72*b*, the pressing member 72*c*, the pressure receiving member 72*d*, the compression spring 72*e*, and a torsion coil spring 72*f*.

The bottle holding face 72*a* functions as a sliding face of the toner container 32Y during the attachment/detachment operation of the toner container 32Y, and functions as a holding unit of the rotatable container body 33Y after setting of the toner container 32Y is completed.

Referring to FIG. 29, the stopper-release biasing portion 72*b* is a trapezoidal rib formed on the upper side (trailing side in the attachment direction of the toner container 32Y) of the bottle holding face 72*a*. As described above with reference to FIG. 18, the stopper-release biasing portion 72*b* pushes the stopper releasing unit 34*d*21 of the shutter unit 34*d* upward to release the contact state between the stoppers 34*d*22 and the contact portions 34*n*5 in association with the attachment operation of the toner container 32Y (in order to enable the opening operation of the shutter unit 34*d*).

Figure 30:
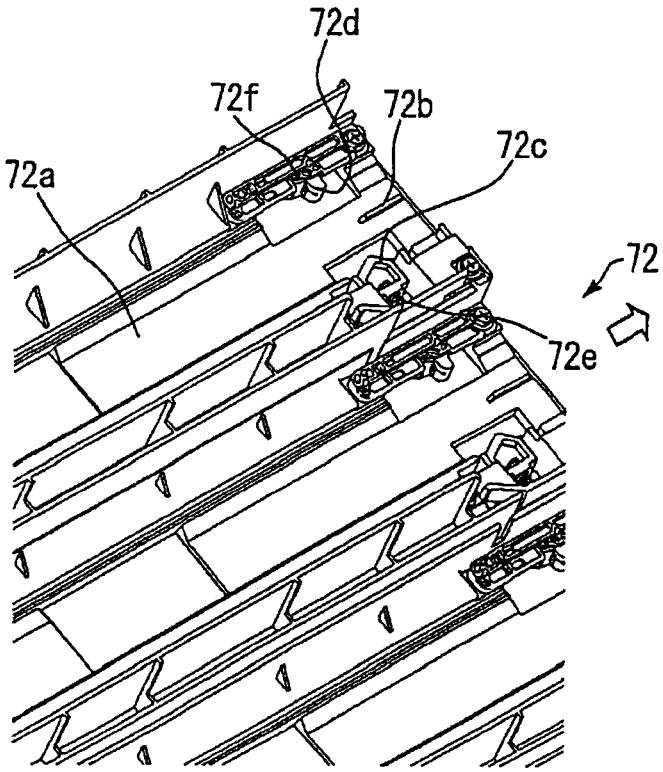
FIG. 30 is an enlarged perspective view of the vicinity of a leading-end portion of the bottle holder.
Figure 32:
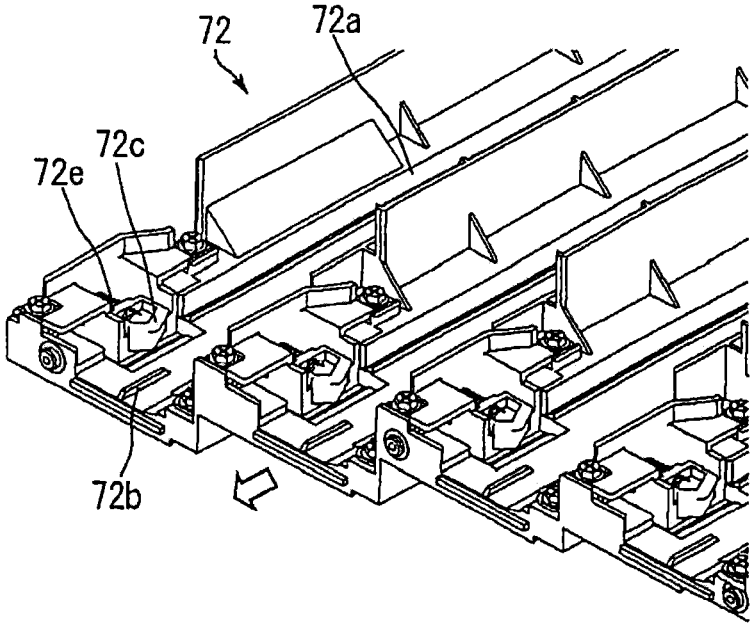
FIG. 32 is still another enlarged perspective view of the vicinity of the leading-end portion of the bottle holder.

Referring to FIG. 29, the pressing member 72*c* is disposed on a side wall on the right side of the bottle holding face 72*a* on the downstream side in the attachment direction of the toner container 32Y. As illustrated in FIGS. 30 and 32, the tip of the pressing member 72*c* is formed to have a ridge shape, and the bottom portion of the pressing member 72*c* is connected to one end of the compression spring 72*e*. The pressing member 72*c* configured as above is urged by the compression spring 72*e* to the left in FIG. 29.

Figure 31:
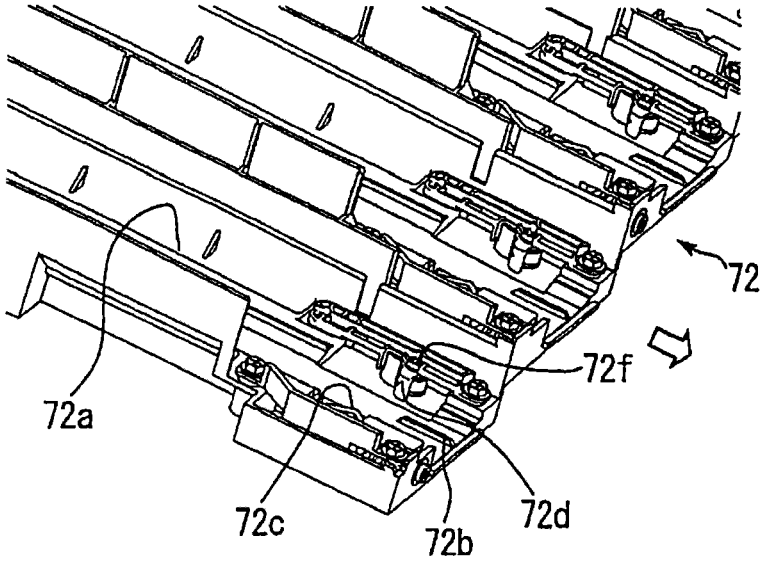
FIG. 31 is another enlarged perspective view of the vicinity of the leading-end portion of the bottle holder.

Referring to FIG. 29, on the other hand, the pressure receiving member 72*d* is disposed on a side wall on the left side of the bottle holding face 72*a* (the position to face the pressing member 72*c*) on the trailing side in the attachment direction of the toner container 32Y. As illustrated in FIG. 31, the tip of the pressure receiving member 72*d* is formed such that two curves form a reversed V-shape (the v-shaped cleavage faces diagonally the lower right side in FIG. 29), and the bottom portion of the pressure receiving member 72*d* is connected to the torsion coil spring 72*f*. The pressure receiving member 72*d* is oscillatory movable about a shaft portion where the coil portion of the torsion coil spring 72*f* is inserted.

With the pressing member 72*c* and the pressure receiving member 72*d* configured as above, the position of the cap unit 34Y just before being inserted to the cap holder 73 is fixed when the toner container 32Y is attached to the toner-container holder 70. More specifically, the pressing rail 34*n*2 of the cap unit 34Y (see FIG. 12) is engaged with the pressing member 72*c*, so that the cap unit 34Y is pressed by the pressing member 72*c* to the left in FIG. 29. The pressure receiving face 34*n*3 (see FIG. 11) of the cap unit 34Y pressed by the pressing member 72*c* comes into slide contact with the pressure receiving member 72*d* by which the pressing force is received to fix the position of the cap unit 34Y in the horizontal direction in FIG. 29.

Referring to FIGS. 33 to 37, the cap holder 73 of the toner-container holder 70 includes the main guide pin 73*a*, the sub-guide pin 73*b*, the engaged portion 73*m*, the lateral grooves 73*c*, the shutter closing mechanisms 73*d* (the shutter holding mechanisms), the toner supply port 73*w*, evacuation holes 73*k*, the antenna 73*e* (RFID antenna), and the driving gear 81.

Figure 37:
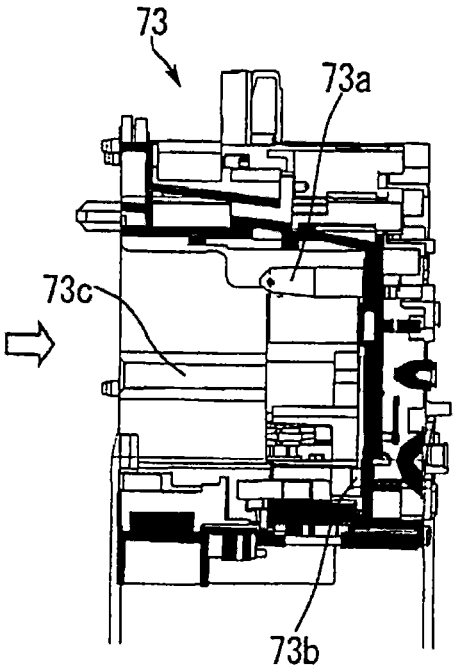
FIG. 37 is a cross-sectional view of the cap holder.

As described above with reference to FIG. 11, the main guide pin 73*a* and the sub-guide pin 73*b* are engaged with the first hole unit 34*a* and the second hole unit 34*b* of the cap unit 34Y, respectively. Accordingly, the position of the cap unit 34Y in the cap holder 73 is fixed. Referring to FIG. 37, the main guide pin 73*a* is longer than the sub-guide pin 73*b* in the longitudinal direction (positions of the guide surfaces that function as the base portions are formed on the plane that is common to the main guide pin 73*a* and the sub-guide pin 73*b*). The tip of the main guide pin 73*a* is formed to be tapered. Therefore, it is possible to smoothly attach the toner container 32Y to the cap holder 73 in the attachment operation of the toner container 32Y to the cap holder 73 in the longitudinal direction.

The engaged portion 73*m* is engaged with the first engaging portion 34*e* and the second engaging portions 34*f* (regulator) formed on the cap unit 34Y of the toner container 32Y. Therefore, the cap unit 34Y is attached to and detached from the cap holder 73 while the posture of the cap unit 34Y in the horizontal direction is regulated. The lateral grooves 73*c* are engaged with the lateral projections 34*c* (second regulator) formed on the cap unit 34Y of the toner container 32Y. Therefore, the cap unit 34Y is attached to and detached from the cap holder 73 while the posture of the cap unit 34Y in the rotational direction is regulated. Furthermore, the posture of the cap unit 34Y in the rotational direction is regulated while the cap unit 34Y is being attached to the cap holder 73.

Figure 38:
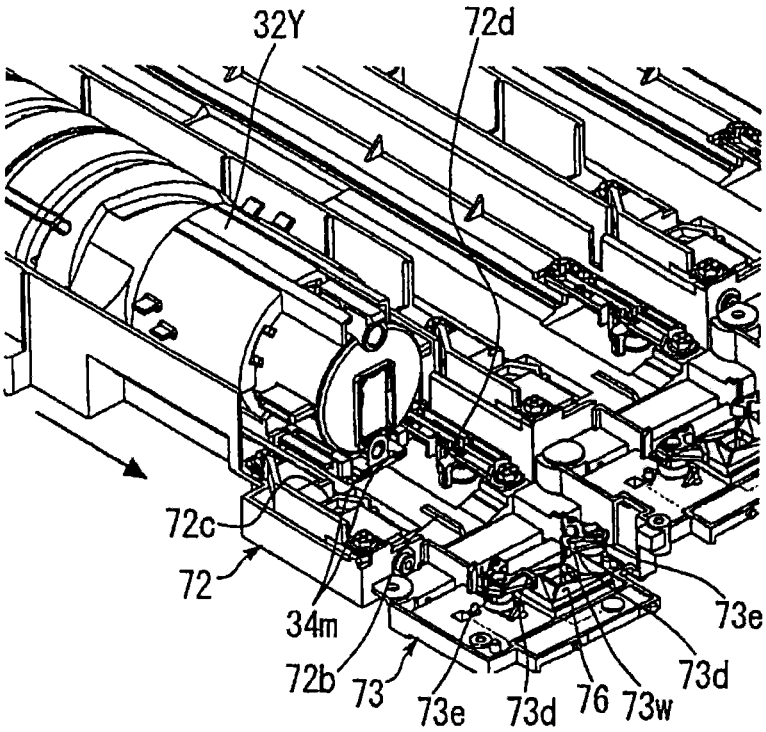
FIG. 38 is a perspective view of how the toner container is set in the toner-container holder.

Referring to FIGS. 34 and 38, the shutter closing mechanisms 73*d* (shutter holding mechanisms) are disposed at the bottom position inside the cap holder 73, and on the leading side of the toner supply port 73*w* in the attachment direction of the toner container 32Y. The shutter closing mechanisms 73*d* being a pair are approximately horseshoe-shaped members that are arranged to face each other in the horizontal direction in FIG. 39, and are configured to be rotatable about supporting shafts 73*d*3 at which torsion coil springs are arranged. The first holding members 73*d*1 are formed on one end of the respective shutter closing mechanisms 73*d* (shutter holding mechanisms), and the second holding members 73*d*2 are formed on the other ends of the shutter closing mechanisms 73*d*. As described above, the held portions 34*d*11 of the shutter unit 34*d* are held by the second holding members 73*d*2 and the vertical surfaces 34*s* of the cap unit 34Y are held by the first holding members 73*d*1 during the open/close operation of the shutter unit 34*d* in the toner container 32Y, so that the postures of the shutter unit 34*d* and the cap unit 34Y in the cap holder 73 are fixed during the open/close operation of the shutter unit 34*d*. Consequently, it is possible to smoothly perform the open/close operation.

FIGS. 39 to 41 are diagrams illustrating the operation of the shutter closing mechanisms 73*d* (shutter holding mechanisms) in association with the open/close operation of the shutter unit 34*d*. As illustrated in FIG. 39, when the opening operation of the shutter unit 34*d* is performed, the first holding members 73*d*1 come into contact with the projections 34*m* and the second holding members 73*d*2 come into contact with the held portions 34*d*11 of the shutter unit 34*d* in association with the attachment operation of the toner container 32Y in the direction indicated by an outlined arrow.

Thereafter, as illustrated in FIG. 40, when the attachment operation of the toner container 32Y in the direction indicated by the outlined arrow proceeds, the shutter closing mechanisms 73*d* (shutter holding mechanisms) rotate about the supporting shafts 73*d*3, so that the first holding members 73*d*1 hold the vertical surfaces 34*s* of the projections 34*m* of the cap unit 34Y and the second holding members 73*d*2, while being engaged with the engaging walls 34*d*11*a* of the held portions 34*d*11 of the shutter unit 34*d*, hold the side walls 34*d*11*c* (the shutter unit 34*d*) of the shutter main unit 34*d*1 (the held portions 34*d*11).

Thereafter, the shutter unit 34*d* comes into contact with the wall formed on the circumference of the toner supply port 73*w* of the cap holder 73 (see FIG. 34). Accordingly, the motion of the shutter unit 34*d* in the cap holder 73 is regulated as the shutter unit 34*d* is sandwiched between the wall and the second holding members 73*d*2 (the shutter unit 34*d* never move in the longitudinal direction). However, because the movement of the toner container 32Y in the attachment direction proceeds, the shutter unit 34*d* relatively moves in the opening direction. That is, as illustrated in FIG. 41, the shutter unit 34*d* relatively moves toward the container body 33Y, thereby to open the toner outlet W. At this time, as illustrated in FIG. 41, the opening operation of the shutter unit 34*d* is performed while the first holding members 73*d*1 hold the vertical surfaces 34*s* of the cap unit 34Y and the second holding members 73*d*2, being engaged with the held portions 34*d*11 of the shutter unit 34*d*, hold the shutter unit 34*d*. Therefore, the postures of the shutter unit 34*d* and the cap unit 34Y in the cap holder 73 are fixed and the opening operation of the shutter unit 34*d* can be smoothly performed.

On the other hand, when the toner container 32Y is removed (detached) from the toner-container holder 70 (the cap holder 73), the operation is performed in reverse order of the attachment operation described above. That is, the operation of the shutter closing mechanisms 73*d* (shutter holding mechanisms) in association with the closing operation of the shutter unit 34*d* is performed in the order of FIGS. 41, 40, and 39.

Referring to FIG. 40, in the first embodiment, because the vertical surfaces 34*s* that function as the held surfaces to be held by the first holding members 73*d*1 extend in the attachment direction (in the upward direction in FIG. 40) (because the projections 34*m* are arranged), when the toner container 32Y is removed from the toner-container holder 70, a timing at which the shutter closing mechanisms 73*d* (the second holding members 73*d*2) release holding of the shutter unit 34*d* (the held portions 34*d*11) using the vertical surfaces 34*s* as references can be delayed as compared to a timing at which the shutter closing mechanisms 73*d* completely close the shutter unit 34*d*. That is, because the vertical surfaces 34*s* (the projections 34*m*) are formed to extend to protrude to the upper side in FIG. 40, when the closing operation of the shutter unit 34*d* is performed (relative movement of the shutter unit 34*d* from the state illustrated in FIG. 41 to the state illustrated in FIG. 40), rotation of the shutter closing mechanisms 73*d* as illustrated in FIG. 39 is prevented and the closing operation of the shutter unit 34*d* can be completed while the first holding members 73*d*1 are holding the vertical surfaces 34*s* of the projections 34*m* and the second holding members 73*d*2 are holding the held portions 34*d*11 of the shutter unit 34*d*. In other words, when the vertical surfaces 34*s* are not formed to extend to protrude to the upper side in FIG. 40, the first holding members 73*d*1 release the holding of the vertical surfaces 34*s* at an earlier timing and the shutter closing mechanisms 73*d* instantly rotate as illustrated in FIG. 39, and accordingly, the second holding members 73*d*2 also release the holding of the held portions 34*d*11 of the shutter unit 34*d*. Consequently, the shutter unit 34*d* cannot complete the closing operation.

As described above, according to the first embodiment, because the projections 34*m* are arranged on the cap unit 34Y, it is possible to prevent the toner container 32Y from being removed from the body of the image forming apparatus 100 before the shutter unit 34*d* completely closes the toner outlet W. Referring to FIGS. 34 and 35, the cap holder 73 has the evacuation holes 73*k* formed on wall surfaces thereof such that the projections 34*m* of the cap unit 34Y do not cause interference with the wall surface of the cap holder 73.

Referring to FIGS. 42A to 42D, when the attachment operation of the toner container 32Y to the toner-container holder 70 proceeds, each portion of the bottle holder 72 and the cap holder 73 is engaged with the cap unit 34Y in sequence as described below.

The cap unit 34Y slides on the bottle holding face 72*a* in the horizontal direction to be inserted to the cap holder 73. While sliding on the bottle holding face 72*a*, the backlash of the cap unit 34Y in the horizontal direction, which may occur immediately before being inserted to the cap holder 73, is reduced by the pressing member 72*c* and the pressure receiving member 72*d*. Thereafter, the first engaging portion 34*e* and the second engaging portions 34*f* of the cap unit 34Y are engaged with the engaged portion 73*m* of the cap holder 73, and the lateral projections 34*c* of the cap unit 34Y are engaged with the lateral grooves 73*c* of the cap holder 73, so that the posture of the cap unit 34Y in the cap holder 73 is regulated in both the vertical and horizontal directions (the state illustrated in FIG. 42A proceeds to the state illustrated in FIG. 42B). Subsequently, the first hole unit 34*a* of the cap unit 34Y is engaged with the main guide pin 73*a* of the cap holder 73, so that the position of the main guide is fixed (the state illustrated in FIG. 42C). Thereafter, the second hole unit 34*b* of the cap unit 34Y is engaged with the sub-guide pin 73*b* of the cap holder 73, so that the positions of the main guide and sub-guide are fixed. Before the positioning is completed (until the engagement of the second hole unit 34*b* with the sub-guide pin 73*b* is completed), the stopper-release biasing portion 72*b* releases the contact state between the stoppers 34*d*22 of the shutter unit 34*d* and the contact portions 34*n*5 in the cap unit 34Y. The shutter unit 34*d* starts the opening operation while the postures of the shutter unit 34*d* and the cap unit 34Y in the cap holder 73 are fixed by the shutter closing mechanisms 73*d* (the shutter holding mechanisms) (the state illustrated in FIG. 42C). In addition, until the engagement of the second hole unit 34*b* with the sub guide pin 73*b* is completed, the seal member 76 arranged on the circumference of the toner supply port 73*w* of the cap holder 73 and the edge portion 34*r* (the wall portion) formed on the circumference of the toner outlet W of the cap unit 34Y come into slide contact with each other. Accordingly, the toner outlet W that is opened in the cap unit 34Y and the toner supply port 73*w* of the cap holder 73 are connected with each other to complete the setting of the cap unit 34Y (the toner container 32Y) in the cap holder 73 (the toner-container holder 70) (the state illustrated in FIG. 42D). At this time, the gear 33*c* of the container body 33Y engages with the driving gear 81 of the image forming apparatus 100, and the RFID chip 35 of the cap unit 34Y is located at a position that is optimal to perform radio communication with the antenna 73*e* of the image forming apparatus 100.

In this manner, according to the first embodiment, because the postures of the shutter unit 34*d* and the cap unit 34Y in the cap holder 73 are fixed by the shutter closing mechanisms 73*d* (the shutter holding mechanisms) in the attachment operation of the toner container 32Y, it is possible to prevent the opening operation of the shutter unit 34*d* from being performed with the state in which the cap unit 34Y (the shutter unit 34*d*) is tilted.

In the attachment operation of the toner container 32Y, after the first hole 34*a* of the cap unit 34Y is engaged with the main guide pin 73*a* of the cap holder 73 to fix the position of the main guide, the postures of the shutter unit 34*d* and the cap unit 34Y in the cap holder 73 are fixed by the shutter closing mechanisms 73*d* (the shutter holding mechanisms). Thereafter, the second hole 34*b* of the cap unit 34Y is engaged with the sub-guide pin 73*b* of the cap holder 73 to fix the positions of the main guide and sub-guide. Therefore, the posture of the cap unit 34Y (the shutter unit 34*d*) can be corrected before the positioning of the cap unit 34Y to the sub-guide is completed.

Before the positioning of the main guide is completed by the engagement of the first hole 34*a* of the cap unit 34Y with the main guide pin 73*a* of the cap holder 73, the lateral projections 34*c* of the cap unit 34Y are engaged with the lateral grooves 73*c* of the cap holder 73, for example, to regulate the posture of the cap unit 34Y in the cap holder 73 in both the vertical and horizontal directions. Therefore, the cap unit 34Y can be smoothly positioned to the cap holder 73.

After the postures of the shutter unit 34*d* and the cap unit 34Y in the cap holder 73 are fixed by the shutter closing mechanisms 73*d* (the shutter holding mechanisms), the seal member 76 arranged on the circumference of the toner supply port 73*w* and the toner outlet W (the edge portion 34*r*) of the cap unit 34Y come into slide contact with each other, and thereafter the second hole 34*b* of the cap unit 34Y is engaged with the sub-guide pin 73*b* of the cap holder 73, so that the positions of the main guide and sub-guide are fixed. Therefore, the posture of the cap unit 34Y (the shutter unit 34*d*) can be corrected without receiving sliding contact resistance of the seal member 76.

In the first embodiment, because the shutter closing mechanism 73*d* (the shutter holding mechanism) is arranged near the sub-guide pin 73*b* and not near the main guide pin 73*a*, the postures of the shutter unit 34*d* and the cap unit 34Y in the cap holder 73 are easily corrected by the shutter closing mechanisms 73*d* (the shutter holding mechanisms).

In the detachment of the toner container 32Y, the first hole 34*a* of the cap unit 34Y is kept engaged with the main guide pin 73*a* of the cap holder 73 until the closing operation of the shutter unit 34*d* is completed after the engagement of the second hole 34*b* of the cap unit 34Y with the sub-guide pin 73*b* of the cap holder 73 is released. Therefore, it is possible to prevent the closing operation of the shutter unit 34*d* from being performed with the cap unit 34Y (the shutter unit 34*d*) being tilted.

As described above, according to the image forming apparatus of the first embodiment, by a user's single action of moving the toner container 32Y in the longitudinal direction while gripping the gripper 33*d* (excluding the open/close operation of a body cover 110), the open/close operation of the toner outlet W by the shutter unit 34*d* is also performed and the attachment/detachment operation of the toner container 32Y is completed.

The toner container 32Y of the first embodiment is disposed such that the toner outlet W with a relatively large opening area is arranged to be oriented downward in the vertical direction. Therefore, toner can efficiently be discharged directly from the toner outlet W by the toner's own weight.

The attachment and detachment of the toner container 32Y is performed from the front side of the toner-container holder 70 (the body of the image forming apparatus 100), not being performed from the upper side of the toner-container holder 70 (the body of the image forming apparatus 100). Therefore, flexibility in the layout of the upper side of the toner-container holder 70 is increased. For example, even when a scanner (a document read unit) is disposed above the toner supply devices, operability and workability are not deteriorated in the attachment and detachment of the toner container 32Y.

Furthermore, the toner container 32Y is set in the body of the image forming apparatus 100 with the longitudinal direction of the toner container kept horizontal, and hence, it is possible to increase the toner capacity of the toner container 32Y and to reduce the replacement frequency of the toner container 32Y without affecting the layout of the entire body of the image forming apparatus 100 in the height direction.

The characteristic configuration of the toner container 34Y according to the first embodiment will be summarized with reference to FIG. 43. As illustrated in FIG. 43, the edge portion 34*r* (wall portion) formed on the circumference of the toner outlet W of the cap unit 32Y has the vertex portions 34*r*1 on both the leading and trailing sides in the longitudinal direction. Each of the vertex portions 34*r*1 has a pointed shape. In addition, the edge portion 34*r* (especially the planes, other than the parallel portions 34*r*2, that are in contact with the vertex portions 34*r*1) of the cap unit 34Y is formed in a tapered shape inclined with respect to the vertical direction. With the above configuration, the shutter seal 36 of the shutter unit 34*d* and the seal member 76 provided on the circumference of the toner supply port 73*w* of the cap holder 73 smoothly come into slide contact with the edge portion 34*r* so as to gradually increase (or decrease) a contact area to the edge portion 34*r* in association with the attachment/detachment operation of the toner container 32Y in the longitudinal direction. Therefore, the shutter seal 36 and the seal member 76 are less likely to be peeled or damaged.

Figure 44A:
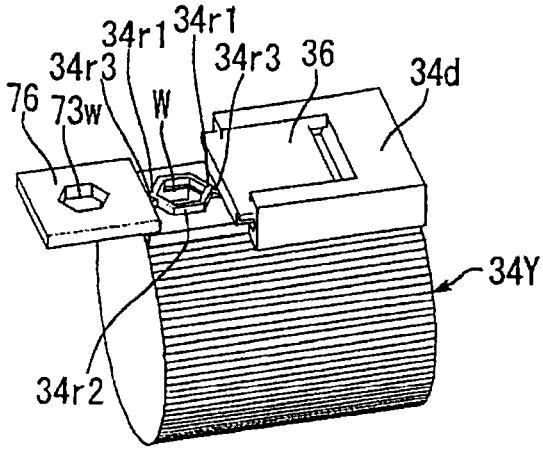
FIGS. 44A to 44B are schematic perspective views illustrating another configuration of the cap unit of the toner container and the seal member of the toner-container holder.

The shapes of the edge portion 34*r* and the toner outlet W are not limited to those in the first embodiment. For example, as illustrated in FIG. 44A, the vertex portions 34*r*1 of the edge portion 34*r* can be formed in tapered shapes so that the amount of downward protrusion gradually decreases from the center of the toner outlet W. More specifically, tapered portions 34*r*3 inclined with respect to the vertical direction can be formed on the vertex portions 34*r*1 of the edge portion 34*r*.

Figure 44B:
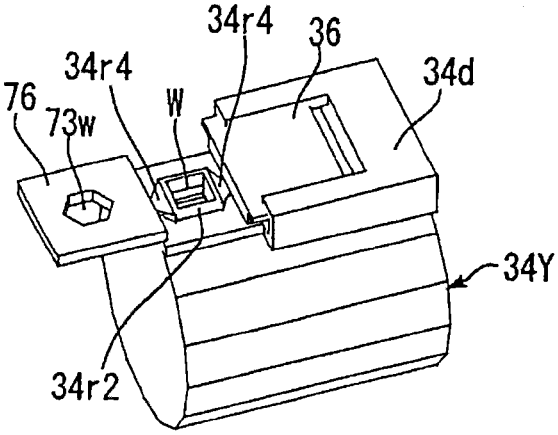

Alternatively, as illustrated in FIG. 44B, the toner outlet W can be formed in a rectangular shape while the outer circumference of the edge portion 34*r* is formed in the hexagonal shape. In addition, vertex portions 34*r*4 of the edge portion 34*r* can be formed in tapered shapes by being inclined with respect to the vertical direction. With both of the above configurations, similarly to the first embodiment, the shutter seal 36 of the shutter unit 34*d* and the seal member 76 provided on the circumference of the toner supply port 73*w* of the cap holder 73 smoothly come into slide contact with the edge portion 34*r* by gradually increasing (or decreasing) a contact area to the edge portion 34*r* in association with the attachment/detachment operation of the toner container 32Y in the longitudinal direction. Therefore, the shutter seal 36 and the seal member 76 are less likely to be peeled or damaged.

As described above, in the toner container 32Y according to the first embodiment, the shutter seal 36 (seal member) is provided on the surface of the shutter unit 34*d* that faces the toner outlet W, and each of the vertex portions 34*r*1 of the edge portion 34*r* is formed in a pointed shape so that the edge portion 34*r* provided on the circumference of the toner outlet W of the cap unit 34Y does not cause the shutter seal 36 to be peeled or damaged. Therefore, a space for arranging the toner container 32Y can be effectively secured in the body of the image forming apparatus 100 and the toner container 32Y can be set to the body of the image forming apparatus 100 with high fitting capability and operability, so that it is possible to prevent toner contained in the toner container 32Y from scattering to the outside of the toner container 32Y in association with attachment/detachment operation of the toner container 32Y to the body of the image forming apparatus 100 even when the toner container 32Y is configured to discharge toner from the toner outlet W by the toner's own weight.

The toner container described above is a toner container that is detachably attached to a body of an image forming apparatus with a longitudinal direction of the toner container being kept horizontal. The toner container includes a cylindrical container body, a cap unit, and a shutter unit. The cylindrical container body has an opening on one end thereof in the longitudinal direction, and is configured to convey toner contained therein toward the opening that is inserted to the cap unit. The cap unit includes a toner outlet at a bottom portion thereof for discharging toner, which has been discharged from the opening of the container body, to the outside of the toner container in a vertically downward direction. The shutter unit is held at the bottom portion of the cap unit and moves along an outer periphery of the cap unit to thereby open and close the toner outlet. The shutter unit includes a seal member on a surface facing the toner outlet, and the cap unit includes an edge portion that protrudes downward and is provided on the circumference of the toner outlet. The edge portion of the cap unit has tips on both sides in the longitudinal direction. Each of the tips has a pointed shape that is pointed in the longitudinal direction so as to be separated from the center of the toner outlet.

That is, the shutter unit 34*d* includes the shutter seal 36 (seal member) on the surface to face the toner outlet W. The cap unit 34Y includes the edge portion 34*r* that protrudes downward and is formed on the circumference of the toner outlet W. The edge portion 34*r* has the vertex portions 34*r*1 on the leading and trailing sides in the longitudinal direction. Each of the vertex portions 34*r*1 has a pointed shape.

In the toner container, when viewed from below in the vertical direction, the edge portion of the cap unit is a hexagonal edge portion having parallel portions that are opposed to each other along the longitudinal direction, and two vertex portions positioned on the tips opposing to each other in the longitudinal direction.

In the toner container, the toner outlet is formed to be hexagonally shaped so as to follow the hexagonal shape of the edge portion when viewed from below in the vertical direction.

In the toner container, the tips of the edge portion have tapered shapes so that the amount of downward protrusion gradually decreases according to the distance from the center of the toner outlet.

In the toner container, the edge portion is formed so that the planes perpendicular to the longitudinal direction have tapered shapes and the amount of downward protrusion gradually decreases according to the distance from the center of the toner outlet.

In the toner container, the seal member is disposed so as to protrude in the longitudinal direction from one end of the shutter unit in the closing direction.

In the toner container, the cap unit includes a cylindrical cavity formed inside thereof so as to extend in the longitudinal direction and a toner fall path that has a columnar shape with a constant flow passage area from a lower circumferential surface of the cylindrical cavity to the toner outlet.

In the toner container, the container body includes a spiral-shaped projection formed on inner circumferential surface thereof and is held to be rotatable with respect to the cap unit.

The toner container is arranged in a body of an image forming apparatus.

In this way, the seal member is provided on the surface of the shutter unit facing the toner outlet, and the tips of the edge portion have tapered shapes so that the edge portion provided on the circumference of the toner outlet does not cause the seal member to be peeled or damaged. Accordingly, a toner container and an image forming apparatus can be provided such that toner contained in the toner container is less likely to scatter to the outside of the toner container in attachment/detachment operation of the toner container to/from the body of the image forming apparatus.

As described above, in the toner container 32Y according to the first embodiment, because the vertical surfaces 34*s*, on which the shutter rails 34*t* guiding the open/close operation of the shutter unit 34*d* are formed, extend from the end of the shutter unit 34*d*, which is at a position of closing the toner outlet W in the closing direction, to the protruding position in the longitudinal direction, a timing at which the shutter closing mechanisms 73*d* arranged in the body of the image forming apparatus 100 release holding of the shutter unit 34*d* using the vertical surfaces 34*s* as references can be delayed as compared to a timing at which the shutter closing mechanisms 73*d* completely close the shutter unit 34*d*. Therefore, a space for arranging the toner container 32Y can be effectively secured in the body of the image forming apparatus 100 and the toner container 32Y can be set to the body of the image forming apparatus 100 with high fitting capability and operability, so that it is possible to obviate troubles caused by the scatter of toner contained in the toner container 32Y from to the outside of the toner container 32Y in the detachment operation of the toner container 32Y from the body of the image forming apparatus 100 even when the toner container 32Y is configured to discharge toner from the toner outlet W by the toner's own weight.

In a conventional toner container, when a flow passage area of a toner conveying path or an opening area of a toner outlet is increased, it is possible to configure a shutter unit so that the shutter unit can slide to open and close the toner outlet in association with attachment/detachment operation of the toner container to/from the body of an image forming apparatus, in order that attachment/detachment operation of the toner container to/from the apparatus body is accomplished by a single action when a longitudinal direction of the toner container is set as an attachment/detachment direction. In this case, however, it is necessary to configure the shutter unit closing the toner outlet so as not to easily move so that the toner contained in the toner container that is isolated from, and not arranged in, the body of the image forming apparatus does not leak toner to the outside of the toner container.

The toner container described above is a toner container that is detachably attached to the body of an image forming apparatus with a longitudinal direction of the toner container kept horizontal, and includes: a cylindrical container body that has an opening on one end thereof in the longitudinal direction, and is configured to convey toner contained therein toward the opening; a cap unit into which the opening of the container body is inserted, and which includes a toner outlet at a bottom portion thereof for discharging toner, which has been discharged from the opening of the container body, to the outside of the toner container in a vertically downward direction; and a shutter unit that is held on the bottom portion of the cap unit, and moves along an outer periphery of the cap unit to thereby open and close the toner outlet. The shutter unit includes: a shutter main unit that is engaged with a rail unit arranged on the cap unit, and moves along the rail unit to thereby open and close the toner outlet; and a deformable shutter member that is integrally formed on the shutter main unit, and is elastically deformable in a vertical direction by using a connection position between the deformable shutter member and the shutter main unit as a base point. The deformable shutter member includes a stopper that comes into contact with a contact portion formed on the cap unit to thereby regulate a motion of the shutter unit in a direction to open the toner outlet that has been closed; and a stopper releasing unit that protrudes downward in the vertical direction, and displaces the stopper upward along with upward elastic deformation of the deformable shutter member upon receiving an external force from below to thereby release a contact state between the stopper and the contact portion.

More specifically, the shutter unit 34*d* includes the deformable shutter member 34*d*2 that is formed to be elastically deformable by using a connection position, as a base point, between the deformable shutter member 34*d*2 and the shutter main unit 34*d*1 that moves along the rail unit of the cap unit 34Y to open and close the toner outlet. The deformable shutter member 34*d*2 includes the stoppers 34*d*22 that regulate a motion of the shutter unit 34*d* in a direction to open the toner outlet that has been closed, and the stopper releasing unit 34*d*21 that releases a contact state between the stoppers 34*d*22 and the contact portions 34*n*5 upon receiving an external force from below.

In the toner container described above, the shutter deformation unit is disposed on the side of the container body in the longitudinal direction with respect to the shutter main unit, the stopper is formed on the tip, which is away from the shutter main unit, of the deformable shutter member, and the stopper releasing unit is formed between the stopper and the connection position.

In the toner container described above, the cap unit includes a housing unit that maintains a deformed state of the deformable shutter member when the shutter unit opens the toner outlet and houses the deformable shutter member.

In the toner container described above, the shutter main unit further includes a second stopper that comes into contact with a second contact portion formed on the cap unit and regulates a motion of the shutter unit in a direction opposite to a direction in which the stopper performs regulation.

In the toner container described above, the cap unit includes a cylindrical cavity formed inside thereof to extend in the longitudinal direction and a toner fall path that has a columnar shape with a constant flow passage area from a lower circumferential surface of the cylindrical cavity to the toner outlet.

In the toner container described above, the container body includes a spiral-shaped projection formed on inner circumferential surface thereof and is held to be rotatable with respect to the cap unit.

The toner container is arranged in the body of the image forming apparatus.

In this way, according to the configuration, the shutter unit includes the deformable shutter member that elastically deforms by using the connection position between the shutter main unit and the deformable shutter member as a base point, and the deformable shutter member includes the stopper that regulates a motion of the shutter unit in the opening direction and the stopper releasing unit that releases the stopper. Accordingly, a toner container and an image forming apparatus can be provided in which the shutter unit that opens and closes the toner outlet is not easily moved when the toner container is isolated from the image forming apparatus.

As described above, the toner container 32Y of the first embodiment includes, on the shutter unit 34*d*, the deformable shutter member 34*d*2 that is elastically deformed by using the connection position of the shutter main unit 34*d*1 as a base point, and also includes, on the deformable shutter member 34*d*2, the stoppers 34*d*22 for regulating the motion of the shutter unit 34*d* in the opening direction and the stopper releasing unit 34*d*21 for releasing the regulation. Therefore, a space for arranging the toner container 32Y can be effectively secured in the body of the image forming apparatus 100 and the toner container 32Y can be set to the image forming body of the image forming apparatus 100 with high fitting capability and operability, so that it is possible to prevent the shutter unit 34*d* that opens and closes the toner outlet W from being easily moved when the toner container 32Y is isolated even when the toner container 32Y is configured to discharge toner from the toner outlet W by the toner's own weight.

Second Embodiment

A second embodiment will be described in detail below with reference to FIGS. 45 to 52. A toner container according to the second embodiment is different from the first embodiment in that the stirring member 33*f* is differently configured.

Figure 45:
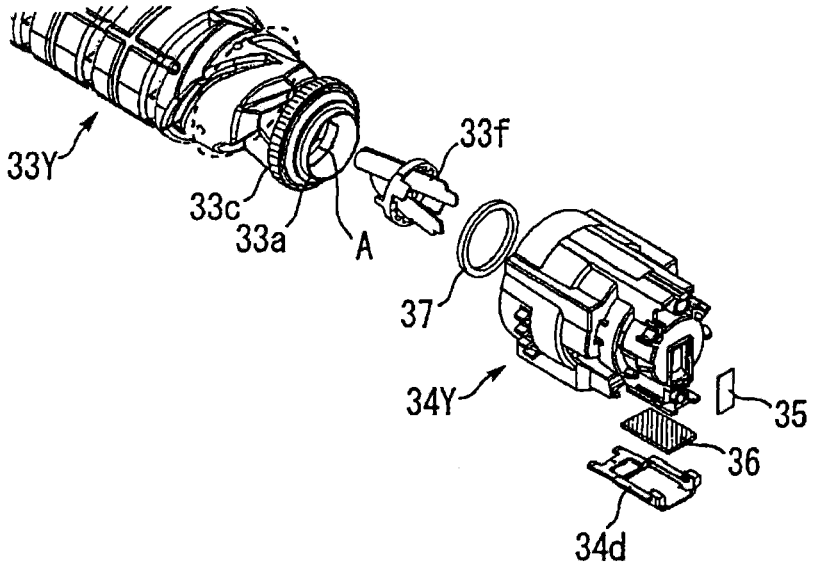
FIG. 45 is an exploded view of a part of a toner container according to a second embodiment of the present invention.

Referring to FIG. 45, the toner container 32Y of the second embodiment mainly includes, similarly to the first embodiment, the container body 33Y (bottle body) and the cap unit 34Y (bottle cap) arranged at the head portion of the container body. The toner container 32Y of the second embodiment further includes, in addition to the container body 33Y and the cap unit 34Y, the stirring member 33*f*, the cap seal 37, the shutter unit 34*d*, the shutter seal 36 as a seal member, and the RFID chip 35 as an electronic-information storage member.

Figure 46:
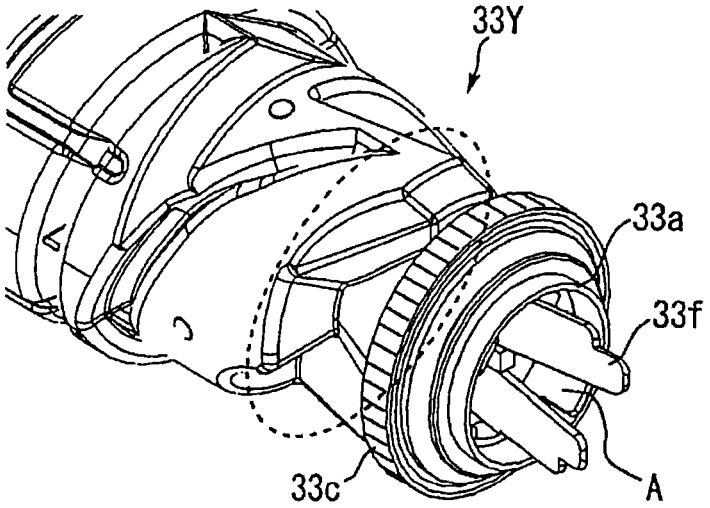
FIG. 46 is a perspective view of a head side of a container body of the toner container illustrated in FIG. 45.

Referring to FIGS. 45 and 46, in the toner container 32Y of the second embodiment, similarly to the first embodiment, the stirring member 33*f* that rotates with the container body 33Y is fitted to the bottle opening 33*a* (the opening A).

Figure 50:
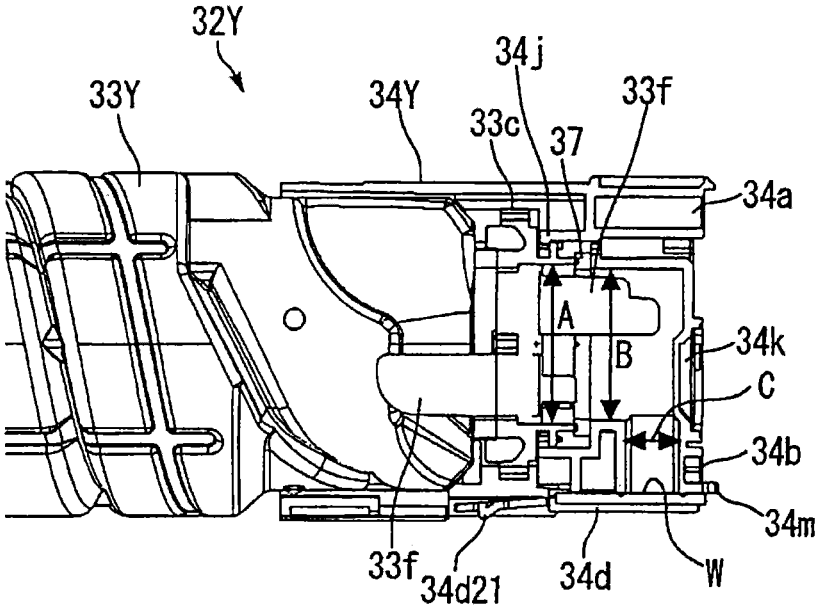
FIG. 50 is a cross-sectional view of the vicinity of the cap unit of the toner container illustrated in FIG. 45.

The stirring member 33*f* is formed of a pair of plate members that extend from the cavity B in the cap unit 34Y to the inside of the container body 33Y (also see FIG. 50). The stirring member 33*f* differs from that of the first embodiment in that the plate members in the pair are alternately tilted in the second embodiment. The stirring member 33*f* is configured such that the tip thereof reaches the upper side of the toner outlet W in the cap unit 34Y and the other end thereof (the end on the opposite side) reaches the scooping portion (a portion surrounded by a dashed circle in FIGS. 45 and 46) when the cap unit 34Y and the container body 33Y are assembled together. Rotation of the stirring member 33*f* in conjunction with the rotation of the opening A of the container body 33Y improves the toner discharging performance from the opening A. In particular, the stirring member 33*f* according to the second embodiment improves toner stirring capability at front and back positions of the opening A because the pair of plate members are alternately tilted.

Referring to FIGS. 45 and 46, engaging members (convex portions), which are engaged with claw members 34*j* (see FIG. 50) of the cap unit 34Y in order to connect the container body 33Y with the cap unit 34Y, are formed around an outer circumference of the bottle opening 33*a* of the container body 33Y. As described above, the container body 33Y (that has the integrally formed gear 33*c*) is engaged with the cap unit 34Y so as to be relatively rotatable against the cap unit 34Y.

The inner diameter of a head portion of the container body 33Y (near the position where the gear 33*c* is formed) is smaller than the inner diameter of a container portion containing toner (the position where the spiral-shaped projection 33*b* is formed) (see FIG. 50). The scooping portion (the portion surrounded by the dashed circle in FIGS. 45 and 46), of which inner circumferential surface protrudes inward, is provided on the head portion of the container body 33Y. Toner conveyed toward the opening A by the spiral-shaped projection 33*b* in association with the rotation of the container body 33Y is scooped, by the scooping portion (the portion surrounded by the dashed circle in FIGS. 45 and 46), into a small-diameter portion of the head portion. The toner scooped into the small-diameter portion of the head portion is stirred by the stirring member 33*f*, and is discharged to the cavity B of the cap unit 34Y through the opening A.

Referring to FIGS. 47 to 50, the shutter unit 34*d*, the shutter seal 36, the cap seal 37 (seal member), and the RFID chip 35 (electronic-information storage member) are arranged on the cap unit 34Y of the toner container 32Y.

Figure 49:
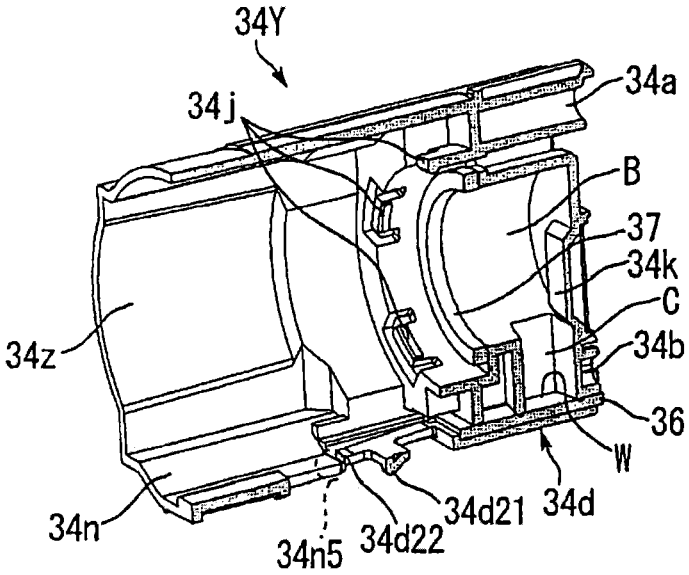
FIG. 49 is a cross-sectional perspective view of the cap unit of the toner container of FIG. 45.
Figure 51:
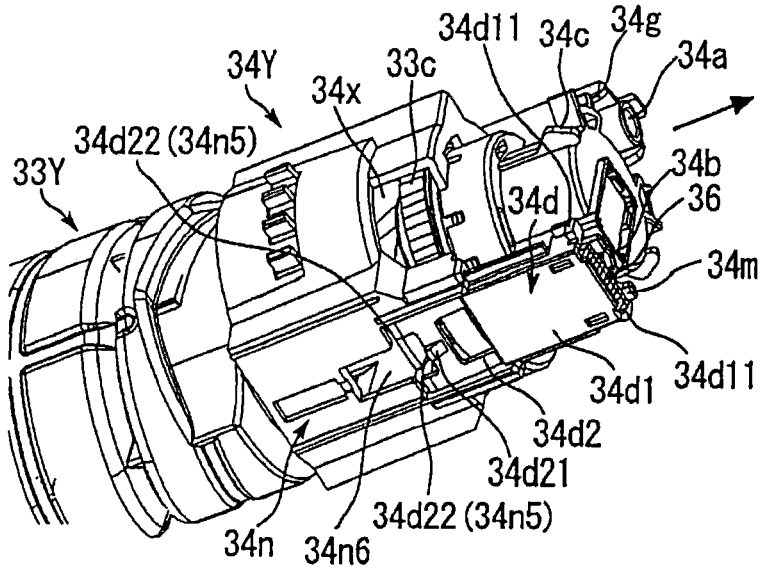
FIG. 51 is a perspective view of a state in which the shutter unit of the toner container of FIG. 45 closes the toner outlet.
Figure 52:
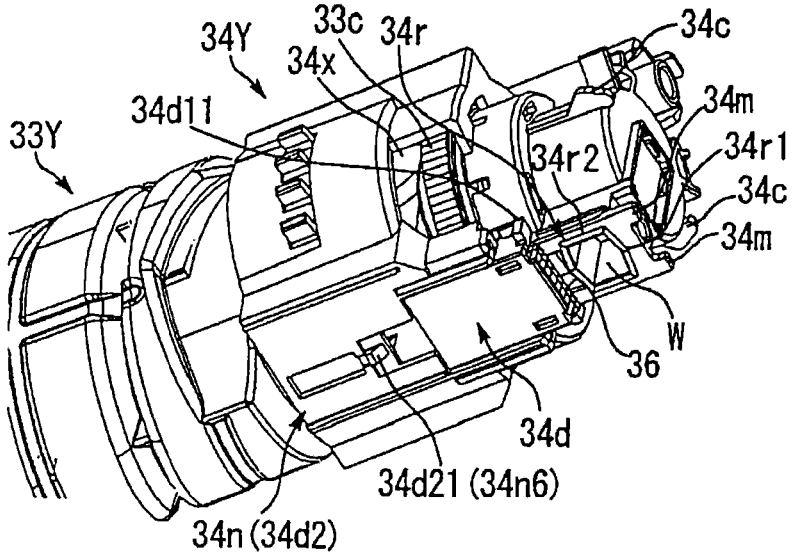
FIG. 52 is a perspective view of a state in which the shutter unit of the toner container illustrated in FIG. 45 opens the toner outlet.

The cap unit 34Y includes the insertion portion 34*z* with an inner diameter greater than the inner diameter of the cavity B (see FIG. 49), and the opening A of the container body 33Y is inserted into the insertion portion 34*z*. Referring to FIGS. 49 and 52, the toner outlet W is formed at the bottom portion of the cap unit 34Y to allow toner that has been discharged from the opening A of the container body 33Y to be discharged to the outside of the toner container in a vertically downward direction (fall by own weight). The shutter unit 34*d* for opening and closing the toner outlet W is held in a slidable manner at the bottom portion of the cap unit 34Y. More specifically, the shutter unit 34*d* relatively moves in the longitudinal direction from the cap unit 34Y side to the container body 33Y side (movement to the left in FIG. 50) to open the toner outlet W. Furthermore, the shutter unit 34*d* relatively moves in the longitudinal direction from the container body 33Y side to the cap unit 34Y side (movement to the right in FIG. 50) to close the toner outlet W. The open/close operation of the shutter unit 34*d* (the open/close operation of the toner outlet W) is performed in association with the attachment/detachment operation of the toner container 32Y to the toner-container holder 70 (the body of the image forming apparatus 100) in the longitudinal direction. FIGS. 51 and 52 illustrate operation of the shutter unit 34*d* from start to completion of opening the toner outlet W.

Figure 47:
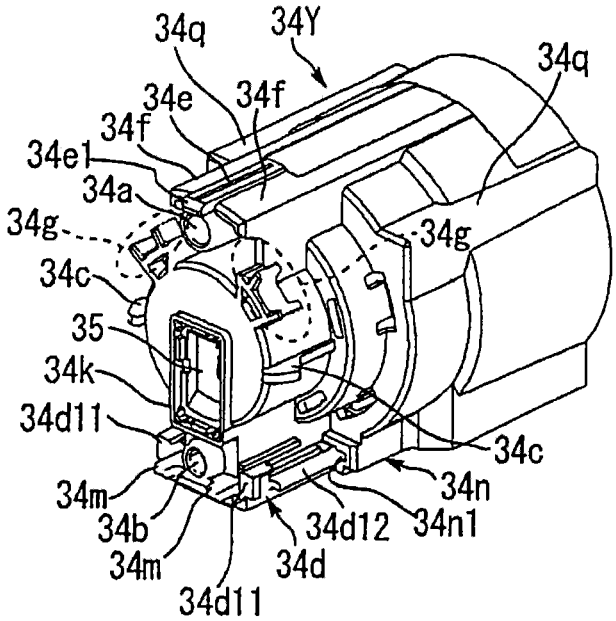
FIG. 47 is a perspective view of a cap unit of the toner container of FIG. 45.
Figure 48:
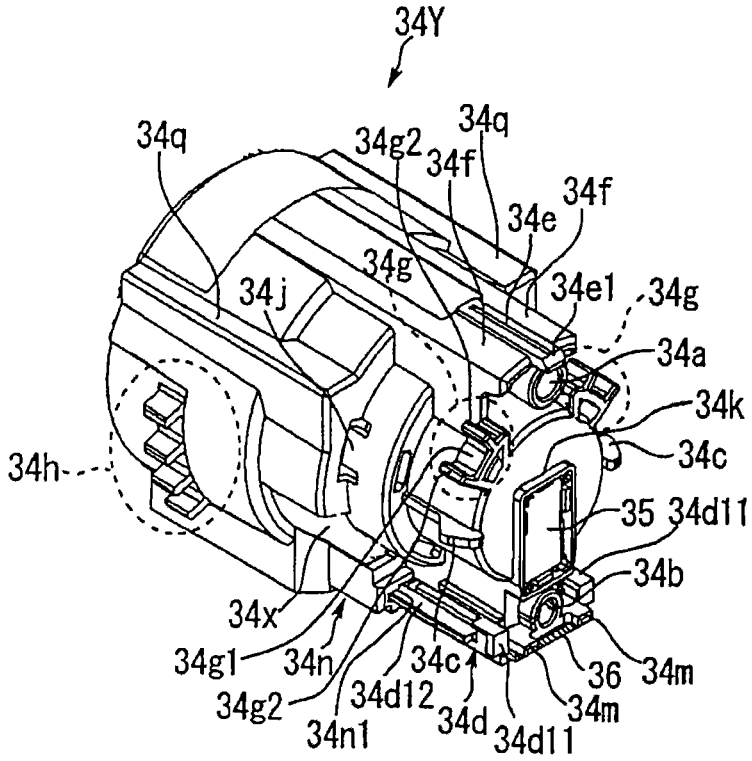
FIG. 48 is another perspective view of the cap unit of the toner container illustrated in FIG. 45.

Referring to FIGS. 47 and 48, the first hole 34*a* (main guide hole) is formed on the upper portion (ceiling portion) of the cap unit 34Y such that the first hole 34*a* extends in the longitudinal direction from the end face of the cap unit 34Y that is perpendicular to the longitudinal direction. The first hole 34*a* functions as a main guide for positioning the cap unit 34Y in the body of the image forming apparatus 100. More specifically, the first hole 34*a* of the cap unit 34Y is engaged with the main guide pin 73*a* of the cap holder 73 in association with the attachment operation of the toner container 32Y to the toner-container holder 70 in the longitudinal direction.

The second hole 34*b* (sub-guide hole) is formed at the lower portion (bottom portion) of the cap unit 34Y such that the second hole 34*b* extends in the longitudinal direction from the end face of the cap unit 34Y that is perpendicular to the longitudinal direction so as not to reach the position of the toner outlet W. The second hole 34*b* functions as a sub-guide for positioning the cap unit 34Y in the body of the image forming apparatus 100. More specifically, the second hole 34*b* of the cap unit 34Y is engaged with the sub-guide pin 73*b* of the cap holder 73 in association with the attachment operation of the toner container 32Y to the toner-container holder 70 in the longitudinal direction. With the use of the two holes 34*a* and 34*b* thus configured, the position of the cap unit 34Y is fixed in the toner-container holder 70.

Referring to FIGS. 47 and 48, shoulder portions 34*q* are formed on the outer circumference of a portion where the insertion portion 34*z* is formed and on both sides on the upper portion of the cap unit 34Y. Each of the shoulder portions 34*q* has a flat top face and a flat lateral face that are approximately perpendicular to each other.

When the toner container 32Y is attached to the toner-container holder 70, the shoulder portions 34*q* come into contact with positioning members (not illustrated), which are arranged on the cap holder 73 of the toner-container holder 70, in association with the attachment operation. Accordingly, backlash of the cap unit 34Y in the cap holder 73 can be suppressed, so that the cap unit 34Y can be smoothly attached to the cap holder 73.

Referring to FIGS. 47 and 48, the lateral projections 34*c* (pressed portions) are arranged on both lateral sides of the cap unit 34Y and protrude from the outer circumferential surface of the cap unit 34Y. The lateral projections 34*c* according to the second embodiment are pressed in a direction against a force in the attachment direction (or the detachment direction) by pressing portions (not illustrated) of the cap holder 73 when the cap unit 34Y is attached to (or detached from) the cap holder 73 of the toner-container holder 70 (the body of the image forming apparatus 100). Therefore, during the attachment operation (or the detachment operation) of the toner container 32Y to the cap holder 73, after a user feels a force against an operating force in the attachment direction (or the detachment direction) at the position where the lateral projections 34*c* are engaged with the pressing portions, the user increases the operating force in the attachment direction (or the detachment direction) to complete the attachment operation (or the detachment operation) instantly. Thus, the user gains a good click feeling in the attachment operation (or the detachment operation) of the toner container 32Y to the cap holder 73.

More specifically, as illustrated in FIGS. 47 and 48, the lateral projections 34*c* according to the second embodiment are formed in ridge shapes along the longitudinal direction (attachment direction). The ridge shapes of the lateral projections 34*c* are formed such that the slopes on the tip side become more gentle than the slopes on the container body side. Therefore, the user can smoothly perform the attachment/detachment operation with a good click feeling when performing the attachment/detachment operation of the toner container 32Y to the cap holder 73.

Referring to FIGS. 47 and 48, the convex portions 34*g* and 34*h* for ensuring the incompatibility of the toner container 32Y with toner containers of other colors are formed on the outer circumferential surface of the cap unit 34Y. The convex portions 34*g* and 34*h* are configured to engage with the lateral grooves 73*c* of the cap holder 73 when the attachment operation of the toner container 32Y to the toner-container holder 70 is correctly performed (when the toner container 32Y is attached to a correct position in the toner-container holder 70). With the above configuration, it is possible to prevent a toner container for a certain color (for example, a toner container for yellow) from being set in a toner-container holder for a different color (for example, a toner-container holder for cyan), thereby preventing a failure to form a desired color image. That is, it is possible to prevent the toner container from being erroneously set in the toner-container holder.

Referring to FIG. 48, the convex portions 34*g* (incompatibly shaped portions) are two projections that are radially formed on the upper portion of the tip of the cap unit 34Y. Each of the two projections (the incompatibly shaped portions 34*g*) includes a base portion 34*g*1 and two incompatible claw members 34*g*2 projecting from the base portion 34*g*1. The base portion 34*g*1 has a trapezoidal shape that spreads out outward. The two incompatible claw members 34*g*2 are arranged so as to radially project outward from the top face of the base portion 34*g*1.

The incompatible claw members 34*g*2 are cut off depending on the type (color) of toner contained in the toner container so as to fulfill the incompatible function for each color. That is, some of the incompatible claw members 34*g*2 are cut off with a cutting tool, such as a nipper or a cutter, from the cap unit 34Y having the four incompatible claw members 34*g*2 in total on the left and right sides, so that the incompatibly shaped portions 34*g* of various shapes can be formed. With the above configuration, it becomes unnecessary to manufacture the same number of molds as the number of types of the toner containers (cap units), and it becomes possible to form a plurality of types of incompatible cap units by using one mold to enable to reduce an entire manufacturing cost for producing the plurality of types of the toner containers.

Referring to FIG. 48, a relatively large space is set between the two incompatible claw members 34*g*2 in the incompatibly shaped portions 34*g* so that the incompatible claw members 34*g*2 can be easily cut off by using a cutting tool such as a nipper or a cutter.

Referring to FIG. 48 and other related drawings such as FIGS. 49 to 52, the cap unit 34Y of the second embodiment includes an incompatible convex portion 34*h* for identifying a destination of the toner container (for example, for domestic use or for export to North America, Europe, and other countries and regions). The convex portion 34*h* is configured to be engaged with an engagement member (not illustrated) formed in the bottle holder 72 when the body of the image forming apparatus 100 as a setting object is compatible (when the cap unit is set in the correct body of the image forming apparatus 100).

In the toner container 32Y according to the second embodiment, similarly to the first embodiment, the shutter seal 36 (seal member) is provided on the surface of the shutter unit 34*d* that faces the toner outlet W, and the vertex portions 34*r*1 of the edge portion 34*r* are formed in pointed shapes so that the edge portion 34*r* provided on the circumference of the toner outlet W of the cap unit 34Y does not cause the shutter seal 36 to be peeled or damaged.

Therefore, also in the second embodiment, similarly to the first embodiment, a space for arranging the toner container 32Y can be effectively secured in the body of the image forming apparatus 100 and the toner container 32Y can be set to the body of the image forming apparatus 100 with high fitting capability and operability, so that it is possible to prevent toner contained in the toner container 32Y from scattering to the outside of the toner container 32Y in association with the attachment/detachment operation of the toner container 32Y to/from the body of the image forming apparatus 100 even when the toner container 32Y is configured to discharge toner from the toner outlet W by the toner's own weight.

Also in the toner container 32Y according to the second embodiment, similarly to the first embodiment, because the vertical surfaces 34*s*, on which the shutter rails 34*t* guiding the open/close operation of the shutter unit 34*d* are formed, extend from the end of the shutter unit 34*d*, which is at a position of closing the toner outlet W in the closing direction, to the protruding position in the longitudinal direction, a timing at which the shutter closing mechanisms 73*d* arranged in the body of the image forming apparatus 100 release holding of the shutter unit 34*d* using the vertical surfaces 34*s* as references can be delayed in comparison to a timing at which the shutter closing mechanisms 73*d* completely close the shutter unit 34*d*.

Therefore, also in the second embodiment, similarly to the first embodiment, a space for arranging the toner container 32Y can be effectively secured in the body of the image forming apparatus 100 and the toner container 32Y can be set to the body of the image forming apparatus 100 with high fitting capability and operability, so that it is possible to prevent toner contained in the toner container 32Y from scattering to the outside of the toner container 32Y in association with detachment operation of the toner container 32Y from the body of the image forming apparatus 100 even when the toner container 32Y is configured to discharge toner from the toner outlet W by the toner's own weight.

Also in the toner container 32Y of the second embodiment, similarly to the first embodiment, the shutter unit 34*d* includes the deformable shutter member 34*d*2 that is elastically deformed by using the connection position of the shutter main unit 34*d*1 as a base point, and also includes, on the deformable shutter member 34*d*2, the stoppers 34*d*22 for regulating the motion of the shutter unit 34*d* in the opening direction and the stopper releasing unit 34*d*21 for releasing the regulation.

Therefore, also in the second embodiment, similarly to the first embodiment, a space for arranging the toner container 32Y can be effectively secured in the body of the image forming apparatus 100 and the toner container 32Y can be set to the body of the image forming apparatus 100 with high fitting capability and operability, so that it is possible to prevent the shutter unit 34*d* that opens and closes the toner outlet W from being easily moved when the toner container 32Y remains isolated even when the toner container 32Y is configured to discharge toner from the toner outlet W by the toner's own weight.

Third Embodiment

A third embodiment will be described in detail below with reference to FIGS. 53 to 56. A toner container according to the third embodiment is different from the second embodiment in that the stirring member 33*f* is differently configured.

The toner container 32Y of the third embodiment mainly includes, similarly to the second embodiment, the container body 33Y (bottle body) and the cap unit 34Y (bottle cap) arranged on the head portion of the container body. The toner container 32Y of the third embodiment further includes, in addition to the container body 33Y and the cap unit 34Y, the stirring member 33*f*, the cap seal 37, the shutter unit 34*d*, the shutter seal 36 as a seal member, and the RFID chip 35 as an electronic-information storage member (see FIG. 45).

In the toner container 32Y of the third embodiment, similarly to the second embodiment, the stirring member 33*f* that rotates in association with the container body 33Y is fitted to the bottle opening 33*a* (the opening A). Specifically, referring to FIGS. 53 to 55, a fitting portion 33*f*2 of the stirring member 33*f* is press-fitted to the bottle opening 33*a* (the opening A) illustrated in FIG. 45.

Figure 53:
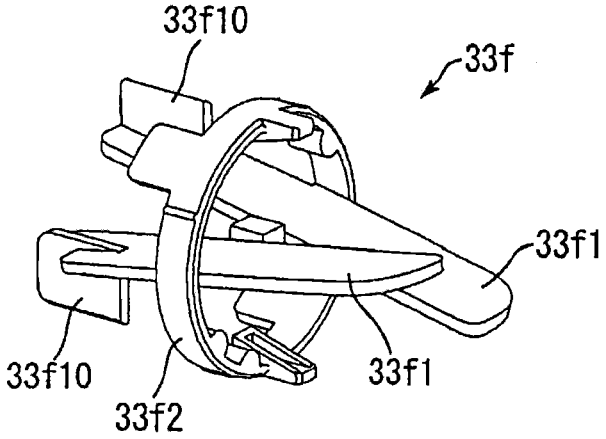
FIG. 53 is a perspective view of a stirring member of a toner container according to a third embodiment of the present invention.
Figure 54:
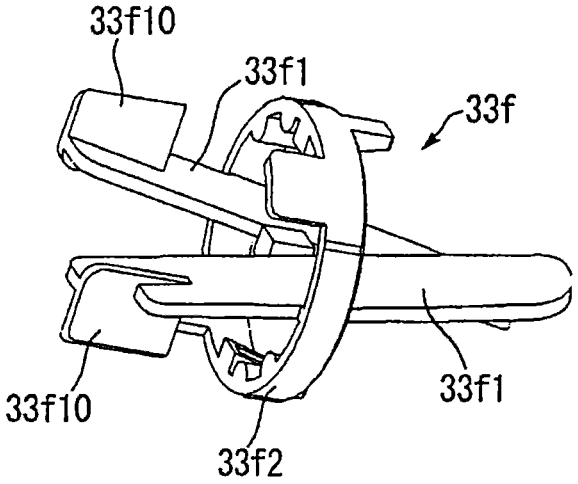
FIG. 54 is another perspective view of the stirring member illustrated in FIG. 53.
Figure 55:
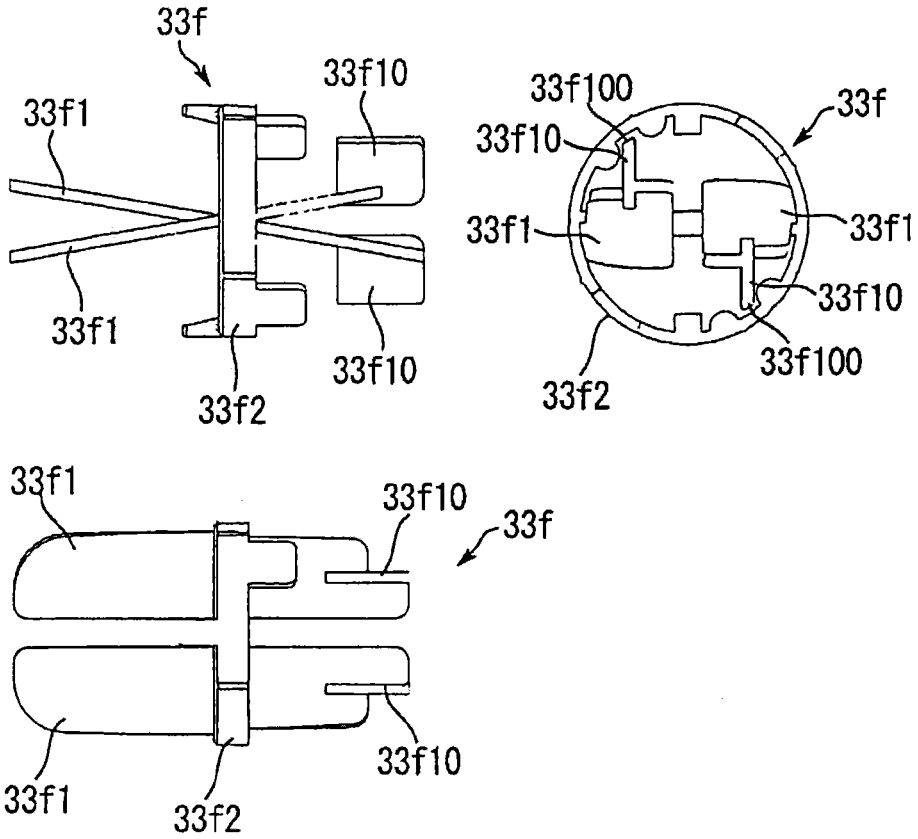
FIG. 55 illustrates three sides view of the stirring member illustrated in FIG. 53.

As illustrated in FIGS. 53 to 55, the stirring member 33*f* of the third embodiment includes plate members 33*f*1 being a pair, which extends from the cavity B in the cap unit 34Y toward the inside of the container body 33Y. The plate members 33*f*1 of the stirring member 33*f* are alternately tilted, similarly to the second embodiment. The stirring member 33*f* is configured such that the tip thereof (on the side where push plates 33*f*10 are formed) reaches the upper side of the toner outlet W in the cap unit 34Y and the other end thereof (the end on the opposite side) reaches the scooping portion (the portion surrounded by the dashed circle in FIGS. 45 and 46) when the cap unit 34Y and the container body 33Y are assembled together. Rotation of the stirring member 33*f* in conjunction with the rotation of the opening A of the container body 33Y improves the toner discharging performance of the opening A.

As illustrated in FIGS. 53 to 55, the stirring member 33*f* of the third embodiment is different from the second embodiment in that the push plates 33*f*10 are arranged on the tips of the plate members 33*f*1 (on the side toward the inside of the cap unit 34Y). The push plates 33*f*10 are plate members that stand approximately perpendicular to the main bodies of the plate members 33*f*1. Each of the push plates 33*f*10 includes a tapered portion 33*f*100 on the outer circumference thereof.

As described above, because the push plates 33*f*10 are arranged on the tips of the plate members 33*f*1 of the stirring member 33*f*, the push plates 33*f*10 push toner toward the toner outlet W in the cap unit 34Y in association with the rotation of the stirring member 33*f*. Therefore, even when the cap unit 34Y is clogged with toner in the vicinity of the toner outlet W (the toner fall path C), the toner can be smoothly discharged from the toner outlet W.

FIGS. 56A to 56D are schematic front views of how the stirring member 33*f* rotates in the toner container 32Y that has the stirring member 33*f* with the push plates 33*f*10 (the stirring member 33*f* of the third embodiment). On the other hand, FIGS. 57A to 57D are schematic front views of how the stirring member 33*f* rotates in the toner container 32Y that has the stirring member 33*f* without the push plates 33*f*10 (the stirring member 33*f* of the second embodiment).

Figures 56A, 56B, 56C, 56D:
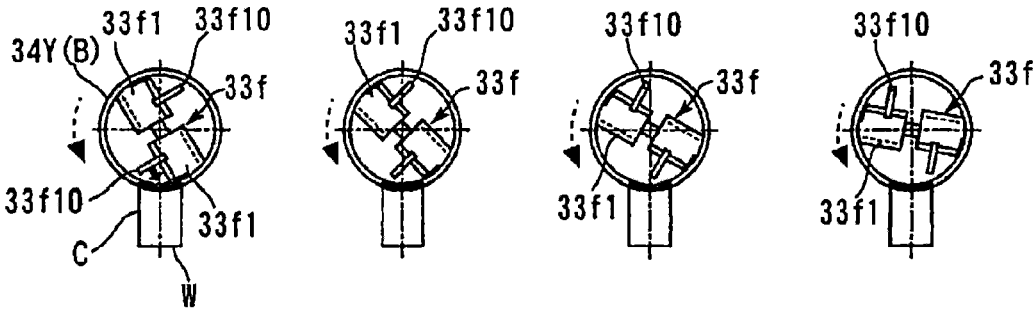
FIGS. 56A to 56D are schematic front views of how the stirring member illustrated in FIG. 53 rotates.
Figures 57A, 57B, 57C, 57D:
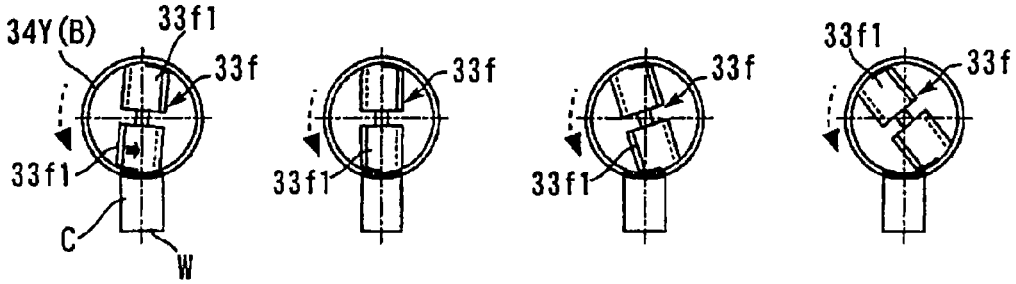
FIGS. 57A to 57D schematic front views of how the stirring member of the toner container illustrated in FIG. 45 rotates.

In FIGS. 56A and 57A, black arrows indicate a toner conveying direction in which the stirring member 33*f* conveys toner toward the toner outlet W (the toner supply port 73*w*).

As illustrated in FIG. 57A, when the push plates 33*f*10 are not arranged on the tips of the plate members 33*f*1 of the stirring member 33*f*, the push plates 33*f*10 convey toner in a circumferential direction along the inner circumference of the cap unit 34Y in association with the rotation of the stirring member 33*f*. By contrast, as illustrated in FIG. 56A, when the push plates 33*f*10 are arranged on the tips of the plate members 33*f*1 of the stirring member 33*f*, the push plates 33*f*10 convey toner toward the toner outlet W (conveyance in an approximately normal direction with respect to the inner circumference of the cap unit 34Y) in association with the rotation of the stirring member 33*f*.

In the toner container 32Y according to the third embodiment, similarly to each of the above-described embodiments, the shutter seal 36 (seal member) is provided on the surface of the shutter unit 34*d* to face the toner outlet W, and the vertex portions 34*r*1 of the edge portion 34*r* are formed in pointed shapes so that the edge portion 34*r* provided on the circumference of the toner outlet W of the cap unit 34Y does not cause the shutter seal 36 to be peeled or broken.

Therefore, also in the third embodiment, similarly to each of the above-described embodiments, a space for arranging the toner container 32Y can be effectively secured in the body of the image forming apparatus 100 and the toner container 32Y can be set to the body of the image forming apparatus 100 with high fitting capability and operability, so that it is possible to prevent toner contained in the toner container 32Y from scattering to the outside of the toner container 32Y in association with attachment/detachment operation of the toner container 32Y to the body of the image forming apparatus 100 even when the toner container 32Y is configured to discharge toner from the toner outlet W by the toner's own weight.

Fourth Embodiment

A fourth embodiment will be described in detail below with reference to FIGS. 58, 59, and 60A to 60G. A toner container according to the fourth embodiment is different from the third embodiment in that a flexible member 34*u* is disposed near the toner outlet W of the cap unit 34Y.

The toner container 32Y of the fourth embodiment mainly includes, similarly to the third embodiment, the container body 33Y (bottle body) and the cap unit 34Y (bottle cap) arranged on the head portion of the container body. The toner container 32Y of the fourth embodiment further includes, in addition to the container body 33Y and the cap unit 34Y, the stirring member 33*f*, the cap seal 37, the shutter unit 34*d*, the shutter seal 36 as a seal member, and the RFID chip 35 as an electronic-information storage member (see FIG. 45).

In the toner container 32Y of the fourth embodiment, similarly to the third embodiment, the stirring member 33*f* that rotates in conjunction with the container body 33Y is fitted to the bottle opening 33*a* (the opening A).

Figure 58:
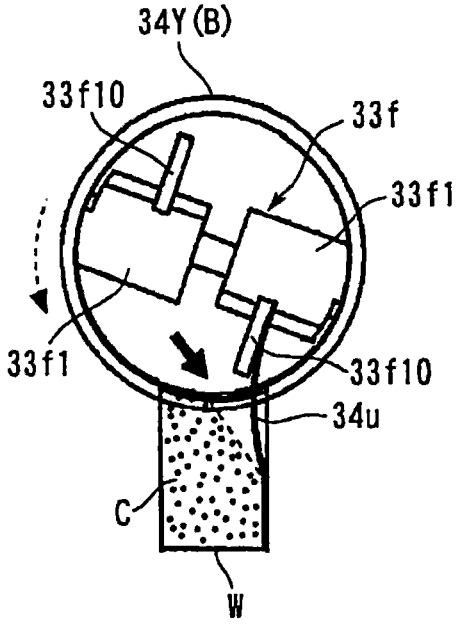
FIG. 58 is a schematic cross-sectional view of a cap unit of a toner container according to a fourth embodiment of the present invention.

As illustrated in FIG. 58, the stirring member 33*f* of the fourth embodiment includes the plate members 33*f*1 being a pair, which extends from the cavity B in the cap unit 34Y toward the inside of the container body 33Y (which are alternately tilted). The stirring member 33*f* of the fourth embodiment further includes the push plates 33*f*10 on the tips of the plate members 33*f*1 (on the side toward the inside of the cap unit 34Y), similarly to the third embodiment.

Figure 59:
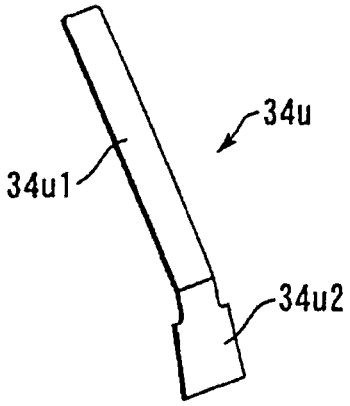
FIG. 59 is a perspective view of a flexible member disposed near a toner outlet of the toner container illustrated in FIG. 57.

Referring to FIGS. 58, 59, and 60A to 60G, the cap unit 34Y of the fourth embodiment is different from the third embodiment in that the cap unit 34Y includes a flexible member 34*u* made of flexible material such as mylar with a thickness of about 0.188 mm to 0.5 mm extending from the toner fall path C to the cavity B. More specifically, as illustrated in FIG. 59, a part of the flexible member 34*u* is bent, and a fixation portion 34*u*2 (with a width wider than a flexible portion 34*u*1) as an attachment surface is attached (fixed) to the inner wall of the toner fall path C (the inner wall on the side near the toner outlet W and on the downstream side of the stirring member 33*f* in the rotational direction). Specifically, the fixation portion 34*u*2 is attached to the inner wall of the toner fall path C so that the bent portion of the flexible member 34*u* can be located in the toner fall path C. The flexible portion 34*u*1 of the flexible member 34*u* is a free end and extends from the toner fall path C to the inside of the cavity B. The tip of the flexible portion 34*u*1 comes into contact with the push plates 33*f*10 in association with the rotation of the stirring member 33*f*, so that even when the cap unit 34Y is clogged with toner in the vicinity of the toner outlet W (the toner fall path C) is clogged with toner, the toner can be smoothly discharged from the toner outlet W.

Figure 60A:
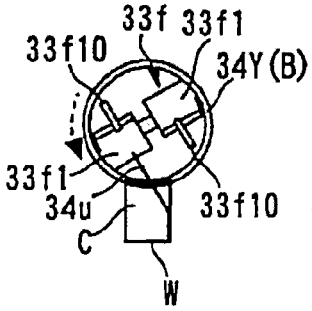
FIGS. 60A to 60G schematic front views of how a stirring member of the toner container illustrated in FIG. 57 rotates.
Figure 60B:
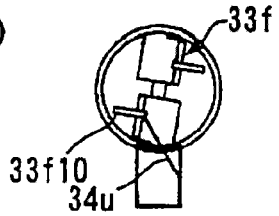
Figure 60C:
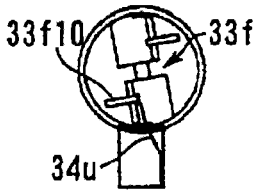
Figure 60D:
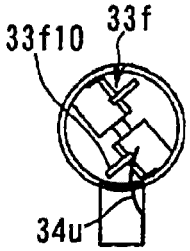

More specifically, as illustrated in FIGS. 60A to 60D, the push plates 33*f*10 push the flexible member 34*u* (the flexible portion 34*u*1) in association with the rotation of the stirring member 33*f*, so that the flexible member 34*u* is gradually bent in an arched shape. At this time, even when the portion between the inner wall of the toner fall path C and the flexible member 34*u* is clogged with toner with the stirring member 33*f* being in the state illustrated in FIG. 60A, because the flexible member 34*u* is greatly bent in an arched shape and the space between the inner wall of the toner fall path C and the flexible member 34*u* increases as illustrated in FIG. 60D, toner clogging the toner fall path C is loosened.

Figure 60E:
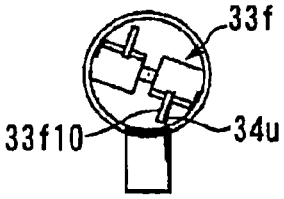
Figure 60F:
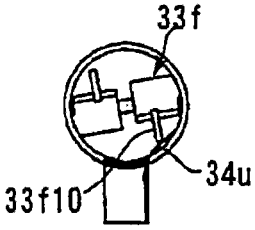
Figure 60G:
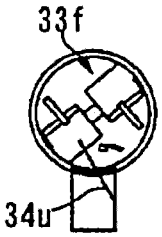

Thereafter, as illustrated in FIG. 60E, a planer portion of the push plate 33*f*10 and a planer portion of the flexible member 34*u* overlap each other, and the flexible member 34*u* is deformed to become nearly flat from the fixation portion 34*u*2 to the flexible portion 34*u*1. During this deformation, the space between the flexible member 34*u* and the toner becomes large to promote the toner for further loosening and the toner is further supplied to the space by being pushed by the push plate 33*f*10 (the state illustrated in FIG. 58). Accordingly, toner discharging efficiency and toner loosening performance at the toner outlet W (the toner fall path C) are promoted. Thereafter, as illustrated in FIG. 60F, the flexible member 34*u* gets completely warped, and the contact between the flexible member 34*u* and the push plate 33*f*10 is released. Then, as illustrated in FIG. 60G, the flexible member 34*u* is returned to the initial state by the elastic force of the flexible member 34*u*. At this time, the toner receives a restoring force caused by the elasticity of the flexible member 34*u*, so that the toner loosening and the toner discharging at the toner fall path C are promoted.

The shape of the flexible member 34*u* is not limited to that described in the fourth embodiment. For example, the flexible member 34*u* may not have a bent portion, or may have the fixation portion 34*u*2 in a different shape.

In the toner container 32Y according to the fourth embodiment, similarly to each of the above-described embodiments, the shutter seal 36 (seal member) is provided on the surface of the shutter unit 34*d* that faces the toner outlet W, and the vertex portions 34*r*1 of the edge portion 34*r* are formed in pointed shapes so that the edge portion 34*r* provided on the circumference of the toner outlet W of the cap unit 34Y does not cause the shutter seal 36 to be peeled or damaged.

Therefore, also in the fourth embodiment, similarly to each of the above-described embodiments, a space for arranging the toner container 32Y can be effectively secured in the body of the image forming apparatus 100 and the toner container 32Y can be set to the body of the image forming apparatus 100 with high fitting capability and operability, so that it is possible to prevent toner contained in the toner container 32Y from scattering to the outside of the toner container 32Y in association with attachment/detachment operation of the toner container 32Y to the body of the image forming apparatus 100 even when the toner container 32Y is configured to discharge toner from the toner outlet W by the toner's own weight.

In the above embodiments, only toner is contained in the toner containers 32Y, 32M, 32C, and 32K. However, it is possible to contain two-component developer in the toner containers 32Y, 32M, 32C, and 32K for an image forming apparatus that appropriately supplies two-component developer formed of toner and carrier to a developing device. Even for this case, the same advantages as described above can be achieved.

In the above embodiments, a part or all of the image forming units 6Y, 6M, 6C, and 6K may be configured as process cartridges. Even for this case, the same advantages as described above can be achieved.

In the above embodiments, the container body 33Y is made rotatable so that toner contained in the container body 33Y can be conveyed toward the opening A. However, the container body 33Y may be configured such that the container body 33Y is non-rotatably held by the toner-container holder 70 together with the cap unit 34Y, and the container body 33Y includes, inside thereof, a conveying member (for example, a conveying member that has a conveying coil or a plurality of conveying blades on a shaft portion and that rotates in a predetermined direction by a gear separated from the container body) for conveying toner toward the opening A so that toner contained in the container body 33Y can be conveyed toward the opening A (see FIG. 61).

Figure 61:
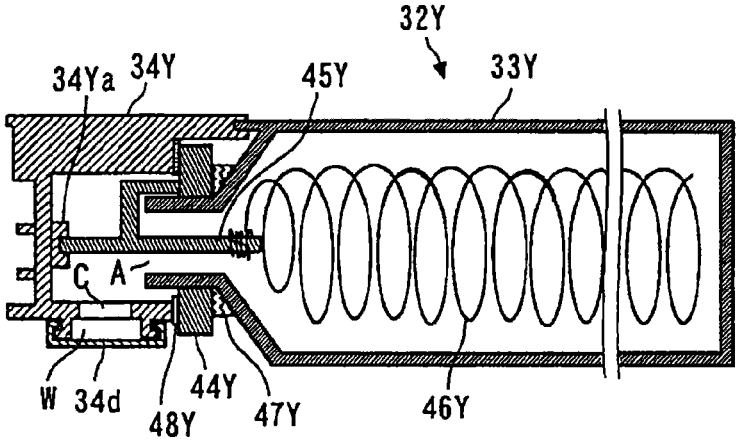
FIG. 61 is a configuration diagram of a toner container having another configuration.

More specifically, as illustrated in FIG. 61, the toner container 32Y mainly includes the container body 33Y, a gear 44Y, and the cap unit 34Y (bottle cap). The opening A is arranged on the head portion of the container body 33Y, and the gear 44Y is rotatably arranged on the outer circumference of the opening A. The gear 44Y engages with the driving gear of the body of the image forming apparatus 100 to rotate a coil 46Y about an axis of rotation. The opening A is used for discharging toner contained in the container body 33Y to the space inside the cap unit 34Y. A rotary shaft 45Y is integrally arranged on the gear 44Y, and the spiral-shaped coil 46Y (conveying coil) is connected to the rotary shaft 45Y. One end of the rotary shaft 45Y is supported by a bearing 34Ya of the cap unit 34Y. The coil 46Y is extended from the opening A to the bottom portion inside the container body 33Y. The gear 44Y rotates around the container body 33Y to thereby rotate the rotary shaft 45Y and the coil 46Y. Therefore, toner contained in the container body 33Y is conveyed to the opening A side by a toner conveying force of the coil 46Y. The gear 44Y is inserted into the outer circumference of the opening A so as to be sandwiched by the container body 33Y and the cap unit 34Y. A rubber member 47Y is disposed between the gear 44Y and the container body 33Y on the side of one of the faces of the gear 44Y. A seal member 48Y is disposed between the gear 44Y and the cap unit 34Y on the other side of the gear 44Y. With this configuration, the sealing capability of the entirety of the toner container 32Y is ensured. That is, it is possible to prevent toner from leaking through a gap between any pairs of the gear 44Y, the container body 33Y, and the cap unit 34Y.

The present invention can also be applied to the above toner container 32Y similarly to the above embodiments. Accordingly, it is possible to achieve the same advantages of the above embodiments.

In the above embodiments, in each of the toner supply devices 60Y, 60M, 60C, and 60K, the toner conveying path formed with the toner tank (61Y), the toner conveyor (62Y, 63Y), and the toner-falling conveying path (64Y) has a reversed N-character shape (similarly to the shape of the Russian letter И ) as illustrated in FIG. 1 (an N-character shape when viewed from the rear side of FIG. 1). The toner conveyer (62Y, 63Y) for each color is provided on the upper side of the process cartridge (the image forming unit 6Y) for the corresponding color, and on the upper side of the opening for attachment and detachment of the process cartridge to the body of the image forming apparatus 100. The toner container (32Y), the toner tank (61Y) and the upstream side of the toner conveyor (62Y) for each color are provided on the upper side of the nearby process cartridge (the left neighbor in FIG. 1), not of the process cartridge for the corresponding color. With above configuration, in a tandem type image forming apparatus in which a plurality of process cartridges (image forming units) are arranged in parallel, a process cartridge (image forming unit) does not cause interference with the toner supply device when the attachment or detachment operation of the process cartridge is performed. In addition, it is possible to provide an image forming apparatus in which the layout of the toner containers and the process cartridges for the respective colors in the vertical direction can be achieved in a compact manner without variance in the amount of a toner supply.

It is understood that the present invention is not limited to the above-described embodiments, and the embodiments can be readily modified within the range of the technical concepts of the present invention. The number, positions, shapes of elements are not limited to those in the embodiments. The number, positions, shapes of elements suitable for embodying the present invention can be employed.

Industrial Applicability

As described above, a toner container and an image forming apparatus according to the present invention is useful for an image forming apparatus such as a copying machine, a printer, and a multifunction peripheral that has functions of the copying machine and the printer, and is particularly suitable for an apparatus that has a mechanism in which powder such as toner is housed, attached and supplied to the apparatus, and a system including the apparatus.

What is claimed:

1. A toner container to be attached to an image forming apparatus, the toner container comprising:

a toner storage section having a length parallel to a longitudinal direction of the toner container, the longitudinal direction being horizontal when the toner container is attached to the image forming apparatus;

a toner outlet for discharging toner to outside of the toner container, the toner outlet for discharging the toner in a vertically downward direction when the toner container is attached to the image forming apparatus, the toner outlet including an edge which protrudes downwardly when the toner container is attached to the image forming apparatus, a portion of the edge which is generally transverse to the longitudinal direction including a tip that points in the longitudinal direction and is directed away from a center of the toner outlet;

a shutter, slidably attached to the toner container, that is movable along the longitudinal direction of the toner container to open and close the toner outlet; and a seal on a surface of the shutter which faces the toner outlet.

2. The toner container according to claim 1, wherein:

the edge comprises a hexagonal shape with parallel portions opposing each other along the longitudinal direction, the parallel portions being two sides of the hexagonal shape, said portion of the edge which is generally transverse to the longitudinal direction being another two sides of the hexagon shape, the edge further comprises another portion which is generally transverse to the longitudinal direction including another tip that points in the longitudinal direction in a direction opposite to a direction said tip points, and is directed away from the center of the toner outlet, the another portion being another two sides of the hexagon shape.

3. The toner container according to claim 2, wherein the toner outlet comprises a hexagonal shape that corresponds to the hexagonal shape of the edge.

4. The toner container according to claim 1, wherein the tips of the edge have tapered shapes such that an amount of downward protrusion when the toner container is attached to the image forming apparatus gradually decreases with an increase in a distance from the center of the toner outlet.

5. The toner container according to claim 1, wherein the edge includes sides generally facing in the longitudinal direction, the sides having tapered shapes each protruding downwardly such that an amount of downward protrusion gradually decreases with an increase in a distance from the center of the toner outlet.

6. The toner container according to claim 1, wherein the seal is disposed so as to protrude in the longitudinal direction from an end of the shutter in a closing direction of the shutter.

7. The toner container according to claim 1, wherein:

the toner storage section includes a cylindrical cavity which extend in the longitudinal direction, and a toner fall path that has a columnar shape with a flow passage area from a lower circumferential surface of the cylindrical cavity to the toner outlet.

8. The toner container according to claim 1, further comprising:

toner within toner storage section.

9. An image forming apparatus comprising the toner container according to claim 1, the toner container being set in and attached to a body of the image forming apparatus.

10. A toner container to be attached to an image forming apparatus, the toner container comprising:

a toner storage section having a length parallel to a longitudinal direction of the toner container, the longitudinal direction being horizontal when the toner container is attached to the image forming apparatus;

a toner outlet for discharging toner to outside of the toner container, the toner outlet for discharging the toner in a vertically downward direction when the toner container is attached to the image forming apparatus, the toner outlet including a lip which protrudes downwardly when the toner container is attached to the image forming apparatus, a portion of the lip which is generally transverse to the longitudinal direction including a corner that points in the longitudinal direction and is directed away from a center of the toner outlet;

a shutter, slidably attached to the toner container, that is movable along the longitudinal direction of the toner container to open and close the toner outlet; and a seal on a surface of the shutter which faces the toner outlet.

11. The toner container according to claim 10, wherein:

the lip comprises a hexagonal shape with parallel portions opposing each other along the longitudinal direction, the parallel portions being two sides of the hexagonal shape, said portion of the lip which is generally transverse to the longitudinal direction being another two sides of the hexagon shape, the lip further comprises another portion which is generally transverse to the longitudinal direction including another corner that points in the longitudinal direction in a direction opposite to a direction said corner points, and is directed away from the center of the toner outlet, the another portion being another two sides of the hexagon shape.

12. The toner container according to claim 11, wherein the toner outlet comprises a hexagonal shape that corresponds to the hexagonal shape of the lip.

13. The toner container according to claim 12, wherein the corners of the lip have tapered shapes such that an amount of downward protrusion when the toner container is attached to the image forming apparatus gradually decreases with an increase in a distance from the center of the toner outlet.

14. The toner container according to claim 10, wherein the lip includes sides generally facing in the longitudinal direction, the sides having tapered shapes each protruding downwardly such that an amount of downward protrusion gradually decreases with an increase in a distance from the center of the toner outlet.

15. The toner container according to claim 10, wherein the seal is disposed so as to protrude in the longitudinal direction from an end of the shutter in a closing direction of the shutter.

16. The toner container according to claim 10, wherein:

the toner storage section includes a cylindrical cavity which extend in the longitudinal direction, and a toner fall path that has a columnar shape with a flow passage area from a lower circumferential surface of the cylindrical cavity to the toner outlet.

17. The toner container according to claim 10, further comprising:

toner within toner storage section.

18. An image forming apparatus comprising the toner container according to claim 10, the toner container being set in and attached to a body of the image forming apparatus.

19. A toner container to be attached to an image forming apparatus, the toner container comprising:

a toner storage section having a length parallel to a longitudinal direction of the toner container, the longitudinal direction being horizontal when the toner container is attached to the image forming apparatus;

a toner outlet for discharging toner to outside of the toner container, the toner outlet for discharging the toner in a vertically downward direction when the toner container is attached to the image forming apparatus, an outer portion of the toner outlet defined by a lip which protrudes downwardly when the toner container is attached to the image forming apparatus, a portion of the lip which is generally transverse to the longitudinal direction including a corner that points in the longitudinal direction and is directed away from a center of the toner outlet;

a shutter, slidably attached to the toner container, that is movable along the longitudinal direction of the toner container to open and close the toner outlet; and a seal on a surface of the shutter which faces the toner outlet.

20. The toner container according to claim 19, wherein:

the lip comprises a hexagonal shape with parallel portions opposing each other along the longitudinal direction, the parallel portions being two sides of the hexagonal shape, said portion of the lip which is generally transverse to the longitudinal direction being another two sides of the hexagon shape, the lip further comprises another portion which is generally transverse to the longitudinal direction including another corner that points in the longitudinal direction in a direction opposite to a direction said corner points, and is directed away from the center of the toner outlet, the another portion being another two sides of the hexagon shape.

21. A toner container to be attached to an image forming apparatus, the toner container comprising:

a shutter that is slidably attached the toner container;

a toner outlet for discharging toner to outside of the toner container, the toner outlet for discharging the toner in a vertically downward direction when the toner container is attached to the image forming apparatus, the toner outlet including an edge which protrudes downwardly when the toner container is attached to the image forming apparatus, a portion of the edge including a tip that points in a moving direction of the shutter, the shutter to open and close the toner outlet;

a seal disposed between the shutter and the toner outlet, when the shutter is in a closed position.

22. The toner container according to claim 21, wherein:

the portion of the edge that includes the tip comprises two straight portions which are joined at the tip.

* * * * *